US011735358B2

(12) United States Patent
Yoshida et al.

(10) Patent No.: US 11,735,358 B2
(45) Date of Patent: Aug. 22, 2023

(54) BONDED MAGNET, BONDED MAGNET COMPONENT, AND BONDED MAGNET PRODUCTION METHOD

(71) Applicant: NICHIA CORPORATION, Anan (JP)

(72) Inventors: Rie Yoshida, Anan (JP); Michiya Kume, Anan (JP); Kohei Ihara, Tokushima (JP); Taku Ichimori, Tokushima (JP)

(73) Assignee: NICHIA CORPORATION, Anan (JP)

( * ) Notice: Subject to any disclaimer, the term of this patent is extended or adjusted under 35 U.S.C. 154(b) by 299 days.

(21) Appl. No.: 17/073,914

(22) Filed: Oct. 19, 2020

(65) Prior Publication Data

US 2021/0104361 A1 Apr. 8, 2021

Related U.S. Application Data

(62) Division of application No. 15/404,501, filed on Jan. 12, 2017, now Pat. No. 10,832,863, which is a (Continued)

(30) Foreign Application Priority Data

| | | |
|---|---|---|
| Sep. 30, 2014 | (JP) | 2014-202540 |
| Dec. 29, 2014 | (JP) | 2014-267077 |
| Aug. 27, 2015 | (JP) | 2015-167734 |

(51) Int. Cl.
*H01F 41/02* (2006.01)
*H01F 7/02* (2006.01)

(52) U.S. Cl.
CPC ..... *H01F 41/0266* (2013.01); *H01F 7/021* (2013.01); *H01F 41/0273* (2013.01)

(58) Field of Classification Search
CPC .. H01F 41/0266; H01F 41/0273; H01F 7/021; H01F 3/08; H02K 1/06; H02K 15/03
See application file for complete search history.

(56) References Cited

U.S. PATENT DOCUMENTS

| | | | |
|---|---|---|---|
| 4,222,021 | A | 9/1980 | Bunker, Jr. |
| 4,444,550 | A | 4/1984 | Loubier |

(Continued)

FOREIGN PATENT DOCUMENTS

| | | | |
|---|---|---|---|
| GB | 2014366 | A | 8/1979 |
| JP | S58-107609 | A | 6/1983 |

(Continued)

OTHER PUBLICATIONS

Extended European Search Report, dated Jun. 23, 2016, in European Patent Application No. 15187343.7.

*Primary Examiner* — John A Hevey
(74) *Attorney, Agent, or Firm* — Hunton Andrews Kurth LLP

(57) ABSTRACT

A bonded magnet is provided which includes first and second components. The first and second components have first and second non-action surfaces, and first and second action surfaces that intersect the first and second non-action surfaces, respectively. First and second flux groups curve inside the first and second components from the first and second non-action surfaces to the first and second action surfaces, respectively. The areas of the first and second non-action surfaces are greater than the first and second action surfaces, respectively. The flux densities on the first and second action surfaces are higher than the first and second non-action surfaces, respectively. The pole on the first non-action surface is opposite to the second non-action surface. The first and second non-action surfaces are coupled to each other. The first flux groups continuously extend from one to another.

18 Claims, 47 Drawing Sheets

Related U.S. Application Data division of application No. 14/867,714, filed on Sep. 28, 2015, now Pat. No. 9,583,244.

(56) References Cited

U.S. PATENT DOCUMENTS

| | | | | |
|---|---|---|---|---|
| 4,536,230 | A | 8/1985 | Landa | |
| 4,544,904 | A | 10/1985 | Tarachand | |
| 4,547,758 | A | 10/1985 | Shimizu et al. | |
| 5,019,796 | A | 5/1991 | Lee et al. | |
| 5,349,258 | A | 9/1994 | Leupold | |
| 5,384,957 | A * | 1/1995 | Mohri | H01F 41/028 492/8 |
| 5,416,457 | A | 5/1995 | Nakatsuka et al. | |
| 6,021,296 | A | 2/2000 | Tamura et al. | |
| 8,138,873 | B2 | 3/2012 | Zhang | |
| 2007/0024405 | A1 | 2/2007 | Terasaki | |
| 2008/0218007 | A1 | 9/2008 | Masuzawa et al. | |
| 2013/0192723 | A1 | 8/2013 | Komura et al. | |
| 2013/0278367 | A1 | 10/2013 | Yoshida et al. | |

FOREIGN PATENT DOCUMENTS

| | | | |
|---|---|---|---|
| JP | S61-115316 | A | 6/1986 |
| JP | S62-282422 | A | 12/1987 |
| JP | S62-282423 | A | 12/1987 |
| JP | S63-34904 | A | 2/1988 |
| JP | H01-140614 | A | 6/1989 |
| JP | H02-158112 | A | 6/1990 |
| JP | H05-94921 | A | 4/1993 |
| JP | H06-20826 | A | 1/1994 |
| JP | H0624173 | B2 | 3/1994 |
| JP | H0661036 | A | 3/1994 |
| JP | H06-105644 | B2 | 12/1994 |
| JP | H06105662 | B2 | 12/1994 |
| JP | H0719711 | B2 | 3/1995 |
| JP | 2512035 | B2 | 7/1996 |
| JP | 2725328 | B2 | 3/1998 |
| JP | H10-270277 | A | 10/1998 |
| JP | H10-308308 | A | 11/1998 |
| JP | 2000-298400 | A | 10/2000 |
| JP | 2001-178036 | A | 6/2001 |
| JP | 2002-231526 | A | 8/2002 |
| JP | 2002-343624 | A | 11/2002 |
| JP | 2003-151825 | A | 5/2003 |
| JP | 2003-229321 | A | 8/2003 |
| JP | 2005-269852 | A | 9/2005 |
| JP | 2005-300935 | A | 10/2005 |
| JP | 2007-074888 | A | 3/2007 |
| JP | 2008-160973 | A | 7/2008 |
| JP | 2008-300729 | A | 12/2008 |
| JP | 2010-258181 | A | 11/2010 |
| JP | 2011147288 | A | 7/2011 |
| JP | 2014120492 | A | 6/2014 |
| WO | 2012-090841 | A1 | 7/2012 |

* cited by examiner

| | SINTERED MAG. | RADIAL | POLAR | EX. 1 |
|---|---|---|---|---|
| |  |  |  |  |
| SUR. MAG. FLUX | 4000 | 2000 | 3000 | 4000 |

BONDED MAGNET, BONDED MAGNET COMPONENT, AND BONDED MAGNET PRODUCTION METHOD

CROSS-REFERENCE TO RELATED APPLICATIONS

This is a divisional application based on U.S. patent application Ser. No. 15/404,501, filed Jan. 12, 2017, which is a divisional application based on U.S. patent application Ser. No. 14/867,714, filed on Sep. 28, 2015, which claims priority under 35 U. S. C. § 119 to Japanese Patent Applications No. 2014-202,540, filed Sep. 30, 2014, No. 2014-267,077, filed Dec. 29, 2014, and No. 2015-167,734, filed Aug. 27, 2015. The contents of these applications are incorporated herein by reference in their entirety.

BACKGROUND

1. Technical Field

The present disclosure relates to a bonded magnet, a component for the bonded magnet, and a production method of the bonded magnet.

2. Description of the Related Art

Permanent magnets have been used in various applications such as an electric motor and a loudspeaker. For example, a small electric motor includes a field coil that is arranged in the outer part, and a rotor that is arranged in the inner part. Permanent magnets are arranged on the surface of rotor (SPM) or buried inside the rotor (IPM). For example, on the conditions that SPM type small electric motors have the same numbers of magnetic poles and the same size of permanent magnets, in order to provide a higher torque, the magnetic flux density of the permanent magnet on the surface of the rotor is required to be higher. As such a high magnetic flux density permanent magnet, a sintered magnet containing an earth element has been used such as $Nd_2Fe_{14}B$.

Also, a bonded magnet has been used which includes magnet powder distributed in a plastic material. Such a bonded magnet can be formed by using dies in compression molding, injection molding, or the like. Accordingly, its dimensional accuracy can be easily increased as compared with the sintered magnet. In addition, the bonded magnet can be integrally formed with another component. Additionally, the bonded magnet is lightweight. For these reasons, the bonded magnet is used in various applications. However, the bonded magnet is essentially constructed of resin as a binder. The maximum volumetric ratio of magnet powder is approximately 70% which is added to the binder. Accordingly, its magnetic properties will be necessarily reduced by 30%. As a result, its magnetic force is smaller as compared with the sintered magnet. For example, its energy product is only approximately one third of a sintered magnet of NdFeB. Therefore, the bonded magnet has not been used for an electric motor that is primarily required to provide a high torque. From this viewpoint, a bonded magnet is needed which has a high magnetic flux density to be used for an electric motor, and the like.

Japanese Examined Publication No. JP H06-105,644 B; International Publication No. WO 2012/090,841 A; U.S. Pat. No. 5,019,796 B Specification; and Japanese Laid-Open Patent Publication No. JP H10-308,308 A disclose permanent magnets that are devised to increase their magnetic flux densities. These permanent magnets produces a single magnetic circuit which is used in the molding or magnetic orientation. That is, a closed magnetic circuit (closed circuit) is formed so that the magnetic flux of the magnet is curved or expanded in the magnetic field of the closed circuit. In the case of the process using the single magnetic circuit, it is difficult to control the magnetic orientation of a bonded magnet (to magnetize a bonded magnet). The reason is that when the magnetic field produced by the single magnetic circuit has a low strength part, even if the low strength part is small, the desired orientation of the low strength part will not be completely achieved. For this reason, in the case where such a bonded magnet including the incomplete orientation part is used as a cylindrical columnar bonded magnet for a rotor of an electric motor, its surface magnetic flux will be much lower as compared with the sintered magnet. Therefore, to use a bonded magnet instead of a sintered magnet in the applications where sintered magnets are normally used, further improvement is required for such a bonded magnet.

The present invention is devised in light of the above. It is one object of the present invention to provide a bonded magnet which has an increased magnetic flux density while having the bonded magnet structure.

SUMMARY OF THE INVENTION

A bonded magnet according to one aspect of the present invention includes first and second bonded magnet components. The first bonded magnet component has first, second and fifth surfaces. The second surface is connected to the first surface through a connection portion. The fifth surface is connected to the second surface through a connection portion, and is connected to the first surface through a connection portion. The first bonded magnet component has a substantially sector exterior shape, which is defined by the first, fifth and second surfaces as viewed in section, and has a predetermined central angle which is formed by the first and fifth surfaces. A first magnetic flux group extends from the first surface to the second surface, and a third magnetic flux group extends from the fifth surface to the second surface. The second bonded magnet component has third, fourth and sixth surfaces. The fourth surface is connected to the third surface through a connection portion. The sixth surface is connected to the fourth surface through a connection portion, and is connected to the third surface through a connection portion. The second bonded magnet component has a substantially sector exterior shape, which is defined by the third, sixth and fourth surfaces as viewed in section, and has a predetermined central angle which is formed by the third and sixth surfaces. A second magnetic flux group extends from the fourth surface to the third surface, and a fourth magnetic flux group extends from the fourth surface to the sixth surface. The magnetic flux density on the second surface is higher than the magnetic flux density on the first surface, and the magnetic flux density on the fourth surface is higher than the magnetic flux density on the third surface. The magnetic pole on the first surface is opposite to the magnetic pole on the third surface. The first and third surfaces are coupled to each other so that the first and second magnetic flux groups continuously extend from one to another. The exposed magnetic pole on the second surface is opposite to the exposed magnetic pole on the fourth surface.

The ratio A/B which is defined by a length A as the radius of the sector of the first bonded magnet component and a length B of a part of the arc of the sector that is magnetized satisfies $$0.3184n \leq (A/B) < -0.04n^3 + 1.47n^2 - 14.03n + 43$$

where n is the total number of poles of the bonded magnet, in the case where the total number of poles of the bonded magnet is not greater than 12 (central angle $\Theta_0 \geq 30°$), or $$0.3184n \leq (A/B)$$

in the case where the total number of poles of the bonded magnet is greater than 12 (central angle $\Theta_0 < 30°$). According to this construction, the magnetic flux of the first bonded magnet component is converged from the first surface to the second surface, while the magnetic flux of the second bonded magnet component is converged from the third surface to the fourth surface. Therefore, a high magnetic flux density can be provided on an action surface.

A bonded magnet according to another aspect of the present invention includes first and second bonded magnet components. The first bonded magnet component has first and second surfaces. The second surface is connected to the first surface through a connection portion. The first bonded magnet component has a first magnetic flux group that extends from the first surface to the second surface. The second bonded magnet component has third and fourth surfaces. The fourth surface is connected to the third surface through a connection portion. The second bonded magnet component having a second magnetic flux group that extends from the fourth surface to the third surface. The area of the first surface is greater than the area of the second surface. The magnetic flux density on the second surface is higher than the magnetic flux density on the first surface. The area of the third surface is greater than the area of the fourth surface. The magnetic flux density on the fourth surface is higher than the magnetic flux density on the third surface. The magnetic pole on the first surface is opposite to the magnetic pole on the third surface. The first and third surfaces are coupled to each other so that the first and second magnetic flux groups continuously extend from one to another. The exposed magnetic pole on the second surface is opposite to the exposed magnetic pole on the fourth surface. The first bonded magnet component has an exterior flat shape. The first surface is the main surface of the flat shape, and the second surface is the side surface that extends in the thickness direction of the flat shape. The magnetic lines of flux bend symmetrically inside the first bonded magnet component from the first surface to the both second-surface sides as viewed in section. According to this construction, the magnetic flux of the first bonded magnet component is converged from a first non-action surface to a first action surface, while the magnetic flux of the second bonded magnet component is converged from a second non-action surface to a second action surface. Therefore, a high magnetic flux density can be provided on the action surface.

A method for producing a bonded magnet according to another aspect includes a step for charging a bond magnet composition, and a step for forming the bonded magnet which has a first non-action surface, a first action surface, and a third non-action surface. The first action surface is connected to the first non-action surface through a connection portion. The third non-action surface is connected to the first action surface through a connection portion, and is connected to the first non-action surface through a connection portion. The bonded magnet has a substantially sector exterior shape, which is defined by the first non-action surface, the third non-action surface and the first action surface as viewed in section, and has a predetermined central angle which is formed by the first non-action surface and the third non-action surface. In the charging step, the bond magnet composition, which contains a magnetic material and a resin, is charged into a molding die cavity. In the forming step, the bonded magnet is formed while applying an external magnetic field to the cavity. The external magnetic field is formed by permanent magnets. A first non-action-surface magnetizing magnet, a third non-action-surface magnetizing magnet, and a first action-surface magnetizing magnet as the permanent magnets are arranged to face the parts corresponding to the first non-action surface, the third non-action surface, and the first action surface, respectively. The magnetic pole of the first non-action-surface magnetizing magnet on the corresponding part is the same magnetic pole as the third non-action-surface magnetizing magnet on the corresponding part. The magnetic pole of the first action-surface magnetizing magnet on the corresponding part is opposite to the magnetic pole of the first non-action-surface magnetizing magnet and the third non-action-surface magnetizing magnet on the corresponding parts.

A method for producing a flat bonded magnet according to another aspect includes a preparing step, and a charging step for forming the flat bonded magnet which has a first non-action surface and a first action surface. The first action surface is connected to the first non-action surface through a connection portion. In the preparing step, a molding die cavity to be filled with a bond magnet composition is prepared. The bond magnet composition contains a magnetic material and a resin. In the charging step, the melted bond magnet composition is charged into the cavity, and the flat bonded magnet is formed while controlling the magnetic orientation of the magnetic material by applying an external magnetic field to the magnetic material. The external magnetic field is formed by first and second external magnetic field parts that are distributed by facing the same poles to each other. The cavity is deviated toward the first magnetic field part in the same-poles-facing direction in the space where first and second magnetic field parts are distributed. The second external magnetic field part is formed spaced at substantially the same distance as the depth of the cavity in the same-poles-facing direction.

A method for producing a flat bonded magnet according to another aspect includes a preparing step, and a charging step for forming the flat bonded magnet which has a first non-action surface and a first action surface. The first action surface is connected to the first non-action surface through a connection portion. In the preparing step, a molding die cavity to be filled with a bond magnet composition is prepared. The bond magnet composition contains a magnetic material and a resin. In the charging step, the melted bond magnet composition is charged into the cavity, and the bonded magnet is formed while controlling the magnetic orientation of the magnetic material by applying an external magnetic field to the magnetic material by using magnetizing magnets for magnetically controlling the magnetic orientation of the magnetic material. The magnetizing magnets comprise first and second magnetizing magnets that are orientated with the same poles facing to each other. The cavity is interposed between the first and second magnetizing magnets, and deviated toward the first magnetizing magnet in the axial direction of the magnetizing magnets. The second magnetizing magnet is arranged spaced away from the first magnetizing magnet at substantially the same distance as the depth of the cavity in the axial direction of the magnetizing magnets.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
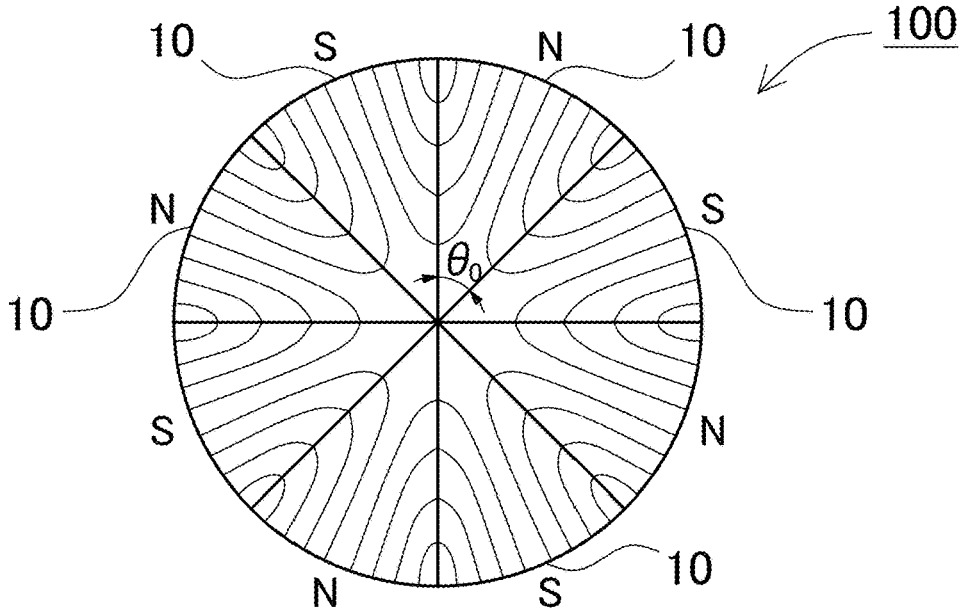
FIG. 1 is a schematic cross-sectional view showing a bonded magnet according to a first embodiment.

The embodiments will now be described with reference to the accompanying drawings, wherein like reference numerals designate corresponding or identical elements throughout the various drawings.

It should be appreciated, however, that the embodiments described below are illustrations of a bonded magnet, a bonded magnet component, and a method for producing a bonded magnet to give a concrete form to technical ideas of the invention, and a bonded magnet, a bonded magnet component, and a method for producing a bonded magnet of the invention are not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the positional relationships of the members in each of drawings are occasionally shown exaggeratingly for ease of explanation.

In a bonded magnet according to the aforementioned aspect of the present invention, the area of the first surface can be greater than the area of the second surface, and the area of the third surface can be greater than the area of the fourth surface.

In a bonded magnet according to the aforementioned aspect of the present invention, the sum of the areas of the first and fifth surfaces can be greater than the area of the second surface, and the sum of the areas of the third and sixth surfaces can be greater than the area of the fourth surface.

In a bonded magnet according to the aforementioned aspect of the present invention, the angle that is formed by the first and second surfaces can be not greater than 90°.

In a bonded magnet according to the aforementioned aspect of the present invention, the second bonded magnet component can have an exterior flat shape. The third surface can be the main surface of the flat shape, and the fourth surface can be the side surface that extends in the thickness direction of the flat shape. The magnetic lines of flux can bend symmetrically inside the second bonded magnet component from the fourth-surface sides to the third surface as viewed in section.

In a bonded magnet according to the aforementioned aspect of the present invention, the distribution of the magnetic lines of flux in the first bonded component can be generally the reflection of the distribution of the magnetic lines of flux in the second bonded component. According to this arrangement, one magnetic pole is exposed to the outside on surfaces of each of bonded magnet components that correspond to the radius sections (sides) of the sector shape. The circular bonded magnet can be produced by coupling the side surfaces of the bonded magnet components to each other with the magnetic poles of the joint side surfaces of adjacent bonded magnet components being opposite to each other.

In a bonded magnet according to the aforementioned aspect of the present invention, the joint surfaces of the first and second bonded components can be adhered to each other.

In a bonded magnet according to the aforementioned aspect of the present invention, the second surface can be an action surface, and the magnetic flux cannot outgo through the surface of the first bonded magnet component that is opposed to the second surface. According to this construction, since the magnetic flux can extend only through the action surface, the bonded magnet components can be easily coupled to each other.

In a bonded magnet according to the aforementioned aspect of the present invention, at least one of the connection portion between the first surface and the second surface, the connection portion between the first surface and the fifth surface, the connection portion between the third surface and the fourth surface, and the connection portion between the third surface and the sixth surface can have the same straight line as a part of the radius of the sector shape as viewed in section.

In a bonded magnet according to the aforementioned aspect of the present invention, at least one of the connection portion between the first surface and the second surface, the connection portion between the first surface and the fifth surface, the connection portion between the third surface and the fourth surface, and the connection portion between the third surface and the sixth surface can be recessed as viewed in section.

In recent years, a sintered magnet is becoming more expensive due to the resources problem. On the other hand, it is difficult to handle such a sintered magnet in assembling. In order to avoid these disadvantages, it is conceivable that a bonded magnet is used as a permanent magnet in a rotor of a high torque motor instead of the sintered magnet. The surface magnetic flux density of such a bonded magnet may be increased by optimizing the magnetic orientation of an anisotropic material (e.g., SmFeN particles) used as magnet powder mixed in the bonded magnet.

Figure 49:
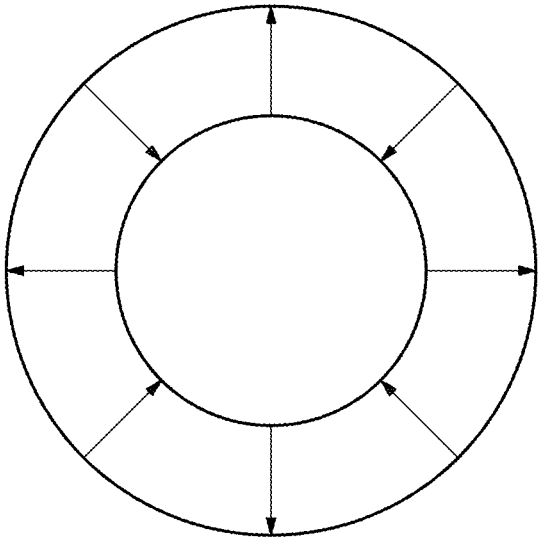
FIG. 49 is a schematic cross-sectional view showing a bonded magnet with radial orientation.

Radial orientation shown in FIG. 49 has been known as one type of magnetic orientation for the bonded magnet. In the radial orientation, since its magnetic path is short, its magnetic flux density will be low. Other approaches for increasing the surface magnetic flux density of a bonded magnet can be provided by polar orientation which can elongate its magnetic path, and converged orientation in which its magnetic flux is converged to increase its magnetic flux density.

(Converged Orientation)

Figure 50:
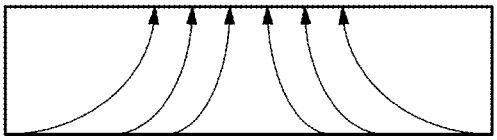
FIG. 50 is a schematic cross-sectional view showing a bonded magnet with converged orientation.
Figure 51:
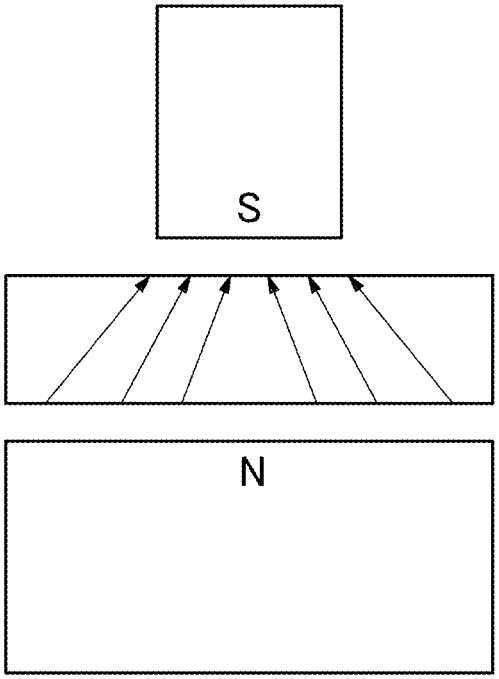
FIG. 51 is a schematic cross-sectional view showing the arrangement of magnetizing magnets for producing the bonded magnet with the converged orientation shown in FIG. 50.

As shown in FIG. 50, in converged orientation, the magnetic flux is converged to one side (upper side in FIG. 5) so that the magnetic flux density in one of north and south poles becomes higher. In converged orientation, as shown in a cross-sectional view of FIG. 51, magnetizing magnets with different sizes are used on the north-pole and south-pole sides to control the magnetic orientation of a bonded magnet molded member so that the magnetic flux density of the magnetized bonded magnet molded member becomes higher on one of action surfaces after the molded member is subjected to the magnetic orientation control. In this magnetization, since a high magnetic flux density part is forcedly formed, it is unavoidable that the distribution of magnetic flux density becomes unbalanced. For this reason, the converged orientation is not suitable for the application where a high magnetic flux density part is formed on the surface of a rotor of an electric motor.

(Polar Orientation)

Figure 52:
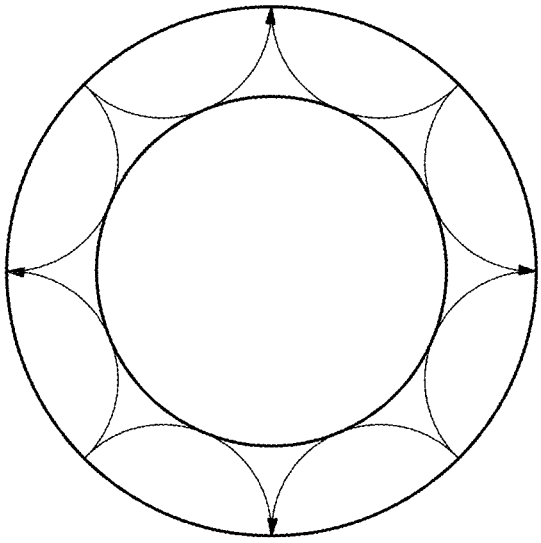
FIG. 52 is a schematic cross-sectional view showing a bonded magnet with polar orientation.
Figure 53:
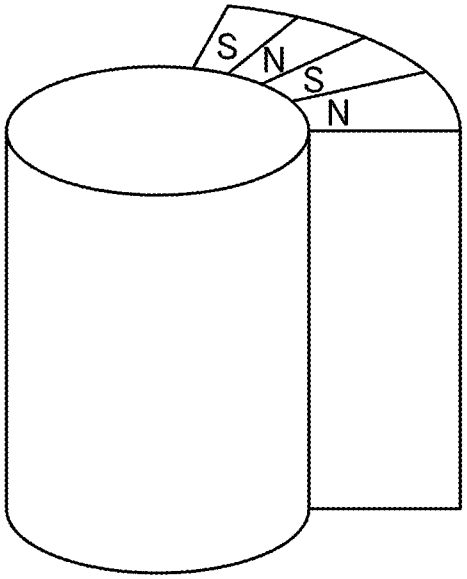
FIG. 53 is a schematic cross-sectional view showing the arrangement of magnetizing magnets for producing the bonded magnet with the polar orientation shown in FIG. 52.

In polar orientation (multi-pole orientation segments on outside diameter), as shown in FIG. 52, the magnetic lines of flux are produced in a substantially arc shape from north poles to south poles so that the operating point of the demagnetization curve of a produced bonded magnet rises. Here, one of production processes is discussed for controlling the magnetic orientation of a cylindrical columnar bonded magnet to be used for a rotor of an electric motor into polar orientation. In this case, as shown in FIG. 53, magnetizing magnets are placed around a cylindrical columnar hollow portion, which serves as a cavity formed by molding dies. This arrangement produces an arc-shaped magnetic field as shown in a plan view of FIG. 54. As a result, the magnetic orientation of magnetic powder particles can be formed along this magnetic field.

Figure 54:
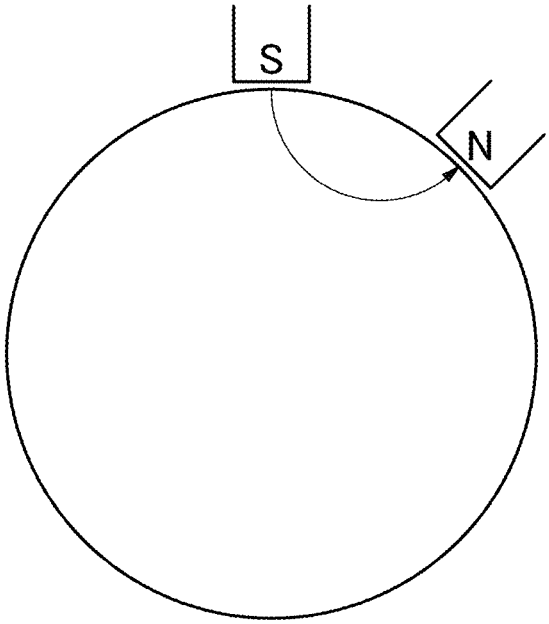
FIG. 54 is a schematic view showing an arc-shaped magnetic path formed by magnetizing magnets for polar orientation.
Figure 55:
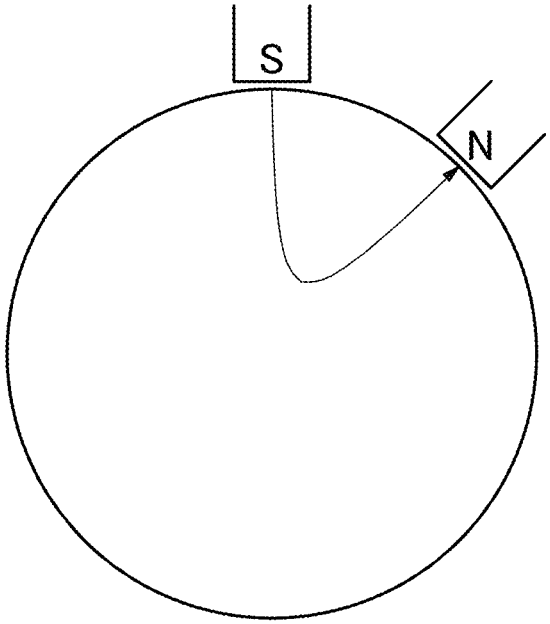
FIG. 55 is a schematic cross-sectional view showing a sharply bent magnetic path which more deeply extends inward with respect to the magnetic field shown in FIG. 54.
Figure 56:
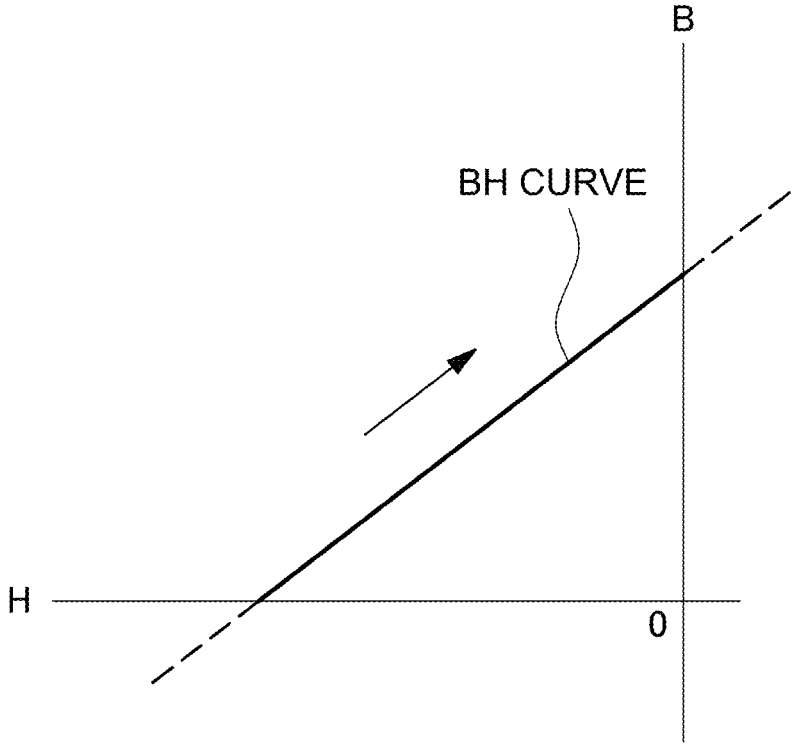
FIG. 56 is a graph showing BH curve of the bonded magnet.

In this process, the magnetizing magnets are placed around the periphery of the cylindrical columnar hollow portion, which corresponds to the exterior surface of the cylindrical columnar bonded magnet, so that the magnetic field is applied from the exterior side to the cylindrical columnar hollow portion. Although the magnetic field is applied from the exterior side to the cylindrical columnar hollow portion, the magnetic field is produced in an arc shape as shown in FIG. 54. The arc-shaped magnetic path will be formed inside near the action surface of the bonded magnet. In this process, magnetic lines of flux are produced in an arc shape, in other words, the magnetic lines of flux cannot be sharply bent. This causes a problem that the magnetic orientation cannot be sufficiently controlled. As shown in FIG. 55, in order to form a magnetic path that deeply enters a bonded magnet, a magnetic path is necessarily produced not in an arc shape but in a U shape which deeply enters and sharply bends outward. However, it is physically difficult to produce such a magnetic path by using magnetizing magnets which are placed outside the surface of the cavity. That is, in order to increase the operating point of the BH curve as shown in FIG. 56, the arrangement of magnetizing magnets is required to extend their magnetic lines of flux toward the center of the cylindrical columnar bonded magnet as shown in FIG. 55. In the case where the external magnetic field for magnetization is applied from the exterior side to the cylindrical columnar hollow portion by the magnetizing magnets, the magnetic forces of the magnetizing magnets are limited. For example, if the cylindrical columnar bonded magnet has a larger diameter, the magnetic path cannot deeply enter the cylindrical columnar bonded magnet. As a result, it would be difficult to provide a bonded magnet having stronger magnetic force.

First Embodiment

Figure 2:
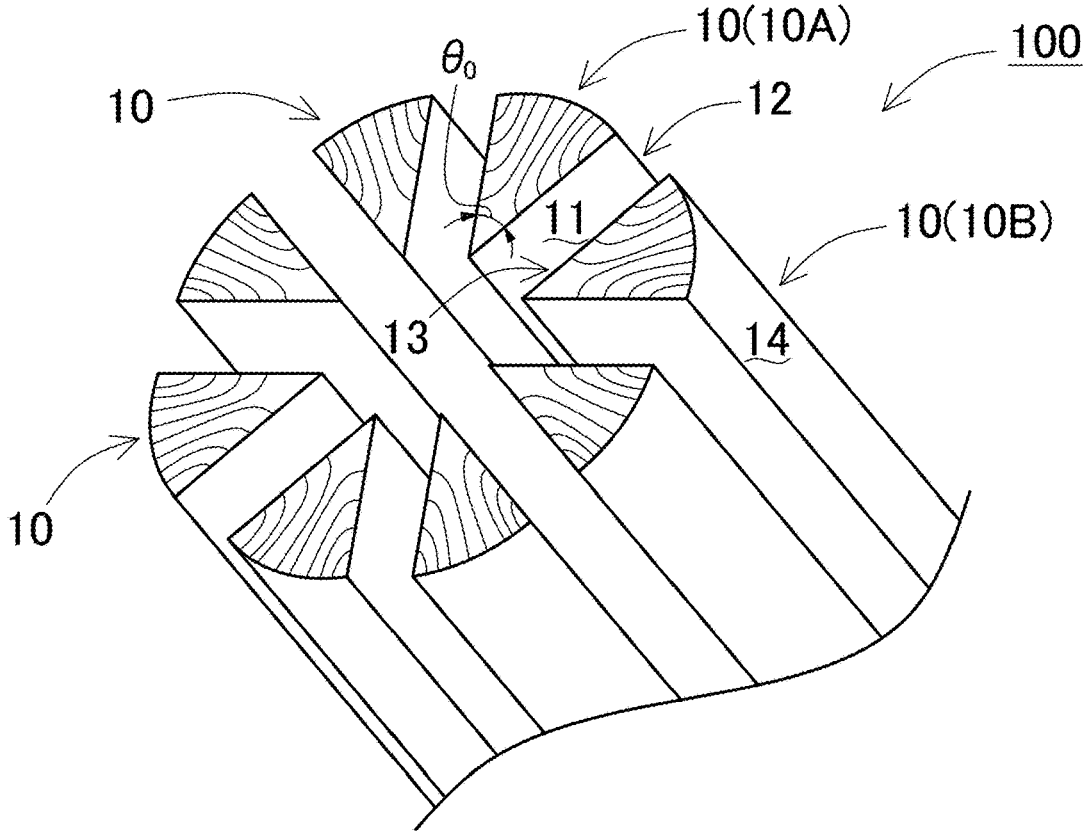
FIG. 2 is an exploded perspective view showing the bonded magnet shown in FIG. 1.

A bonded magnet according to a first embodiment of the present invention is constructed of a plurality of bonded magnet components corresponding to the parts into which the whole bonded magnet is divided. After bonded magnet components are separately formed, the bonded magnet components are coupled to each other. For example, in the case where a cylindrical columnar bonded magnet is produced which is to be used for a rotor of an electric motor, and has a generally circular bottom surface, the bonded magnet is constructed of bonded magnet components 10, which correspond to the parts into which the whole bonded magnet is divided along sectional planes (joint planes) each of which passes through the center axis, as shown in FIG. 1. The axis of easy magnetization of magnetic powder particles in each of the bonded magnet components 10 are orientated so that the magnet paths are formed in the polar orientation after the bonded magnet components 10 are coupled to each other. In the case of the bonded magnet 100 shown in FIG. 1, the cylindrical bonded magnet is constructed of eight sector-shaped columnar bonded magnet components 10, which have a substantially common exterior shape and a central angle of 45° on the bottom, by coupling them to each other as shown in an exploded perspective view of FIG. 2. The magnetic lines of flux of the bonded magnet components 10 are formed along the magnetic paths shown in FIG. 1. The bonded magnet components 10 have joint surfaces as shown in a cross-sectional view of FIG. 3. The joint surfaces of the adjacent bonded magnet components 10 are coupled to each other. The joint surface of the bonded magnet component 10 corresponds to the radius of the sector shape. The joint surfaces serve non-action surfaces. The magnetic poles on the joint surfaces of the adjacent bonded magnet components 10 are opposite to each other so that their magnetic lines of flux continuously extend from one to another.

The cylindrical columnar bonded magnet 100 has been illustratively described to be constructed of eight bonded magnet components 10 in the case of FIG. 1. In this case, total eight poles (four pairs of north and south poles) appear on the circumferential side surface of the bonded magnet 100. The bonded magnet components 10 have a central angle $\Theta_0$ of 45°, which can be obtained by dividing 360° by 8. However, the present invention is not limited to this. The bonded magnet may have six or ten poles which appear on its circumferential side surface. In the case of six or ten poles, the bonded magnet component 10 has a central angle $\Theta_0$ of 60° or 36°. In addition, the bonded magnet may have any number of magnetic poles, or any number of bonded magnet components.

In the polar orientation shown in FIG. 1, the magnetic paths extend from the action surface of the south or north pole inward of the bonded magnet and then be bent so as to form parabolas. In this case, since the magnetic paths extend not in an arc shape but in a parabolic line or a quadric curve, the magnetic path can deeply enter the cylindrical columnar bonded magnet toward the center axis of the cylindrical columnar shape from the circumferential side surface. As a result, the magnetic path can be long. The joint plane is a plane (symmetry plane) that passes along the symmetry axis of the parabolic magnetic paths as viewed in section. The joint surfaces of the bonded magnet components are coupled to each other in the joint plane. The joint surfaces of the bonded magnet components serve as a non-action surface. The density of the easy magnetization axes on the action surface is higher than the non-action surface. According to this construction, a bonded magnet can be provided which has an increased surface magnetic flux density on its action surface.

In this specification, the term "parabola" refer not only to a complete parabolic line but also to an elliptic line that is obtained by elongating an arc line in one direction or is convex inward. The major axis of this elliptic line extends toward the point between its straight sides, which form the central angle. The term "magnetic paths deeply enters the bonded magnet" refers to that the deepest point AP of the longest magnetic path among a plurality of parabolic magnetic paths is located on the center side with respect to the half point HP which is located at one half of the radius of the sector shape as shown in FIG. 3.

Figure 3:
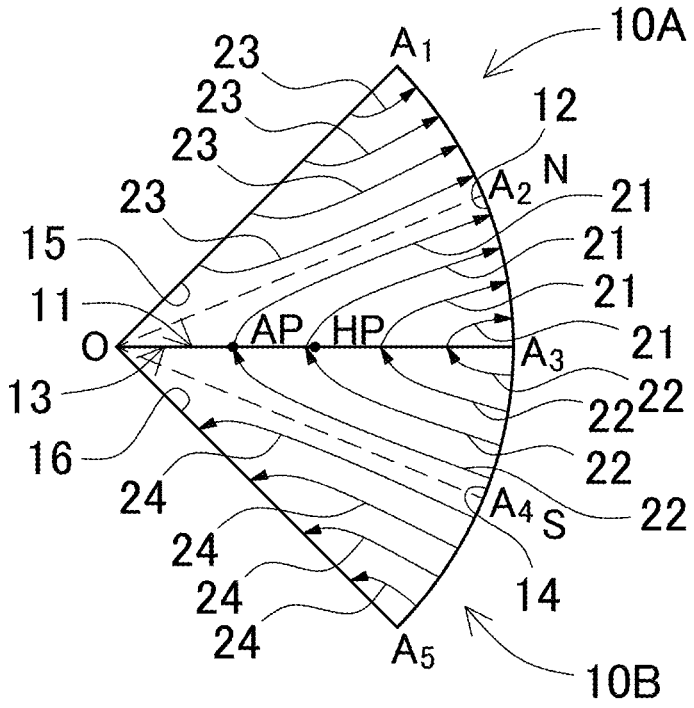
FIG. 3 is a schematic cross-sectional view showing pairs of bonded magnet components included in the bonded magnet shown in FIG. 1.

The bonded magnet shown in FIG. 3 is constructed of first and second bonded magnet components 10A and 10B. The first bonded magnet component 10A includes first, second, and fifth surfaces 11, 12, and 15. The second surface 12 is connected to the first surface 11 through a connection portion. The fifth surface 15 is connected to the second surface 12 through a connection portion, and is connected to the first surface 11 through a connection portion. The first bonded magnet component 10A has a substantially sector exterior shape, which is defined by the first, fifth and second surfaces 10, 15, 12 as viewed in section. The first bonded magnet component 10A has a predetermined central angle which is formed by the first and fifth surfaces 11 and 15, which are inclined with respect to each other. A first group of magnetic lines of flux 21 curves from the first surface 11 to the second surface 12 inside the first bonded magnet component 10A. A third magnetic group of lines of flux 23 curves from the fifth surface 15 to the second surface 12 inside the first bonded magnet component 10A. The fifth surface 15 serves as the joint surface to be coupled to another bonded magnet component (not shown), specifically, to a bonded magnet component which has the same magnetic orientation as the second bonded magnet component 10B. The fifth surface 15 serves as a third non-action surface.

The sum of the physical areas of the first and fifth surfaces 11 and 15 is greater than the physical area of the second surface 12 of the first bonded magnet component 10A. In other words, on the condition that the height of the sectionally sector-shaped first bonded magnet component 10A is constant, the sum of the lengths of the line segments $OA_3$ and $OA_1$, which correspond to the first and second surfaces 11 and 12, respectively, is greater than the length of the arc $A_1A_3$ shown in FIG. 3. According to this construction, the surface magnetic flux density on the second surface 12 can be higher than the surface magnetic flux density on the first or fifth surface 11 or 15. Preferably, the first surface 11 is larger than the second surface 12. In other words, the length of the line segment $OA_3$, which corresponds to the first surface 11, is greater than the length of the arc $A_1A_3$ in FIG. 3. According to this construction, the surface magnetic flux density on the second surface 12 can be further increased.

Preferably, the distribution of the first group of magnetic lines of flux 21 is substantially the reflection of the distribution of the third group of magnetic lines of flux 23 with respect to the bisector which divides the central angle $\theta_0$ of the sectionally sector-shaped first bonded magnet component 10A into two equal angles (line $OA_2$ in FIG. 3). The first surface 11 serves as the joint surface to be coupled to the second bonded magnet component 10B. Accordingly, the first surface 11 is a first non-action surface which is not exposed to the outside. The second surface 12 serves a first action surface on which a magnetic pole is exposed to the outside.

The second bonded magnet component 10B includes third, fourth, and sixth surfaces 13, 14, and 16. The fourth surface 14 is connected to the third surface 13 through a connection portion. The sixth surface 16 is connected to the fourth surface 14 through a connection portion, and is connected to the third surface 13 through a connection portion. The second bonded magnet component 10B having a substantially sector exterior shape, which is defined by said third, sixth and fourth surfaces 13, 16 and 14 as viewed in section, and has a predetermined central angle which is formed by the third and sixth surfaces 13 and 16. The second group of magnetic lines of flux 22 curves from the fourth surface 14 to the third surface 13 inside the second bonded magnet component 10B. A fourth group of magnetic lines of flux 24 curves from the fourth surface 14 to the sixth surface 16 inside the second bonded magnet component 10B. The sixth surface 16 serves as the joint surface to be coupled to another bonded magnet component (not shown), specifically, to a bonded magnet component which has the same magnetic orientation as the first bonded magnet component 10A. The sixth surface 16 serves as a fourth non-action surface.

The sum of the physical areas of the third and sixth surfaces 13 and 16 is greater than the physical area of the fourth surface 14 of the second bonded magnet component 10B. In other words, on the condition that the height of the sectionally sector-shaped second bonded magnet component 10B is fixed, the sum of the lengths of the line segments $OA_3$ and $OA_5$, which correspond to the third and sixth surfaces 13 and 16, respectively, is greater than the length of the arc $A_3A_5$ shown in FIG. 3. According to this construction, the surface magnetic flux density on the fourth surface 14 can be higher than the surface magnetic flux density on the third or sixth surface 13 or 16. Preferably, the third surface 13 is larger than the fourth surface 14. In other words, the length of the line segment $OA_3$, which corresponds to the third surface 13, is greater than the length of the arc $A_3A_5$ in FIG. 3. According to this construction, the surface magnetic flux density on the fourth surface 14 can be further increased.

Preferably, the distribution of the second group of magnetic lines of flux 22 is substantially the reflection of the distribution of the fourth group of magnetic lines of flux 24 with respect to the bisector which divides the central angle 80 of the sectionally sector-shaped second bonded magnet component 10B into two equal angles (line $OA_4$ in FIG. 3). The third surface 13 serves as the joint surface to be coupled to the first bonded magnet component 10A. Accordingly, the third surface 13 is a second non-action surface which is not exposed to the outside. The fourth surface 14 serves a second action surface which is exposed as a magnetic pole to the outside.

The magnetic pole on the first surface 11 of the first bonded magnet component 10A is opposite to the magnetic pole on the third surface 13 of the second bonded magnet component 10B. In this case, the first and third surfaces 11 and 13 correspond to south and north poles, respectively, so that the first and third surfaces 11 and 13 as the joint surfaces can be coupled to each other. The joint surfaces may be coupled to each other by a bonding agent. When the first and third surfaces 11 and 13 of the first and second bonded magnet components 10A and 10B are coupled to each other, first and second groups of magnetic lines of flux 21 and 22 continuously extend from one to another.

After pairs of the bonded magnet components 10A and 10B are assembled, the bonded magnet is produced. The circumferential side surface of this bonded magnet serves as an action surface. The second and fourth surfaces 12 and 14 of the first and second bonded magnet components 10A and 10B, which are exposed to the outside, have opposite magnetic poles. In the case of FIG. 3, the second surface 12 has the north pole, and the fourth surface 14 has the south pole. According to this construction, the magnetic flux density on the action surface can be high while achieving polar orientation in which the magnetic paths are bent inside bonded magnet components. The reason is that the magnetic lines of flux from the first and fifth surfaces 11 and 15 can be converged toward the second surface 12 of the first bonded magnet component 10A, while the magnetic lines of flux from the third and sixth surfaces 13 and 16 can be converged toward the fourth surface 14 of the second bonded magnet component 10B.

As discussed above, one magnetic pole is exposed to the outside on surfaces of each of bonded magnet components that correspond to the radius sections (sides) of the sector shape. The circular columnar bonded magnet can be produced by coupling the side surfaces of the bonded magnet components to each other with the magnetic poles of the joint side surfaces of adjacent bonded magnet components being opposite to each other.

In the case of FIG. 3, the first and second bonded magnet components 10A and 10B have the common shape. However, the present invention is not limited to this. The first and second bonded magnet components may have different shapes from each other.

Figure 4:
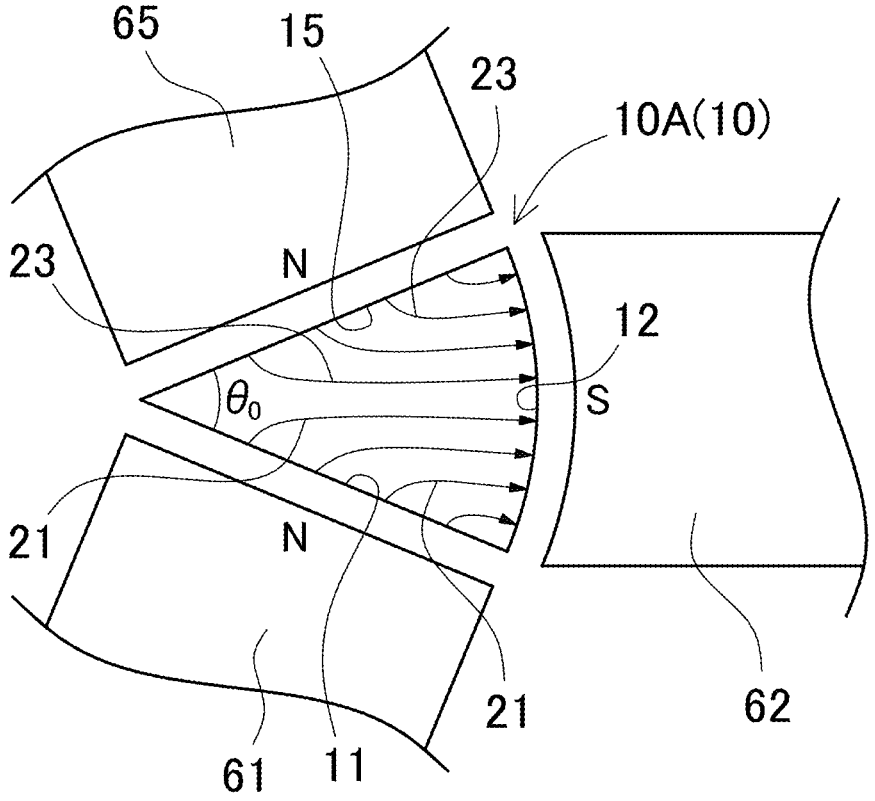
FIG. 4 is a schematic cross-sectional view showing a cavity for forming the bonded magnet component shown in FIG. 3, and magnets for controlling the magnetic orientation of this bonded magnet component.

Since the bonded magnet is constructed of separated components as discussed above, the magnetizing magnets can be placed on parts which correspond to the central parts of the cylindrical columnar bonded magnet, which is produced by coupling the separated components to each other, in other words, on the inside parts of the non-action surfaces when the bonded magnet component is molded as shown in FIG. 4. Accordingly, the magnetic lines of flux from the magnetizing magnets can enter the central parts of the bonded magnet. As a result, the magnetic paths can deeply extend to the central part of the cylindrical columnar bonded magnet 100 as shown in the cross-sectional view of FIG. 1 after the bonded magnet components are assembled into the cylindrical columnar bonded magnet 100. Such magnetic orientation is very difficult for known approaches. The deeply extending magnetic paths can increase the surface magnetic flux density on the action surface. According to this construction, in addition to the effect of increasing the surface magnetic flux density by deeply extending the magnetic paths, the magnetic flux density can be increased by focusing the magnetic flux on the action surface, which is the arc-shaped part of the sector as viewed in section. The reason is that the area of the action surface is smaller than the non-action surface as shown in FIG. 3, or the like. Consequently, converged orientation can be achieved as well as the polar orientation. Therefore, the magnetic flux density of the bonded magnet can be further increased.

In other words, in addition to the polar orientation in which the magnetic flux is bent in a U shaped inside the bonded magnet, the converged orientation can be realized which increases the surface magnetic flux density on the action surface since the non-action surfaces for one magnetic pole are wider than the action surface for another magnetic pole so that the magnetic flux is constricted from the wider surface for one magnetic pole toward the narrower surface for another magnetic pole. As a result, the converged orientation can be produced which can increase the surface magnetic flux density on the action surface.

(Production Method of Bonded Magnet)

A device and a method for producing the bonded magnet 100 are now described with reference to FIG. 4. The first bonded magnet component 10A is produced by the production method shown in FIG. 4. The second bonded magnet component 10B can be produced by magnetizing magnets each of which has an opposite magnetic pole to the case of the first bonded magnet component 10A.

Converged orientation is provided by this method using the wider surfaces for one magnetic pole and the narrower surface for the other magnetic pole to increase the magnetic flux density on the action surface. In order to achieve this, the magnetizing magnets are placed on the parts corresponding to the action and non-action surfaces in the cavity defined by the molding dies. In the case of FIG. 4, for production of the first bonded magnet, a first action-surface magnetizing magnet 62 is placed on the first action surface 12, while first non-action-surface magnetizing magnets 61 are placed on the first non-action surfaces 11. In this method, the converged orientation can be achieved by the non-action surfaces having a greater area than the action surface. In addition, a third non-action-surface magnetizing magnet 65 is placed on the third non-action surface 15. The first and third non-action-surface magnetizing magnets 61 and 65 have the same polarity (north pole in FIG. 4) on their surface facing the bonded magnet component. Accordingly, the magnetic fields from the magnetizing magnets 61 and 65 repel each other so that magnetic lines of flux extend toward the first action-surface magnetizing magnet 62 (south pole in FIG. 4). As a result, the convergence of the converged orientation can be higher.

The degree of converged orientation can be adjusted by adjusting the area ratio between the magnetized areas of the non-action and action surfaces. Specifically, the areas of the first action-surface and non-action-surface magnetizing magnets 62 and 61 placed on the first action and non-action surfaces are designed in accordance with the required specification. A bonded magnet can be optimized by adjusting the area ratio in accordance with the maximum surface magnetic flux density, the distribution of magnetic flux density, or the like as examples of the specification required for a rotor of an electric motor, or the like. The area ratio is the ratio A/B where A is the area of a part corresponding to a length A as the radius of the sector shape of the bonded magnet component as viewed in plan view, and B is the area of a magnetized part B in the segment of a circle corresponding to the sector shape. In the case where the height of the cylindrical columnar bonded magnet component is constant, the area ratio A/B can be represented by the ratio of length A/B.

(Magnetizing Magnet)

Permanent magnets are used as the magnetizing magnets when the bonded magnet components shown in FIG. 4 are molded. The permanent magnet is preferably formed of a material having Br of not smaller than 1 T. For example, an Nd—Fe—B sintered magnet can be used as this permanent magnet. In the case where a magnet is used which has a strong magnetic force, the magnetized strength of the bonded magnet will be high, and as a result the surface magnetic flux density of the bonded magnet can be high.

The cavity defined by the molding dies is filled up with a bonded magnet composition as the material of the bonded magnet. Injection molding or compression molding can be used for molding the bonded magnet. The bonded magnet composition contains at least a magnetic material and a resin.

(Magnetic Material)

An anisotropic material is used as the magnetic material. Examples of the anisotropic materials can be provided by ferrite-, Sm—Co-, Nd—Fe—B-, Sm—Fe—N-based materials, and the like. When becoming anisotropic, these materials can have a certain magnetic performance. BHmax of these anisotropic materials is high as compared with isotropic materials. Even in the case where these anisotropic materials are used for a field magnet unit, they can provide an effective magnetic flux density in the space.

A ferrite-based material has been used from long ago. Since ferrite-based materials are inexpensive, they are most widely used. However, they have a magnetic force lower than rare-earth-based materials. When the molded component is small, its magnetic force will be insufficient. For this reason, in the case where a bonded magnet is required which has a strong magnetic force, the bonded magnet preferably includes a rare-earth-based magnetic powder such as Sm—Co-, Nd—Fe—B-, or Sm—Fe—N-based magnetic powder. The aforementioned magnetic materials can be used solely or in combination of two or more materials as mixture. In addition, the aforementioned magnetic powder materials may be subjected to antioxidation treatment or coupling treatment if necessary.

(Resin)

The resin used in this embodiment of the present invention is not specifically limited. Examples of the resins can be provided by thermoplastic resin such as polypropylene, polyethylene, polyvinyl chloride, polyester, polyamide, polycarbonate, polyphenylene sulfide and acrylic resin, thermoplastic elastomers such as ester- and polyamide-based materials, and thermosetting resins such as epoxy resin, phenol resin, unsaturated polyester resin, urea resin, melamine resin, polyimide resin, allyl resin and silicone resin.

The first action-surface magnetizing magnet 62, the first non-action-surface magnetizing magnet 61, and the third non-action-surface magnetizing magnet 65 shown in FIG. 4 can produce substantially the same magnetic lines of flux as the magnetic lines of flux of the first and third magnetic flux groups 21 and 23. The easy magnetization axes of magnetic powder particles are orientated by the magnetic lines of flux produced by the magnetizing magnets before the resin is cured. After the resin is cured, the bonded magnet 10A can be produced which has the two magnetic path groups substantially corresponding to the first and third magnetic flux groups 21 and 23. Also, in the case where magnetizing magnets each of which has an opposite magnetic pole to the case of the first bonded magnet component 10A are used, the bonded magnet component 10B can be produced which has the two magnetic path groups substantially corresponding to the second and fourth magnetic flux groups 22 and 24.

The sector-shaped bonded magnet components 10A and 10B are alternately arranged coupled to each other so that their non-action surfaces to each other contact each other with, and their arcs form the circle. The bonded magnet 100 shown in FIG. 1 can be produced after this coupling process. The magnetic paths extend from the non-action surfaces inside the bonded magnet component of the bonded magnet 100 so as to be bent in parabolic lines and converged on the action surface as shown in FIG. 1. The magnetic paths of adjacent bonded magnet components 10A and 10B, which extend from the non-action surfaces, are continuously extend through the non-action surfaces from one to another. As a result, the parabolic magnetic path groups can be formed which are convex inward from the action surfaces. The bonded magnet shown in FIG. 1 can be considered as an assembly of pairs of bonded magnet components shown in FIG. 3. Here, one magnetic path set in the first bonded magnet component 10A, and one magnetic path set in the second bonded magnet component 10B that continuously extends from or to the one magnetic path set in the first bonded magnet component 10A is defined as a first magnetic path group. The division plane or joint plane that extends along the boundary between the first and second bonded magnet components 10A and 10B is defined as a first joint plane as the symmetry plane of the first magnetic path group. Also, another magnetic path set in the first bonded magnet component 10A, and another magnetic path set in the second bonded magnet component 10B, which continuously extends from or to the another magnetic path set in the first bonded magnet component 10A, is defined as a second magnetic path group. The bonded magnet components can be separated from each other along the first or second joint plane. The first and second joint planes intersect each other at the center axis of the cylindrical shape.

Comparative Test 1

Figure 5A:
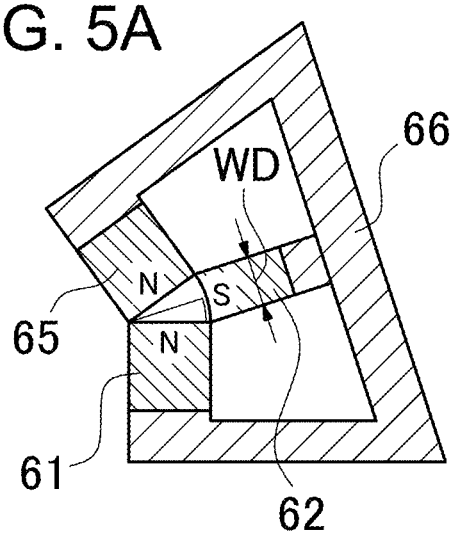
FIGS. 5A to 5F are schematic cross-sectional views showing magnetic circuit devices including permanent magnets used for producing bonded magnet components according to exemplary arrangements.
Figure 5D:
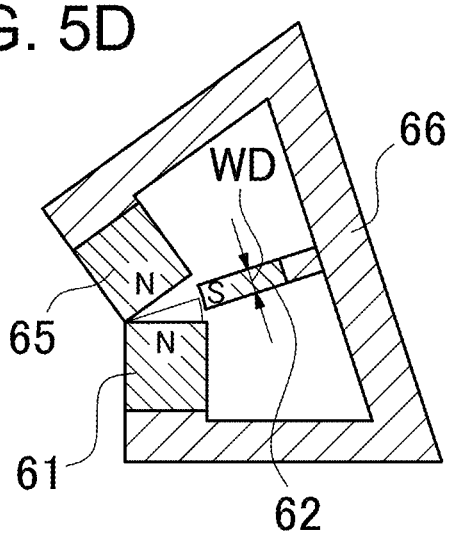
Figure 5B:
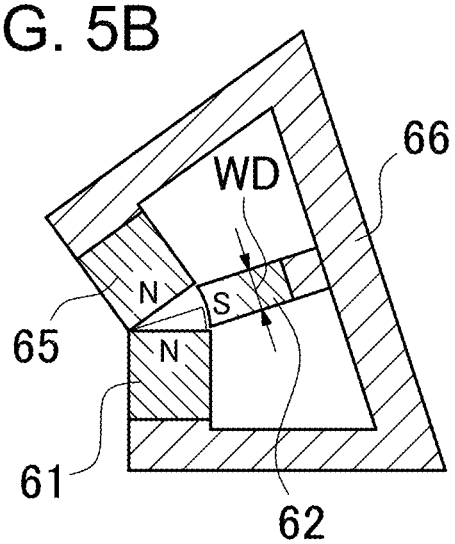
Figure 5E:
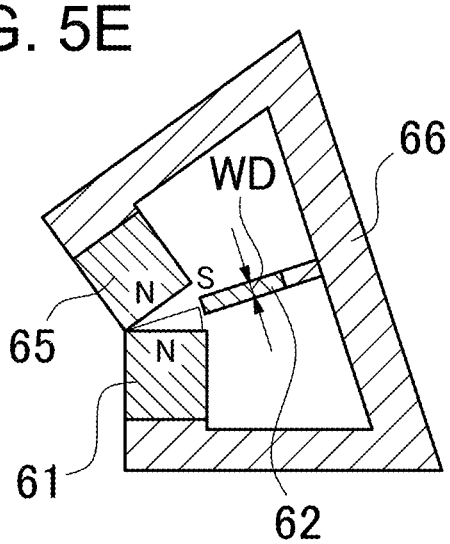
Figure 5C:
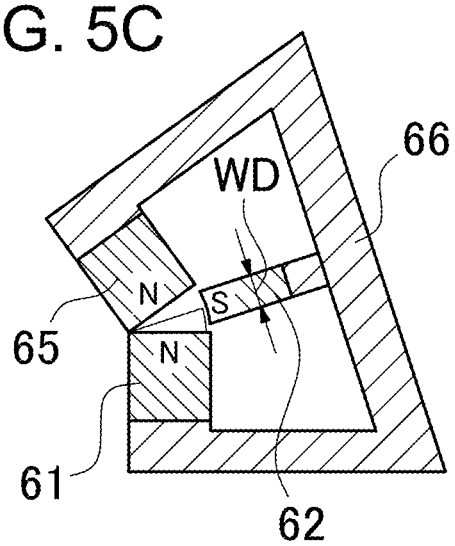
Figure 5F:
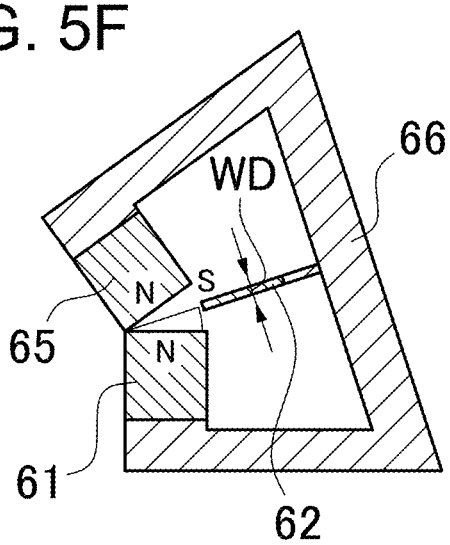
Figure 6:
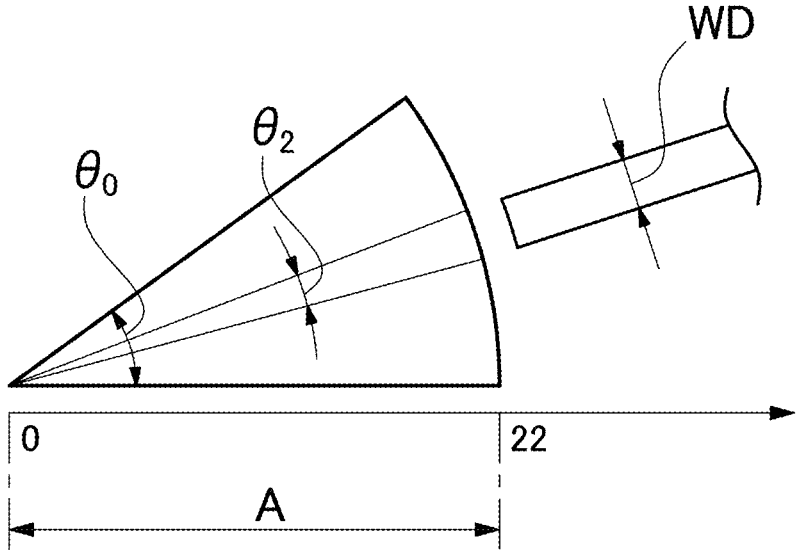
FIG. 6 is a cross-sectional view showing fictitious parts of the bonded magnet component.
Figure 7A:
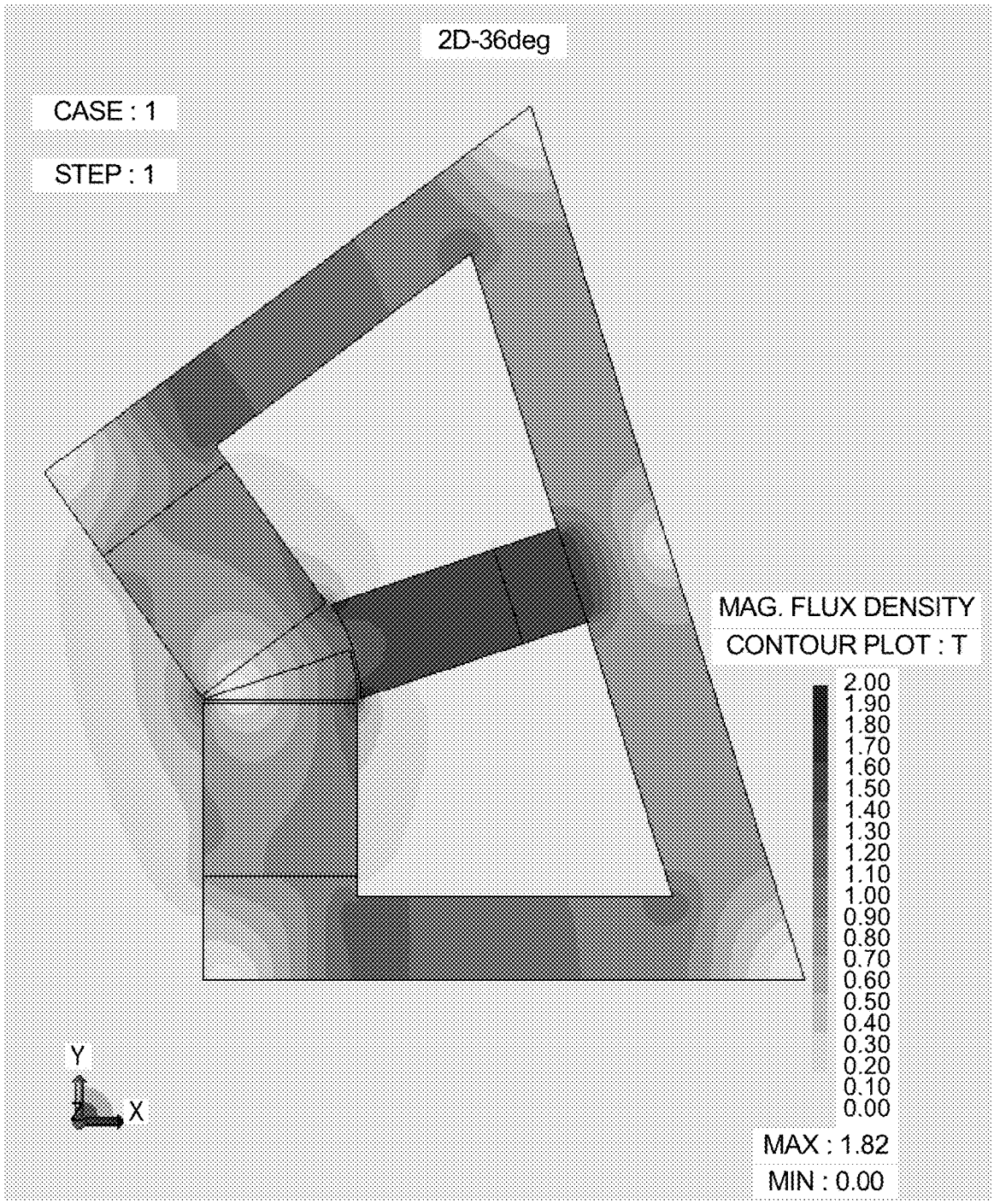
FIGS. 7A to 7F are images showing the distributions of the magnetic flux densities obtained in the exemplary arrangements shown in FIGS. 5A to 5F, respectively.
Figure 7B:
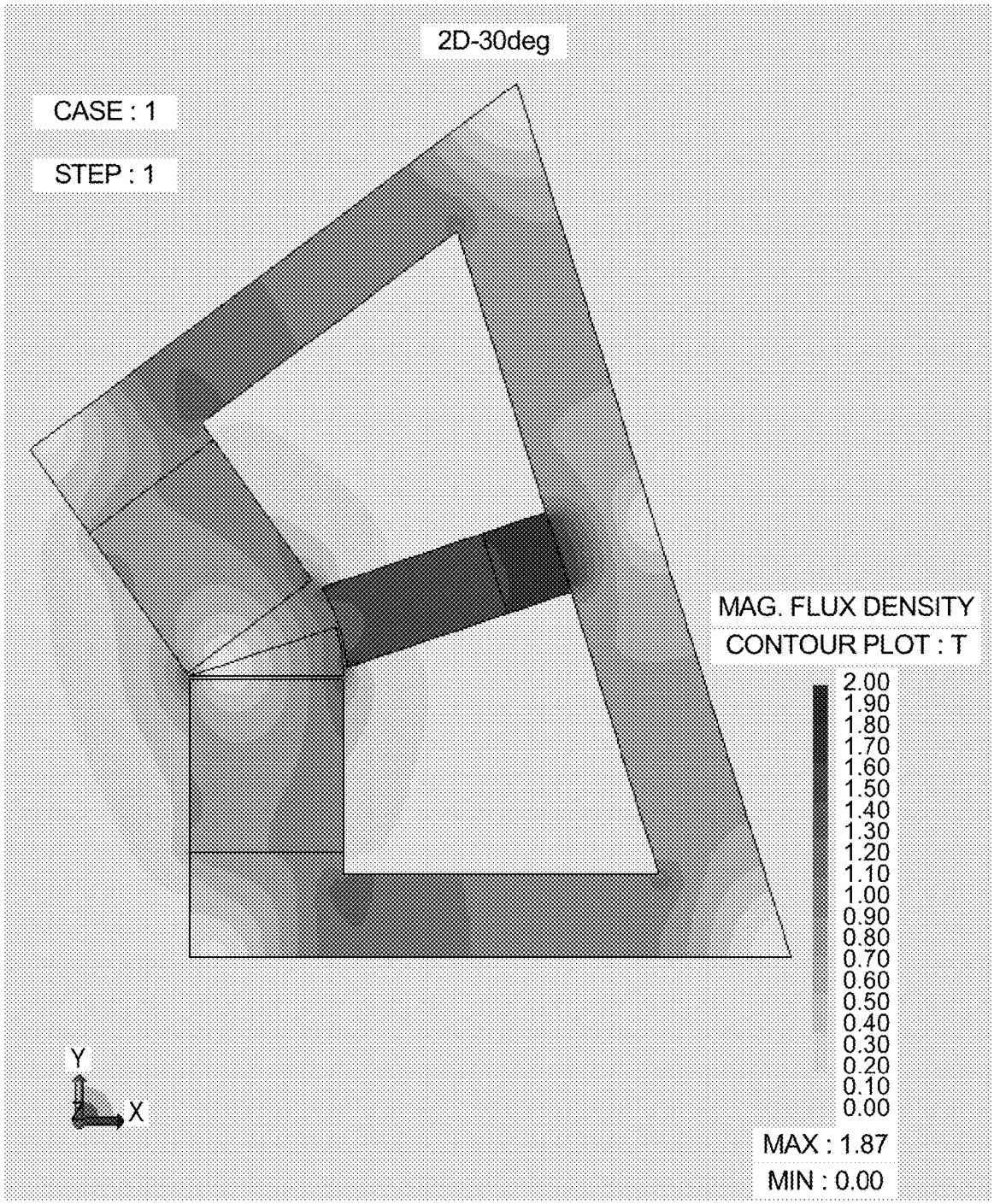
Figure 7C:
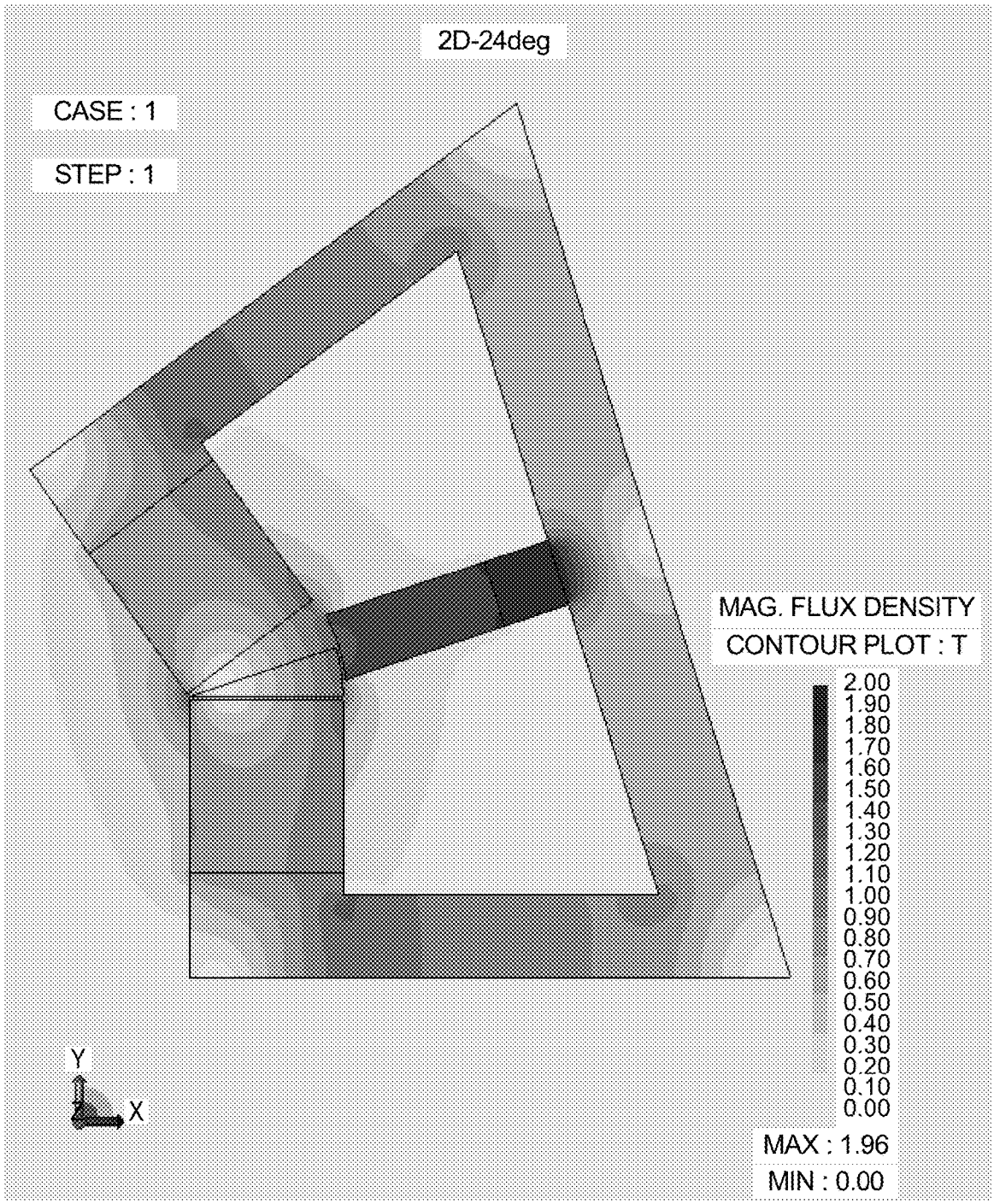
Figure 7D:
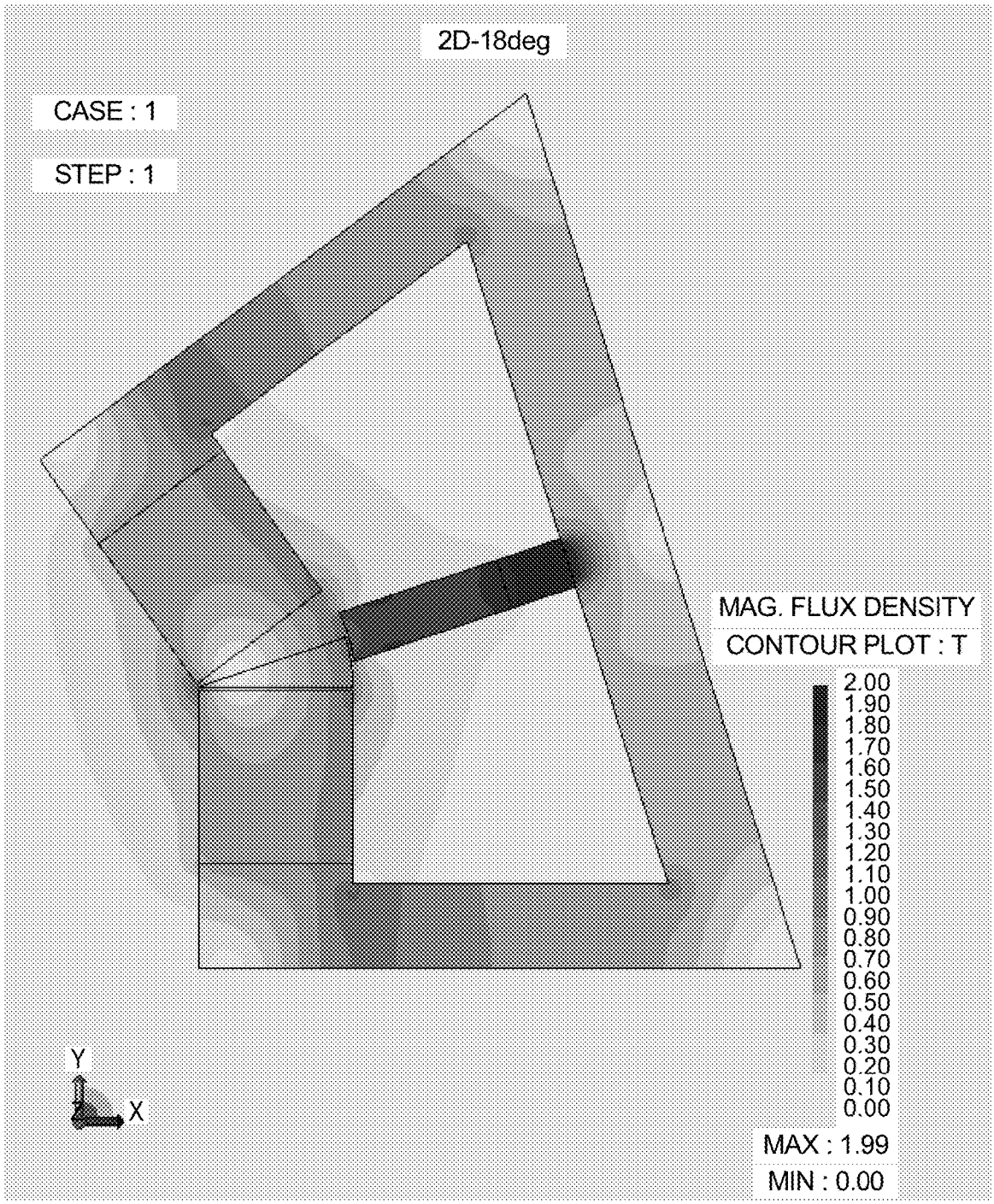
Figure 7E:
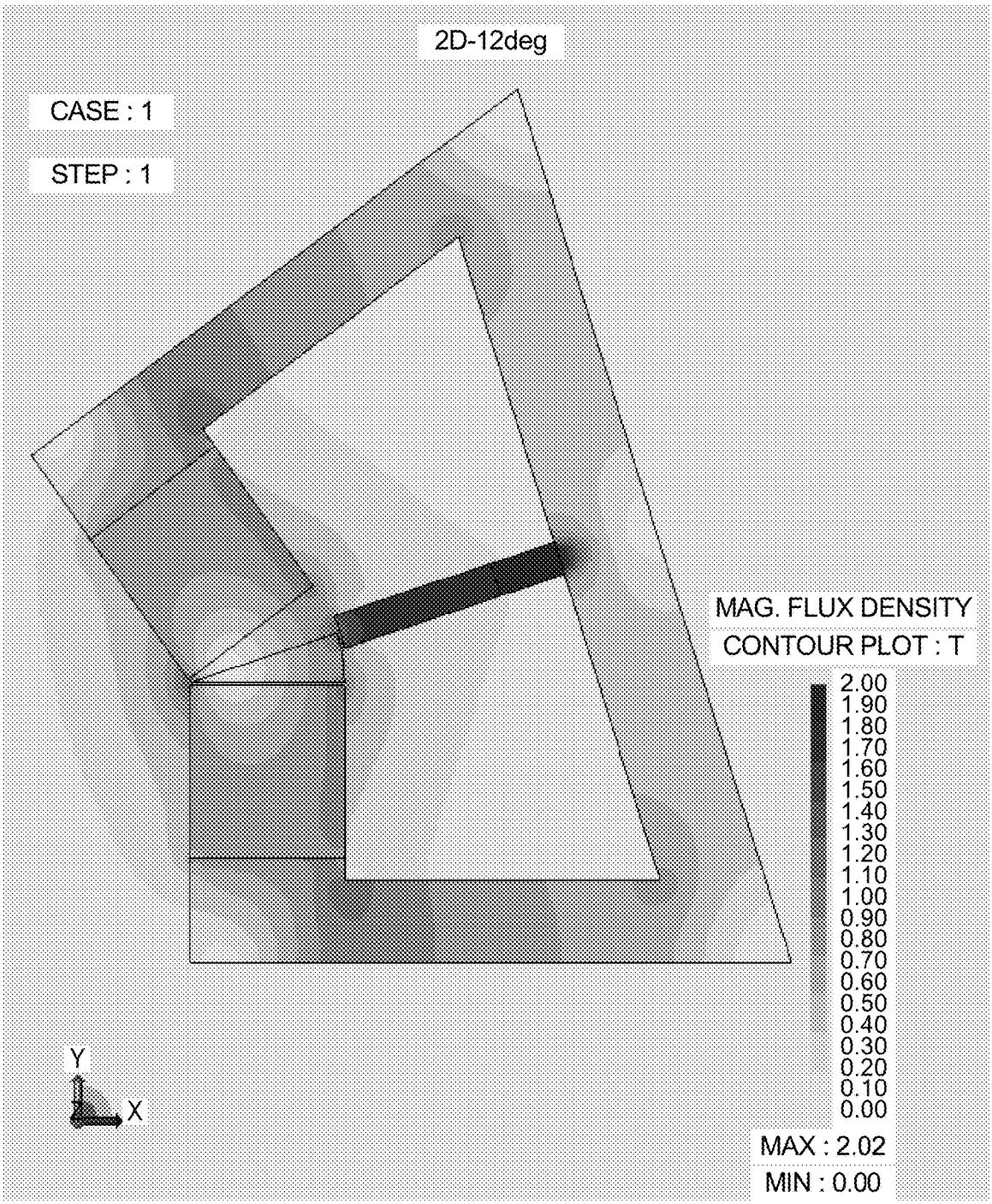
Figure 7F:
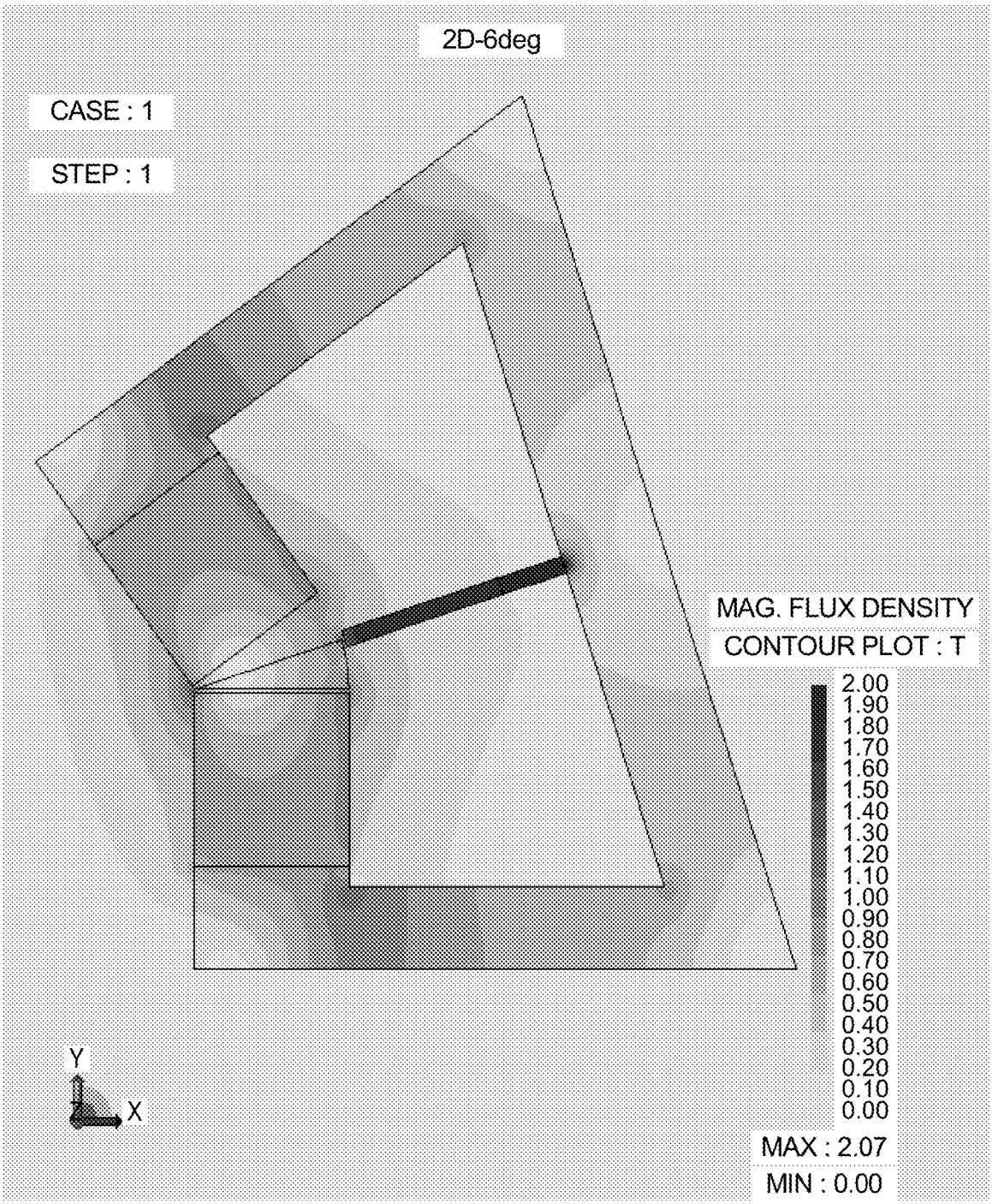
Figure 8A:
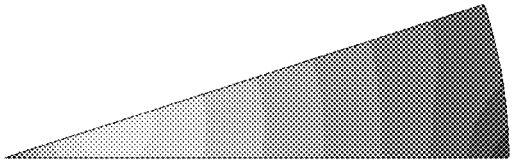
FIGS. 8A to 8F are enlarged images of parts of the bonded magnet components shown in FIGS. 7A to 7F, respectively.
Figure 8D:
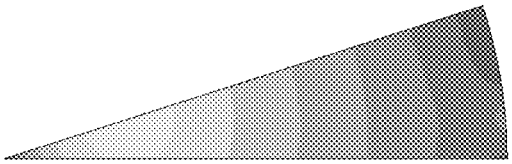
Figure 8B:
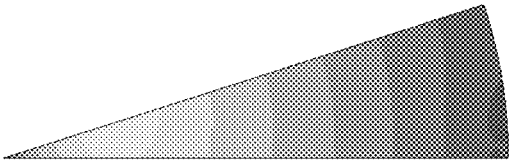
Figure 8E:
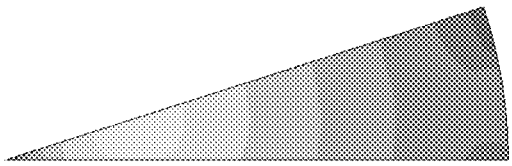
Figure 8C:
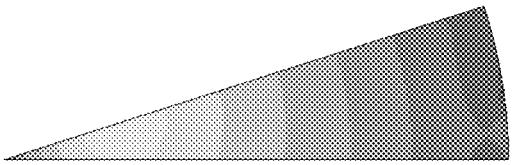
Figure 8F:
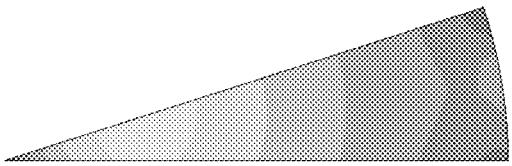
Figure 9A:
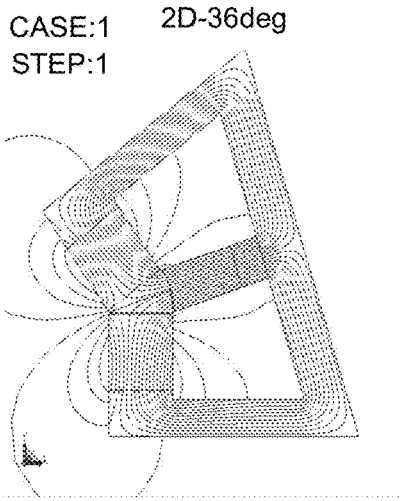
FIGS. 9A to 9F are images showing the magnetic paths produced in the exemplary arrangements shown in FIGS. 5A to 5F, respectively.
Figure 9B:
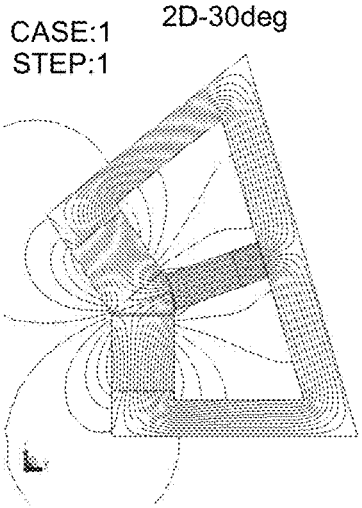
Figure 9C:
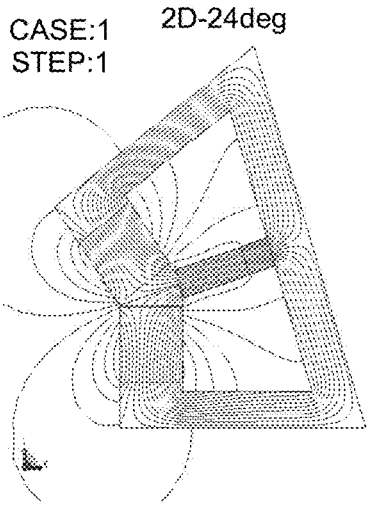
Figure 9D:
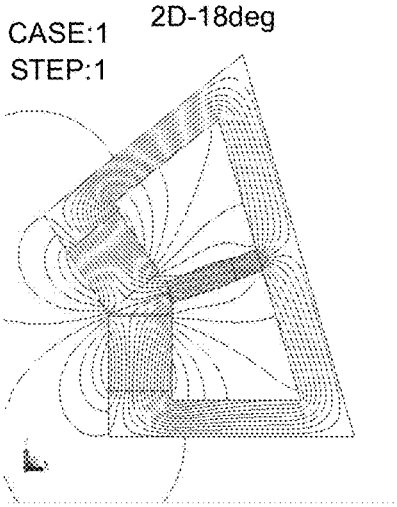
Figure 9E:
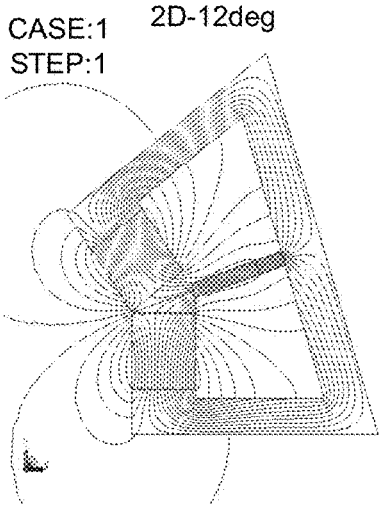
Figure 9F:
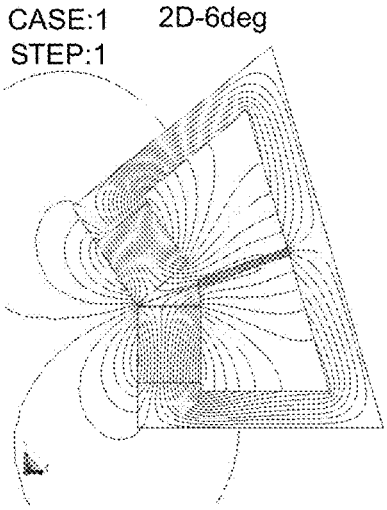
Figure 10A:
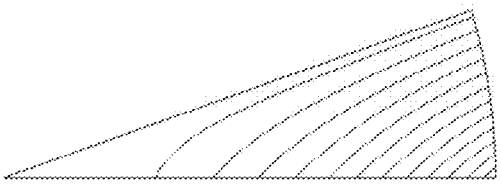
FIGS. 10A to 10F are enlarged images of parts of the bonded magnet components shown in FIGS. 9A to 9F, respectively.
Figure 10D:
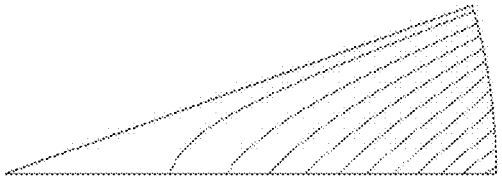
Figure 10B:
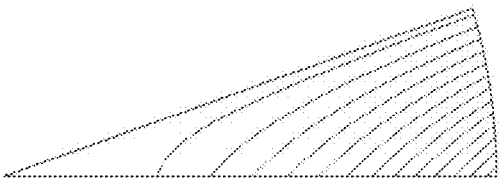
Figure 10E:
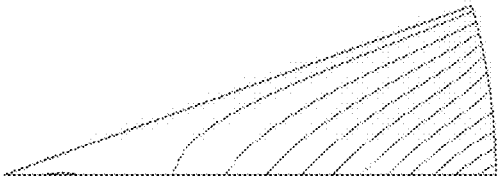
Figure 10C:
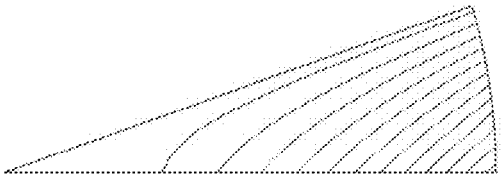
Figure 10F:
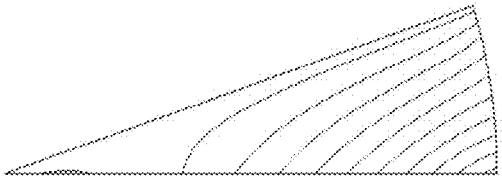
Figure 11A:
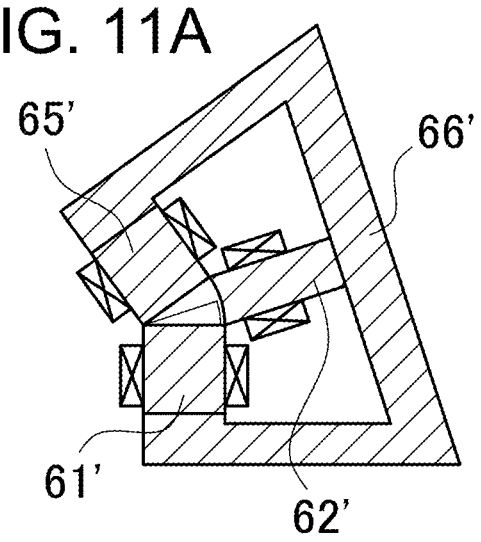
FIGS. 11A to 11F are schematic cross-sectional views showing magnetic circuit devices including electromagnets used for producing bonded magnet components of comparative examples.
Figure 11D:
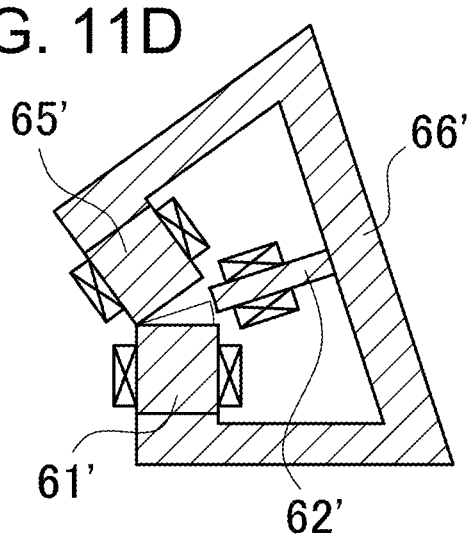
Figure 11B:
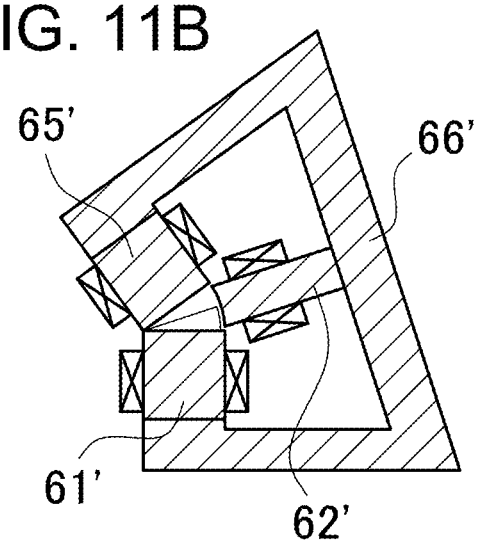
Figure 11E:
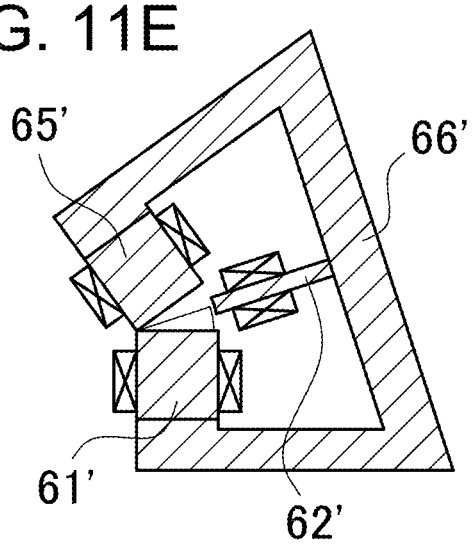
Figure 11C:
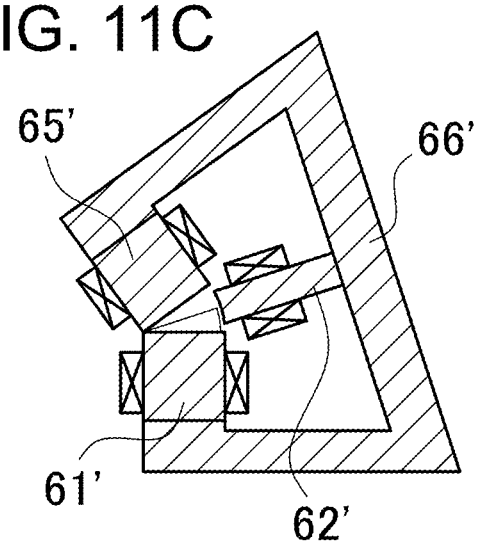
Figure 11F:
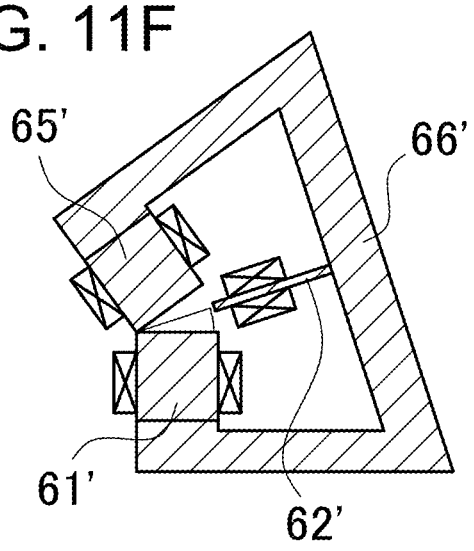
Figure 12A:
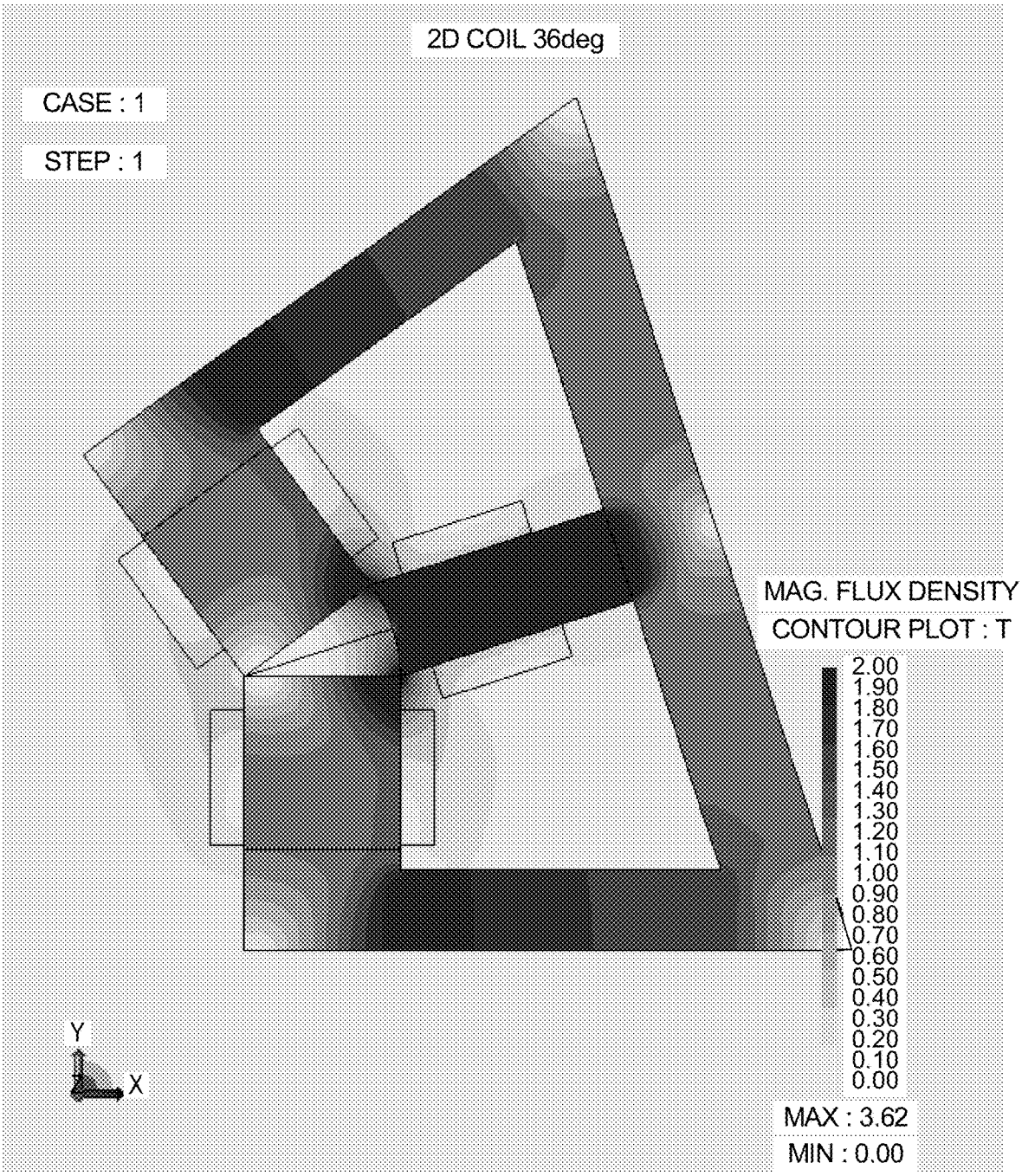
FIGS. 12A to 12F are images showing the distributions of the magnetic flux densities obtained in the exemplary arrangements shown in FIGS. 11A to 11F, respectively.
Figure 12B:
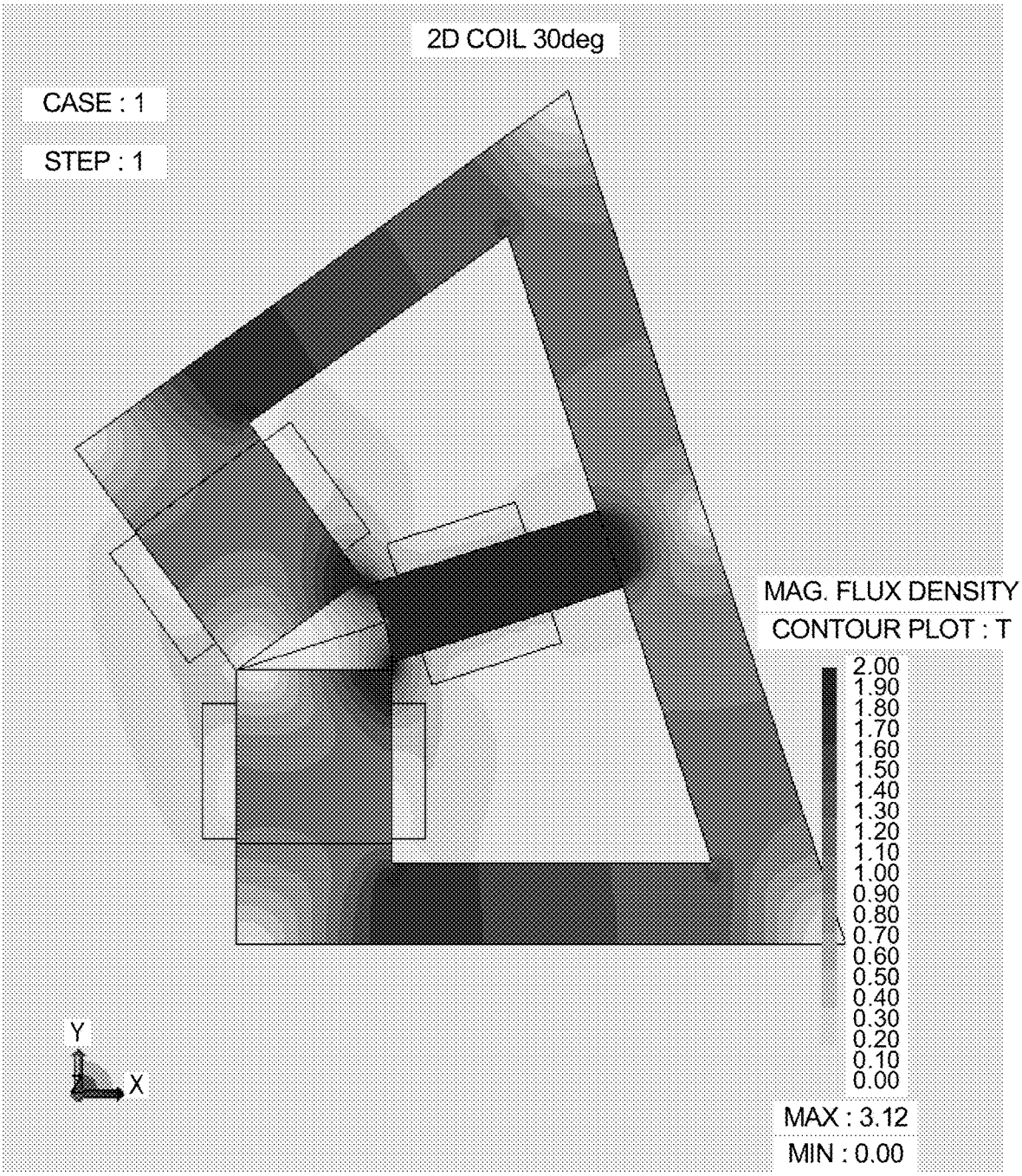
Figure 12C:
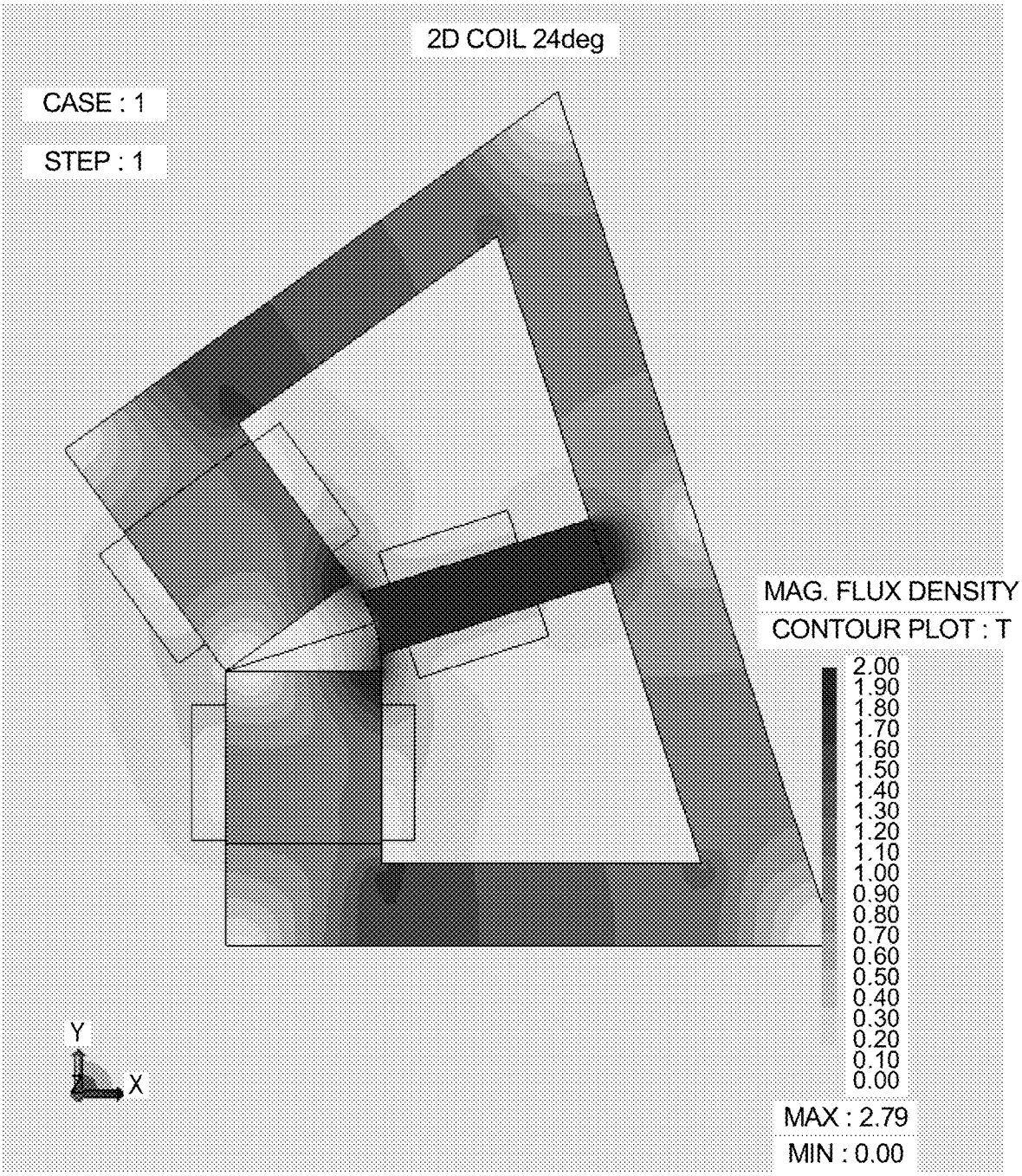
Figure 12D:
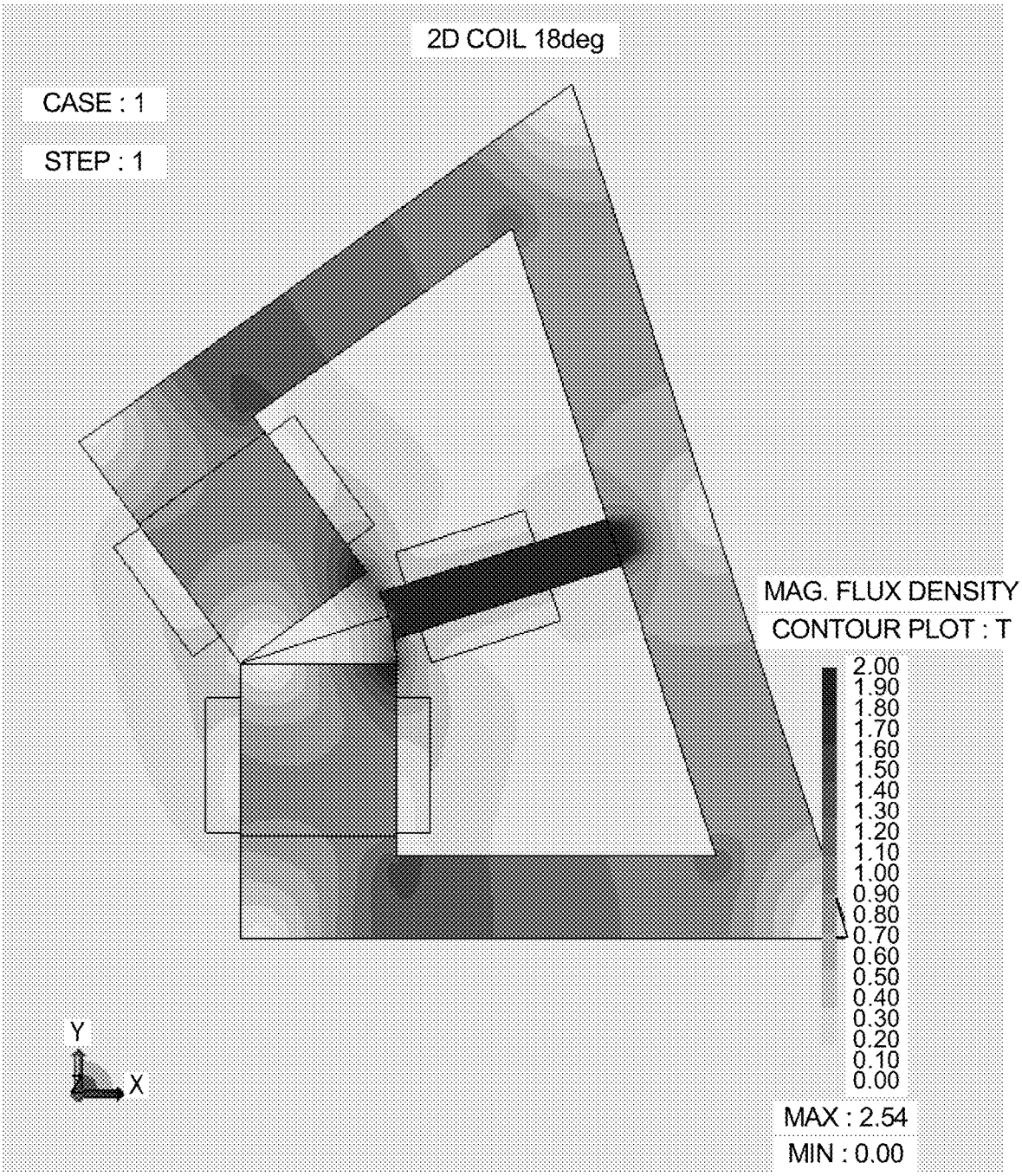
Figure 12E:
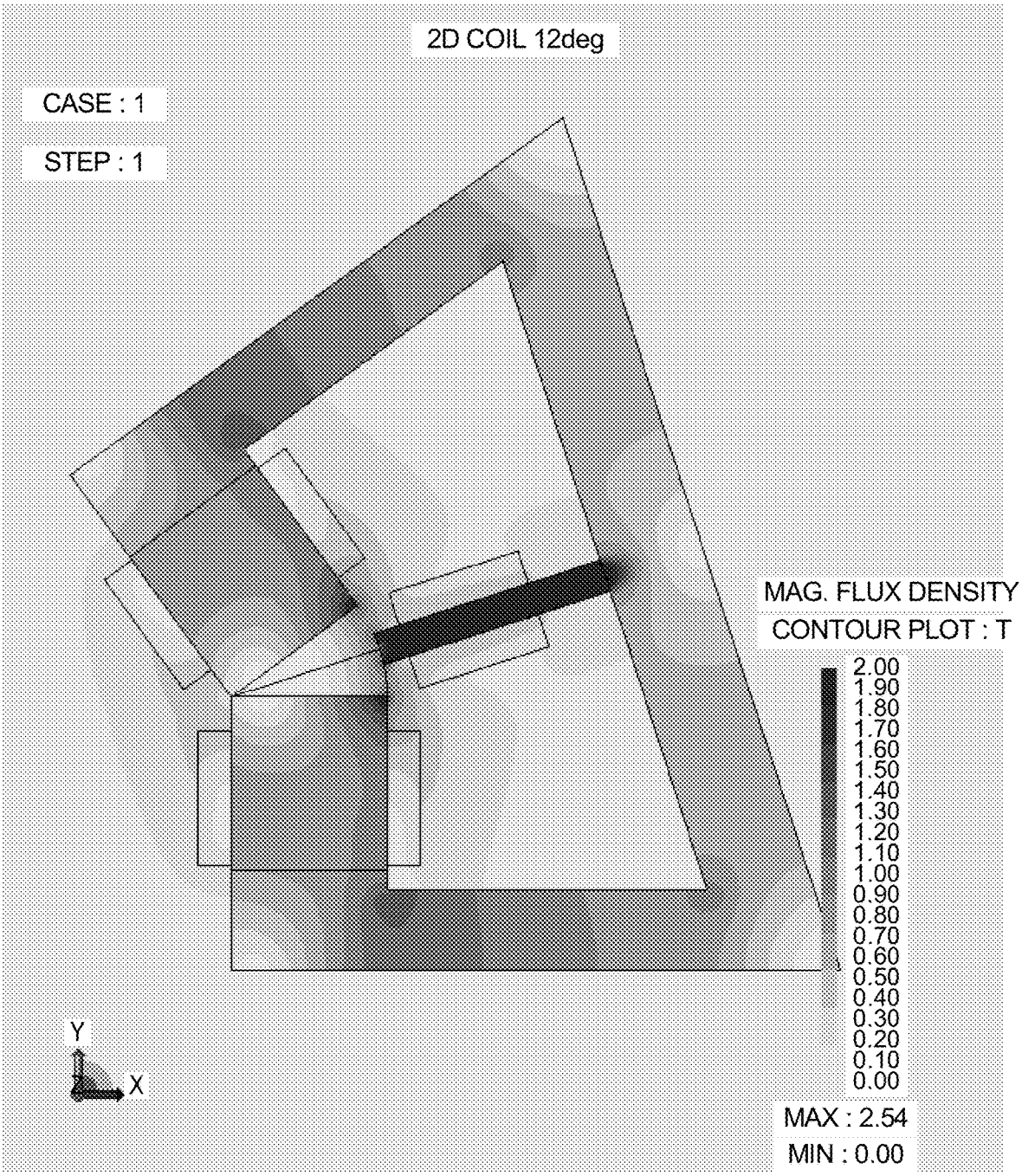
Figure 12F:
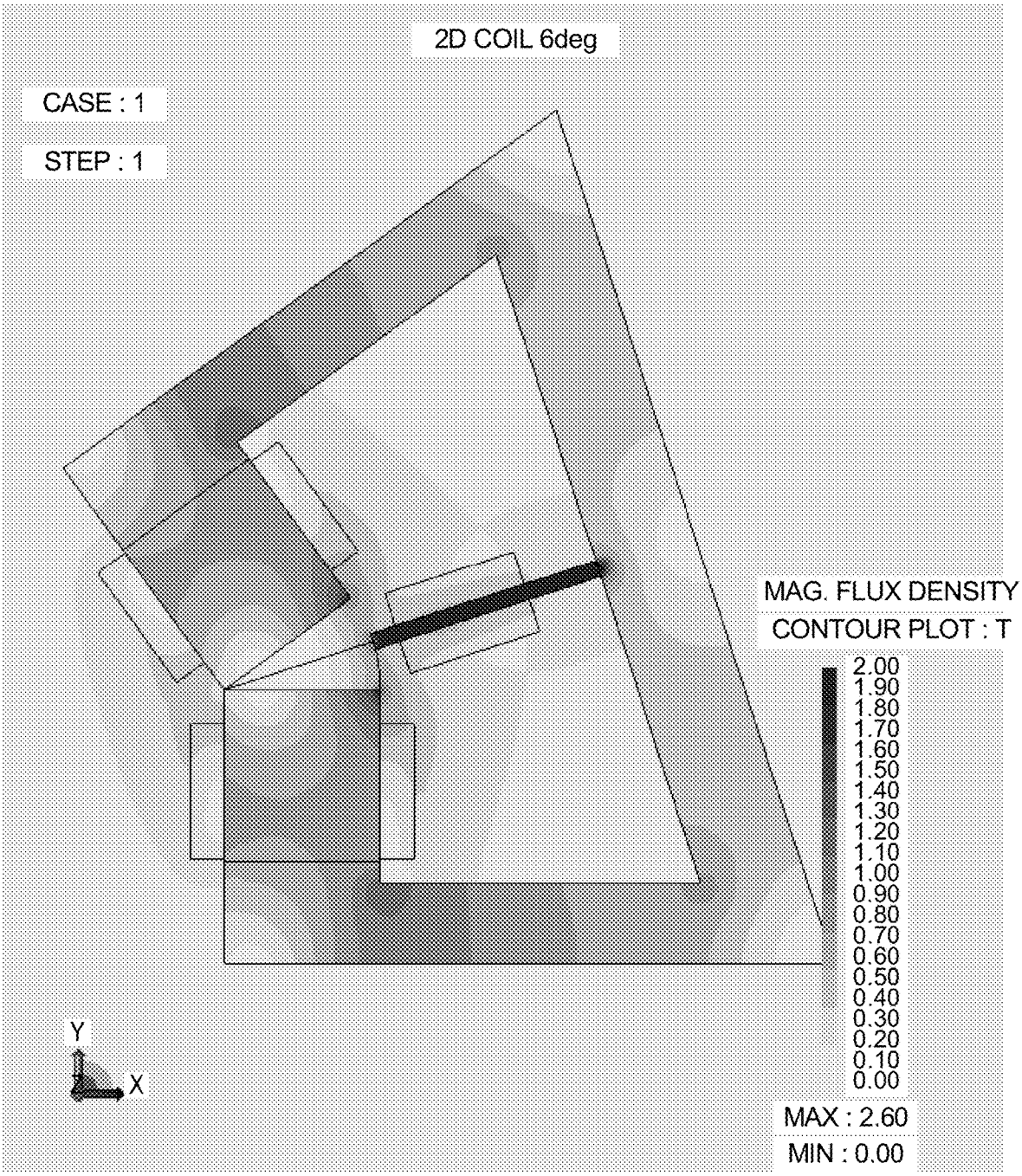
Figure 13A:
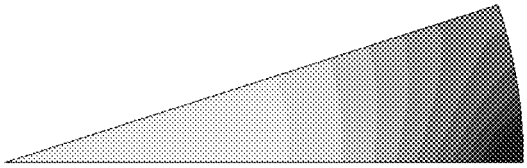
FIGS. 13A to 13F are enlarged images of parts of the bonded magnet components shown in FIGS. 12A to 12F, respectively.
Figure 13D:
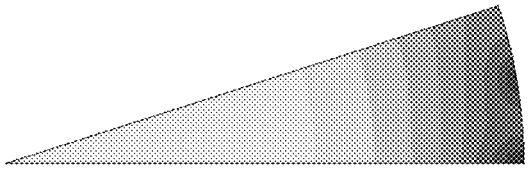
Figure 13B:
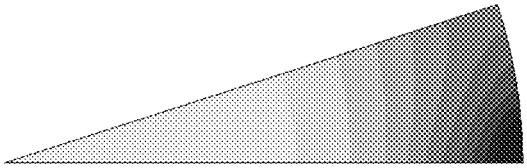
Figure 13E:
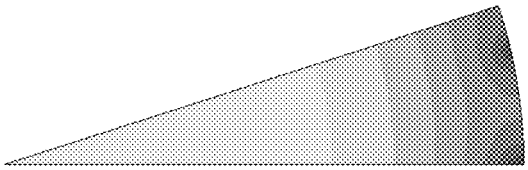
Figure 13C:
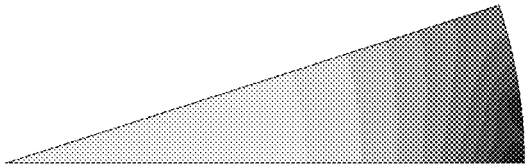
Figure 13F:
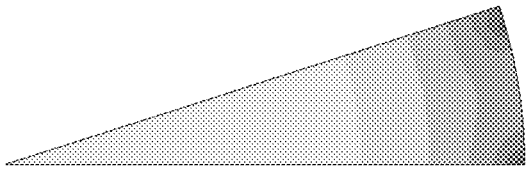
Figure 14A:
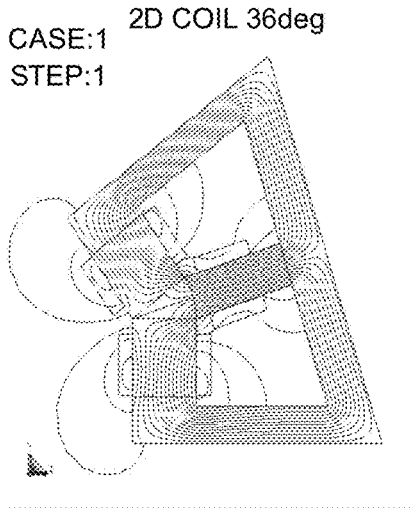
FIGS. 14A to 14F are images showing the magnetic paths produced in the exemplary arrangements shown in FIGS. 11A to 11F, respectively.
Figure 14B:
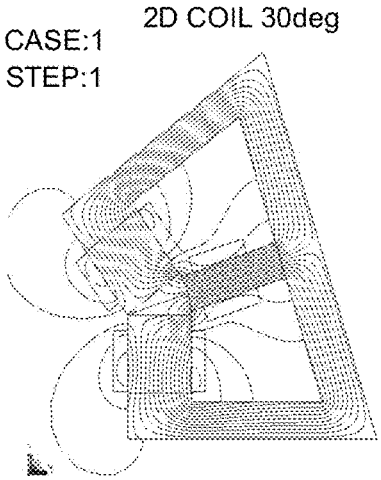
Figure 14C:
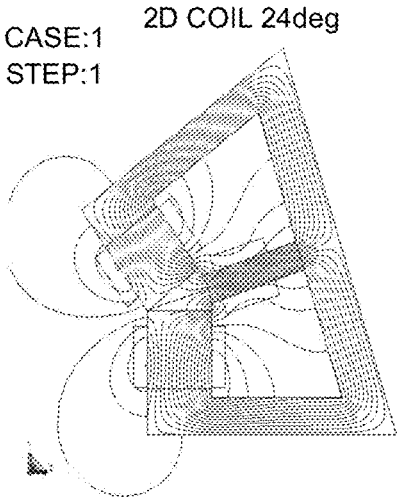
Figure 14D:
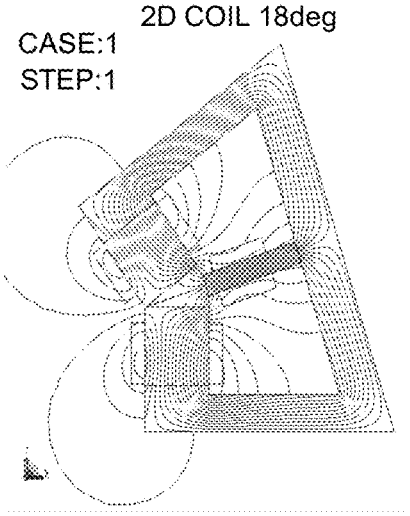
Figure 14E:
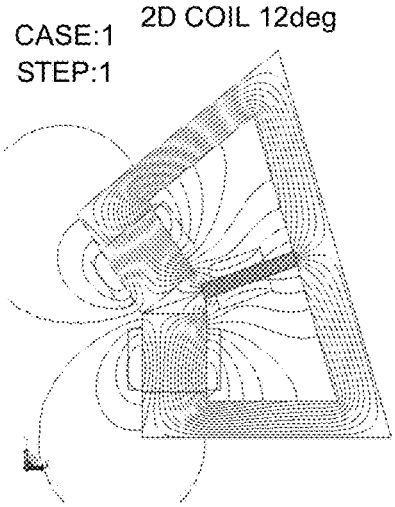
Figure 14F:
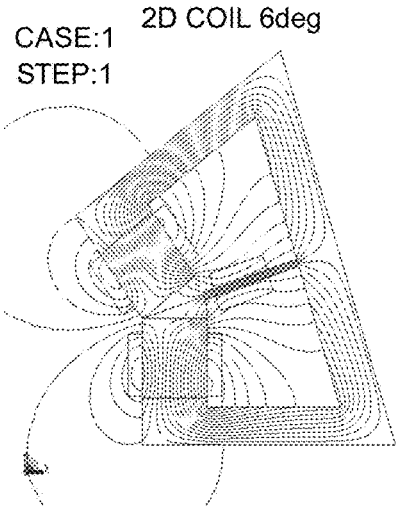
Figure 15A:
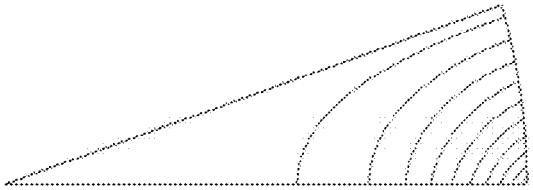
FIGS. 15A to 15F are enlarged images of parts of the bonded magnet components shown in FIGS. 9A to 9F, respectively.
Figure 15D:
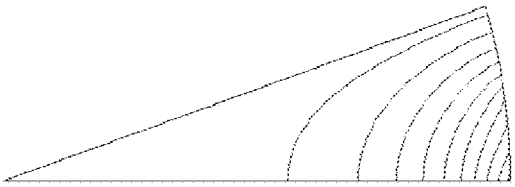
Figure 15B:
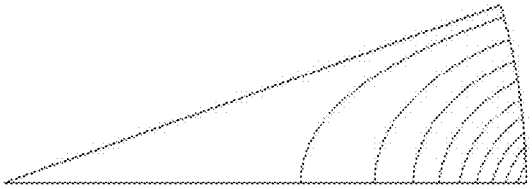
Figure 15E:
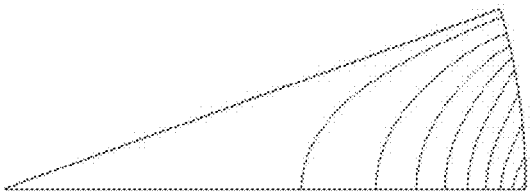
Figure 15C:
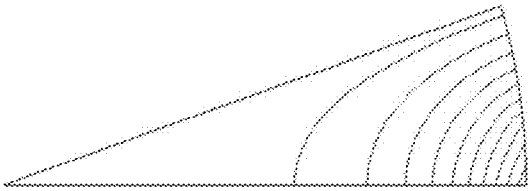
Figure 15F:
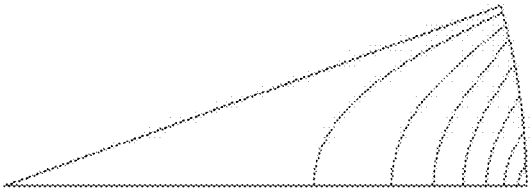

FIGS. 5A to 5F show the simulated results of the magnetic flux densities obtained by bonded magnets which are produced by using magnetic circuit devices each of which includes permanent magnets or electromagnets and is used as an exemplary device for producing the bonded magnet or the bonded magnet component. As shown in FIG. 5A, the first non-action-surface magnetizing magnet 61, the first action-surface magnetizing magnet 62, the third non-action-surface magnetizing magnet 65, and a yoke 66 are arranged so as to form the molds which define the cavity to be filled with the bonded magnet composition for forming the bonded magnet. The yoke 66 magnetically connects these magnets to each other so as to form a magnetic circuit. In this test, the area of the first non-action-surface magnetizing magnet 61 for the sector-shaped first non-action surface 11 (the radius of the sector) and the central angle $\Theta_0$ of the sector are fixed, while the width WD of the first action-surface magnetizing magnet 62 is varied. As shown in FIG. 6, the width WD of the first action-surface magnetizing magnet 62 is represented by the angle $\Theta_2$ as the length of the segment of a circle which extend along the contact arc line between the end surface of the first action-surface magnetizing magnet 62 and the first action surface 12 of the bonded magnet component. In this case, on the conditions that the radius of the sector is set to A=20 mm, and the central angle of the sector is set to $\Theta_0$=36°, the angle $\Theta_2$ of the first action-surface magnetizing magnet 62 is varied by 6° (36°, 30°, 24°, 18°, 12°, and 6°). The exemplary arrangements of the magnetizing magnets are shown in FIGS. 5A to 5F. FIGS. 7A to 7F show the distributions of the magnetic flux densities obtained by the arrangements shown in FIGS. 5A to 5F, respectively. FIGS. 8A to 8F are enlarged diagrams showing parts (lower halves) of the bonded magnet components produced by the arrangements shown in FIGS. 5A to 5F, respectively. FIGS. 9A to 9F are diagrams showing magnetic paths formed by the arrangements shown in FIGS. 5A to 5F, respectively. FIGS. 10A to 10F are enlarged views showing the magnetic paths in parts (lower halves) of the bonded magnet components produced by the arrangements shown in FIGS. 5A to 5F, respectively.

FIGS. 11A to 11F show magnetic circuit devices of comparative examples each of which includes electromagnets as the magnetizing magnets instead of the permanent magnets. In the comparative examples, similar to FIGS. 5A to 5F, the first non-action-surface magnetizing electromagnet 61', the first action-surface magnetizing electromagnet 62', the third non-action-surface magnetizing electromagnet 65', and a yoke 66' are arranged so as to form the molds which define the cavity to be filled with the bonded magnet composition for forming the bonded magnet. The yoke 66" magnetically connects these magnets to each other so as to form a magnetic circuit. The area of the first non-action-surface magnetizing electromagnet 61' for the sector-shaped first non-action surface 11 and the central angle $\Theta_0$ of the sector are fixed, while the width WD of the first action-surface magnetizing magnet 62' is varied by varying the angle $\Theta_2$ as shown in FIGS. 11A to 11F. FIGS. 12A to 12F show the distributions of the magnetic flux densities obtained by the arrangements shown in FIGS. 11A to 11F, respectively. FIGS. 13A to 13F are enlarged diagrams showing parts (lower halves) of the bonded magnet components produced by the arrangements shown in FIGS. 11A to 11F, respectively. FIGS. 14A to 14F are diagrams showing magnetic paths produced by the arrangements shown in FIGS. 11A to 11F, respectively. FIGS. 15A to 15F are enlarged views showing the magnetic paths in parts (lower halves) of the bonded magnet components formed by the arrangements shown in FIGS. 11A to 11F, respectively.

Figure 16:
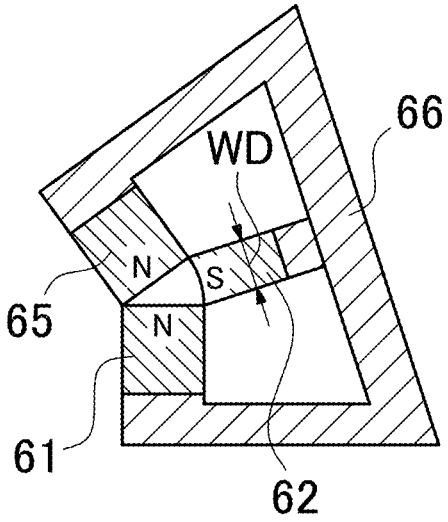
FIG. 16 is a schematic cross-sectional view showing a magnetic circuit device including permanent magnets used for producing a bonded magnet component according to a modified exemplary arrangement.

In the arrangements shown in FIGS. 5A to 5F, and 11A to 11F, the cavities are formed by molding dies for forming two bonded magnet components (first and second bonded magnets). When only the first bonded magnet component is formed, nonmagnetic steel (e.g., stainless steel, etc.) is accommodated in the space to be filled with the second bonded magnet component. To show this process, the exterior shape of one of the cavities for forming the first bonded magnet component is shown in FIGS. 5A to 5F, and 11A to 11F. However, the present invention is not limited to this. Two bonded magnet components (first and second bonded magnets) may be formed at the same time. FIG. 16 shows this arrangement.

Figure 17:
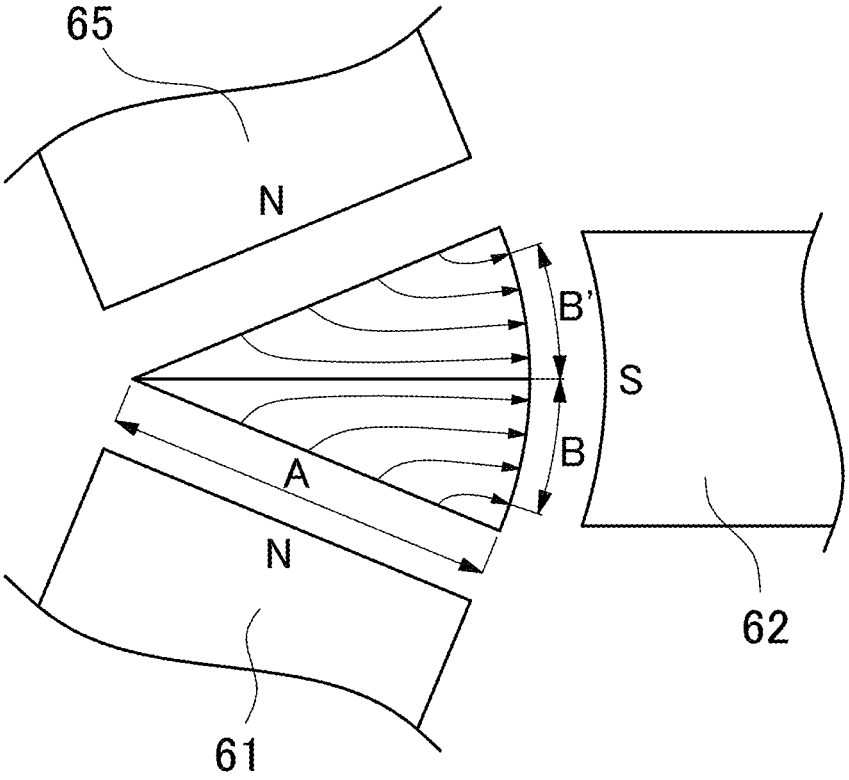
FIG. 17 is a cross-sectional view showing bonded magnet components, and parts of magnets for controlling the magnetic orientation of these bonded magnet components.

FIGS. 18A to 18F show the results of the measured strength of the magnetic field [T] versus position (0 to 20 mm from the center along the length A in FIG. 17) along the radial direction of the bonded magnet components produced at the area ratios by using the permanent magnets and the electromagnets as the magnetizing magnets as discussed above. The area ratio is the ratio A/B of the area of the sector-shaped bonded magnet component corresponding to the radius A to the area from the top end to the lower end of a magnetized part corresponding to the segment of the circle B in the sector shape, as shown in FIG. 17. In the case where the height of the cylindrical columnar bonded magnet component is constant, the ratio A/B is equal to the area ratio. Accordingly, A/B is occasionally referred to as the area ratio.

Figure 18A:
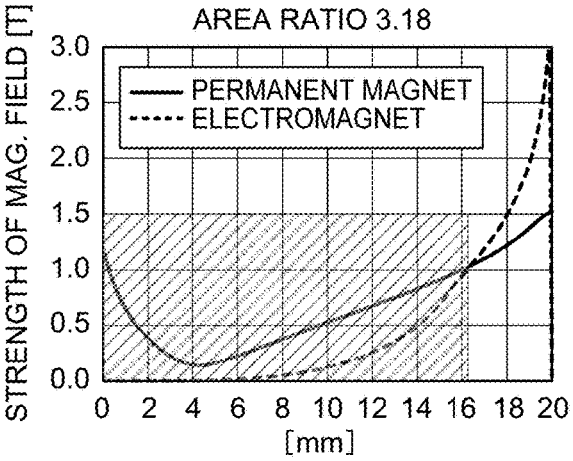
FIGS. 18A, 18B, 18C, 18D, 18E, and 18F are graphs showing the results of the measured strength versus the position along the radial direction of the bonded magnet components produced on the condition that the angle $\Theta_2$ is set to 36°, 30°, 24°, 18°, 12°, and 6°, respectively.
Figure 18B:
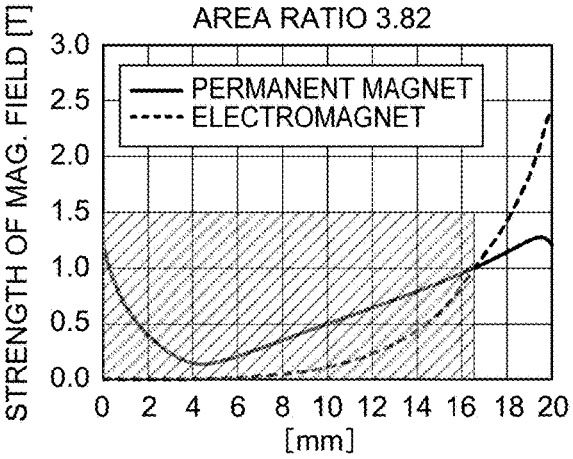
Figure 18C:
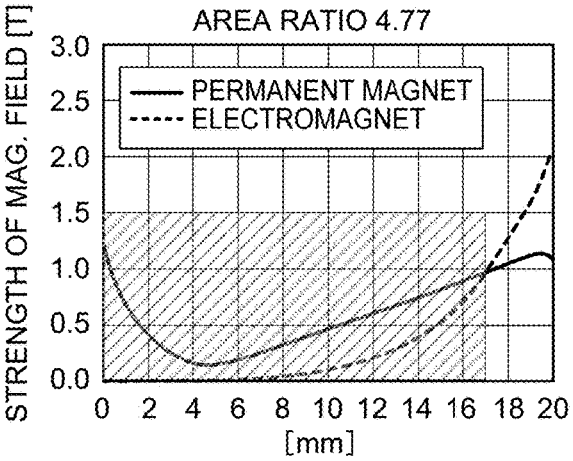
Figure 18D:
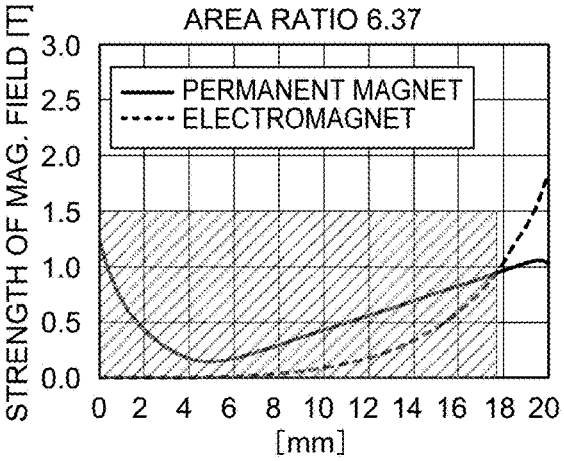
Figure 18E:
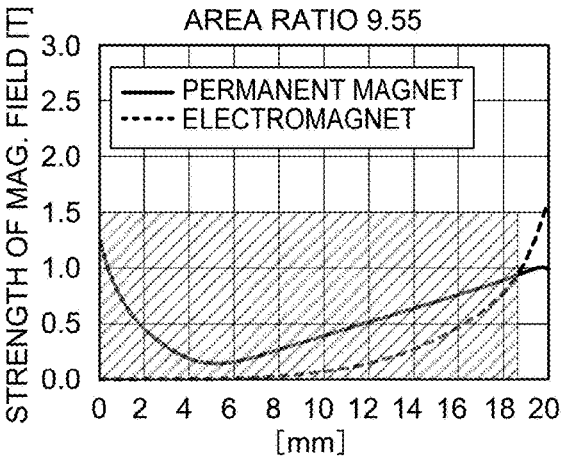
Figure 18F:
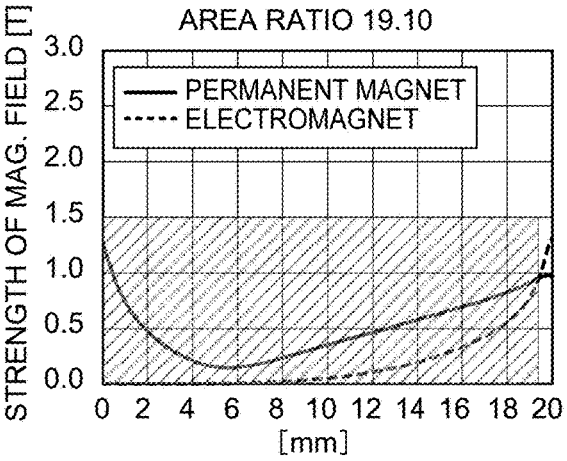

In FIG. 17, the first group of magnetic lines of flux is curved from the first surface to the second surface inside the bonded magnet component, and the third group of magnetic lines of flux is curved from the fifth surface to the second surface inside the bonded magnet component so that the first and third groups of magnetic lines of flux extend substantially symmetrically with respect to a line (on the upper and lower sides with respect to the horizontal line passing through the center in FIG. 17) in the bonded magnet components having a sector shape as viewed in plan view. Accordingly, it can be considered that the part B corresponding the first group of magnetic lines of flux are substantially equal to the part B' corresponding the third group of magnetic lines of flux. For this reason, the degree of convergence of the magnetized part is evaluated based on the part B corresponding one of the magnetic flux groups (the first group of magnetic lines of flux) in this test. The convergence of the magnetic flux will become higher as the value of area ratio A/B increases. FIG. 18A shows the case of $\theta_2$=36°, which corresponds to an area ratio of 3.18. FIG. 18B shows the case of $\theta_2$=30°, which corresponds to an area ratio of 3.82. FIG. 18C shows the case of $\theta_2$=24°, which corresponds to an area ratio of 4.77. FIG. 18D shows the case of $\theta_2$=18°, which corresponds to an area ratio of 6.37. FIG. 18E shows the case of $\theta_2$=12°, which corresponds to an area ratio of 9.55. FIG. 18F shows the case of $\theta_2$=6°, which corresponds to an area ratio of 19.10. It can be clearly seen that the strength of the magnetic field is high only in the part near the arc or segment of the circle in the case of the electromagnets. The reason is that shortcuts of magnetic flux will appear from one of the yokes to another. In other words, only the part near the action surface is magnetized. The magnetic flux becomes weaker as the magnetic flux is closer to the center of the cylindrical shape. That is, the magnetic path does not extend along a parabolic line. This means that the radius of curvature at any point of the pattern of the magnetic path is close to constant. Such magnetic path patterns can be seen in FIGS. 15A to 15F.

In the case of the bonded magnet components produced by permanent magnets, the magnetic field is likely to extend in the entire cavity. Accordingly, the formed magnetic field has a good linearity. The strength of the formed magnetic field tends to increase toward the action surface. In addition, the formed magnetic field has a certain amount of strength even in the part near the center of the cylindrical shape. In other words, it can be seen that the magnetic path reaches the center of the cylindrical shape. Such magnetic fields can be seen in FIGS. 10A to 10F. From the results, it is confirmed that the permanent magnets are more suitable as the magnetizing magnets than the electromagnets.

In particular, the permanent magnets suitably magnetize the bonded magnet containing a rare earth element such as Sm. In the case of a bonded magnet containing ferrite (disclosed in JP H10-308,308 A, for example), the magnetic orientation can be controlled by even a weak magnetic field. However, in the case of a rare-earth-based bonded magnet, a strong magnetic field is required to control the magnetic orientation. For this reason, it is difficult for the approach disclosed in JP H10-308,308 A to deeply extend a magnetic field inside the cylindrical shape. The approach disclosed in JP H10-308,308 A can provide only the magnetic orientation that is formed in the part near the action surface and has a constant radius of curvature at any point of the magnetic orientation as shown in FIGS. 15A to 15F. According to the process according to this embodiment that separately forms the bonded magnet components, which correspond to the divided part of the bonded magnet, by using the permanent magnets as discussed above, the magnetic orientation can be controlled so that the magnetic field deeply extends to the part close to the center of the cylindrical shape.

(Variation in Number of Magnetic Poles)

Figure 19A:
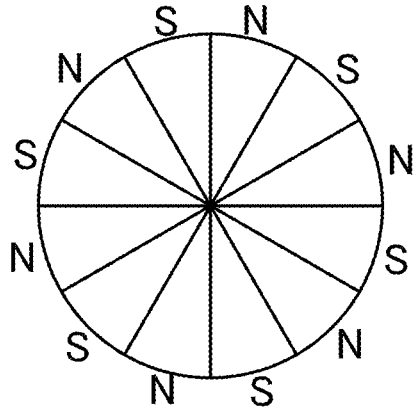
FIGS. 19A, 19B, 19C, and 19D are plan views showing cylindrical 12-pole, 10-pole, 8-pole, and 6-pole bonded magnets.
Figure 19B:
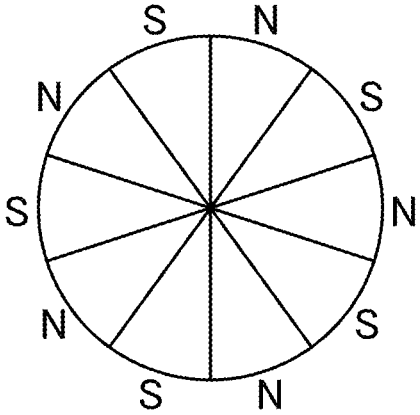
Figure 19C:
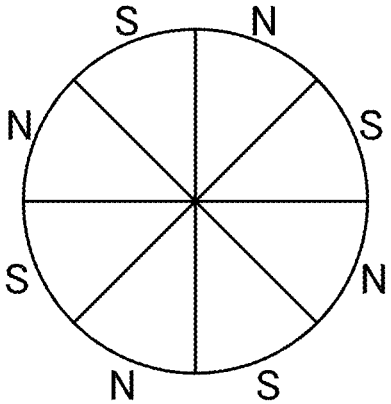
Figure 19D:
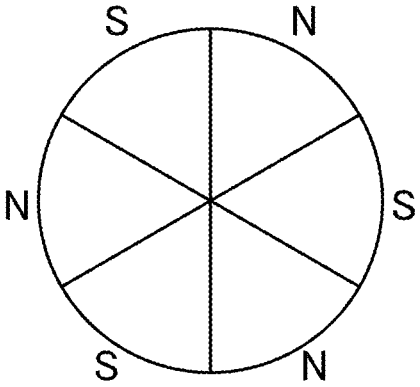
Figure 20A:
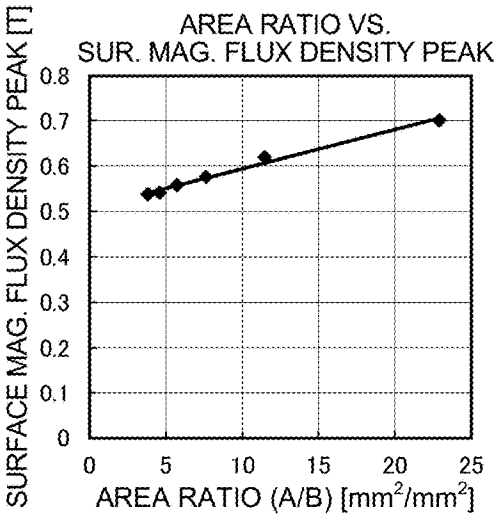
FIGS. 20A, 20B, 20C, and 20D are graphs showing the relationship between the area ratio and the surface magnetic flux density peak value in the bonded magnet components having central angles of 30°, 36°, 45°, and 60°, respectively.
Figure 20B:
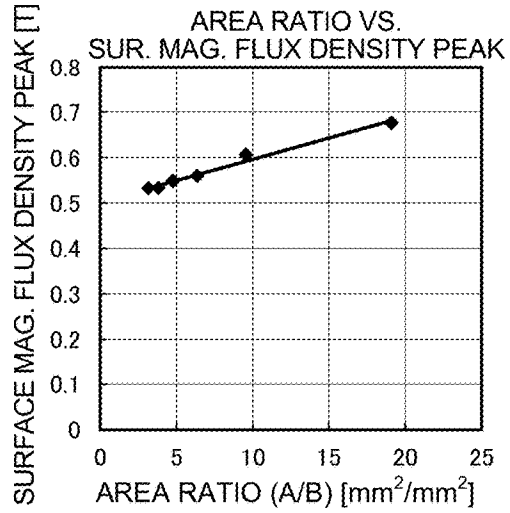
Figure 20C:
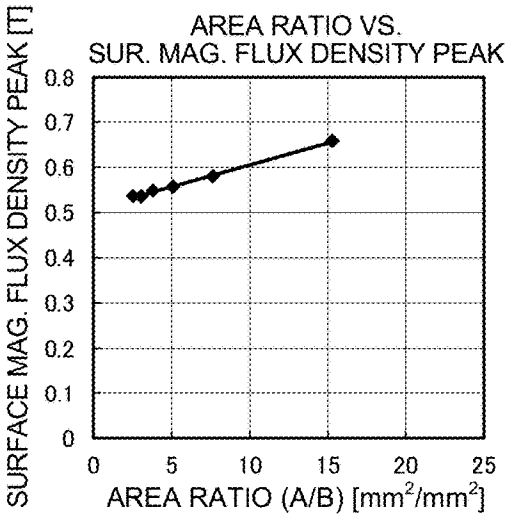
Figure 20D:
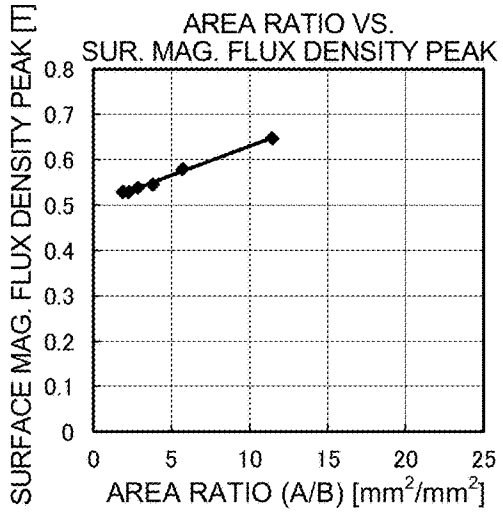
Figure 21A:
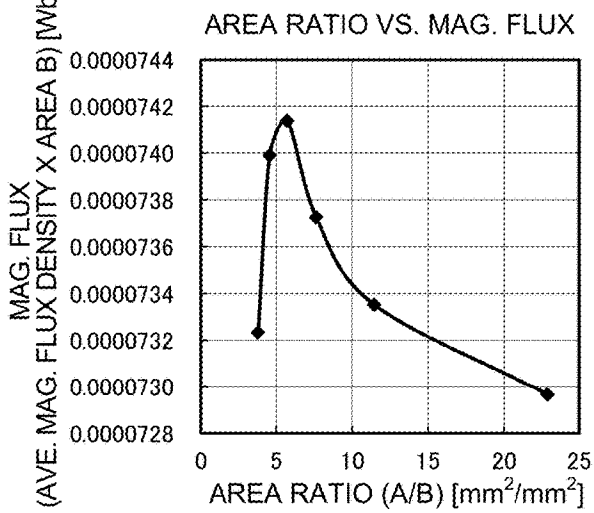
FIGS. 21A, 21B, 21C, and 21D are graphs showing the relationship between the area ratio and the magnetic flux in the bonded magnet components having central angles of 30°, 36°, 45°, and 60°, respectively.
Figure 21B:
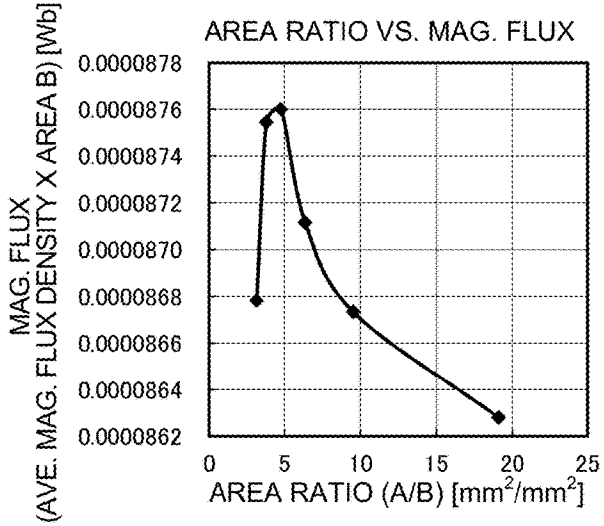
Figure 21C:
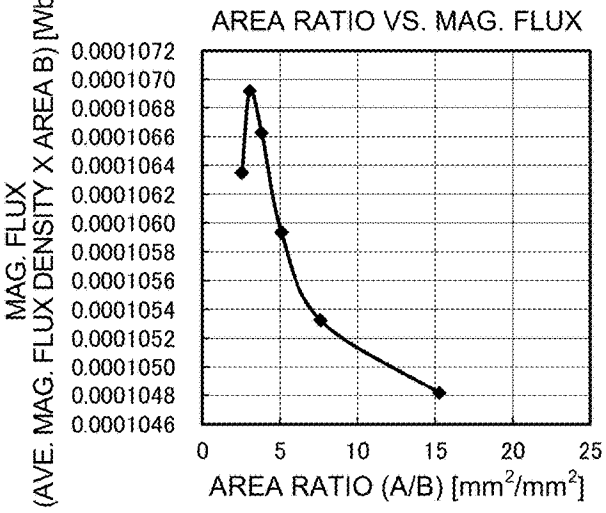
Figure 21D:
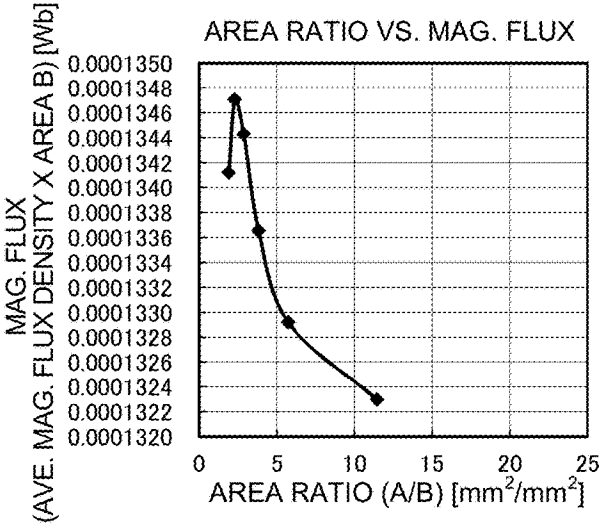
Figure 22A:
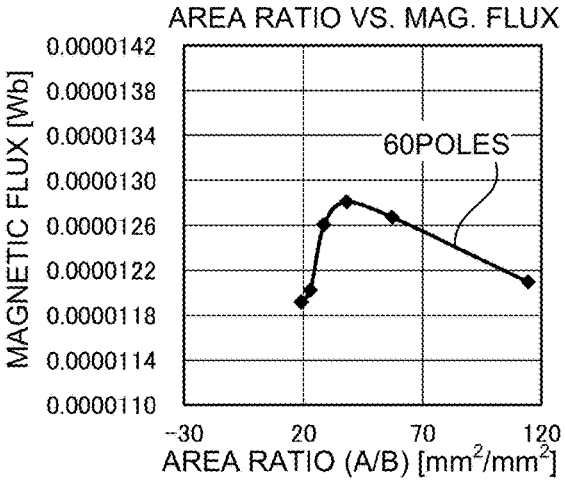
FIGS. 22A, 22B, 22C, 22D, 22E, and 22F are graphs showing the relationship between the area ratio and the magnetic flux in bonded magnet components having central angles of 6°, 9°, 12°, 18°, 20°, and 22.5°; respectively.
Figure 22B:
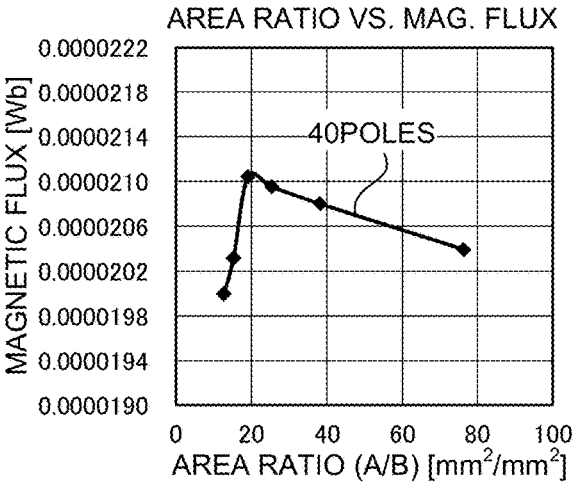
Figure 22C:
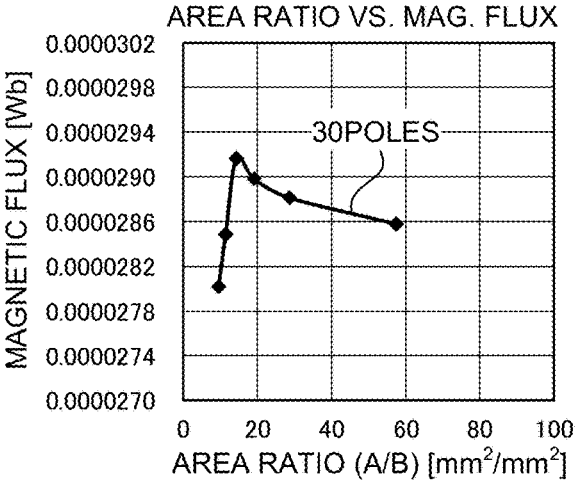
Figure 22D:
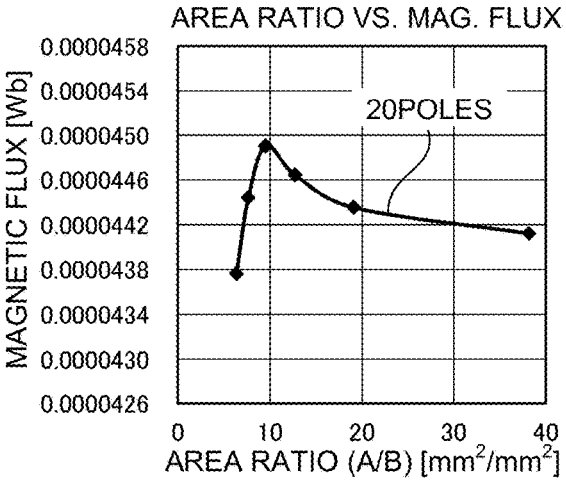
Figure 22E:
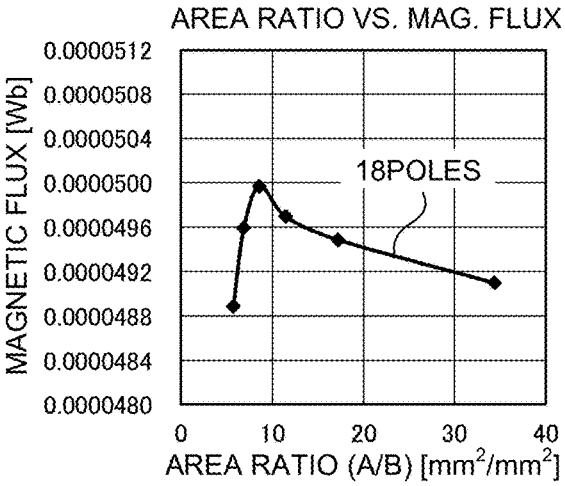
Figure 22F:
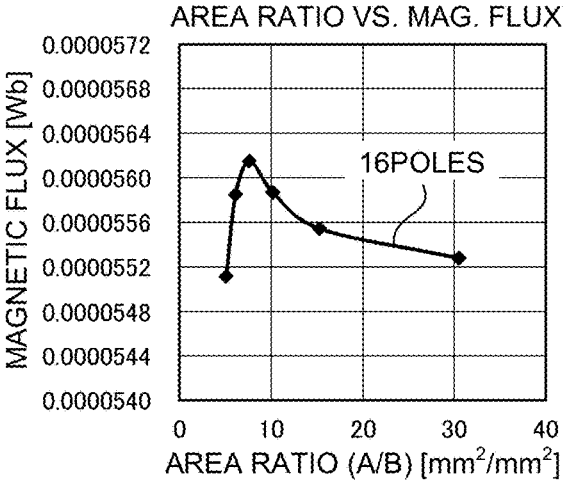

The width of the magnetizing magnet, i.e., the area of the magnetized part of the bonded magnet component is now discussed. In the foregoing embodiment, as the case where the cylindrical columnar bonded magnet is constructed of a plurality of bonded magnet components having the common shape, it has been described that the central angle of the sector of the bonded magnet component is 36°, and the cylindrical columnar bonded magnet is constructed of ten bonded magnet components so that total ten poles (five pairs of north and south poles) appear on the circumferential side surface of the bonded magnet as shown in a plan view of FIG. 19B. Here, the central angle of the bonded magnet component is varied from 30° to 60° (including 36°). FIGS. 20A to 20D show the peak values of the surface magnetic flux density [T] versus the area ratio A/B of the magnetized part in the cases of these central angles. Also, FIGS. 21A to 21D are graphs showing the magnetic flux [Wb] obtained by multiplying the average magnetic flux density by the area in the cases of these central angles. FIGS. 20A and 21A show the surface magnetic flux density and the magnetic flux versus the area ratio A/B of the bonded magnet component which has a central angle $\Theta_0$ of 30° (π/6 [rad]) for a 12-pole cylindrical columnar bonded magnet shown in FIG. 19A. FIGS. 20B and 21B show the surface magnetic flux density and the magnetic flux of the bonded magnet component which has a central angle $\Theta_0$ of 36° (π/5 [rad], for the 10-pole cylindrical columnar bonded magnet shown in FIG. 19B.) FIGS. 20C and 21C show the surface magnetic flux density and the magnetic flux of the bonded magnet component which has a central angle $\Theta_0$ of 45° (π/4 [rad], for the 8-pole cylindrical columnar bonded magnet shown in FIG. 19C.) FIGS. 20D and 21D show the surface magnetic flux density and the magnetic flux of the bonded magnet component which has a central angle $\Theta_0$ of 60° (π/3 [rad], for the 6-pole cylindrical columnar bonded magnet shown in FIG. 19D.) Although these graphs show the relationship between the area ratio A/B and the magnetic flux of the bonded magnet component in the cases of central angles from 30° to 60°, the central angle $\Theta_0$ of the bonded magnet component can be smaller than 30° so that the number of poles of the bonded magnet component is greater than 12. FIGS. 22A to 22F are graphs showing the relationship between the area ratio A/B and the magnetic flux of the bonded magnet component in the cases of total 16 poles to 60 poles. FIGS. 22A, 22B, 22C, 22D, 22E, and 22F correspond to central angles $\Theta_0$ of 6° (60 poles), 9° (40 poles), 12° (30 poles), 18° (20 poles), 20° (18 poles), and 22.5° (16 poles), respectively.

According to these graphs, the surface magnetic flux density of the bonded magnet component tends to become higher as the area ratio A/B increases, in other words, as the width WD of the first action-surface magnetizing magnet 62 decreases in the cases of all of the central angles. The magnetic flux reaches its peak value in the low area ratio A/B range. For example, in the cases of central angles of 30°, 36°, 45°, and 60°, their magnetic flux become high in the area ratio A/B ranges of 5 to 8, 4 to 7, 3 to 4, and 2 to 3, respectively. From the aforementioned results, it can be said that the area ratio A/B preferably falls within the range of 2.0 to 8.0 in the case where the central angle $\Theta_0$ falls within the range of 30° to 60°.

Figure 23:
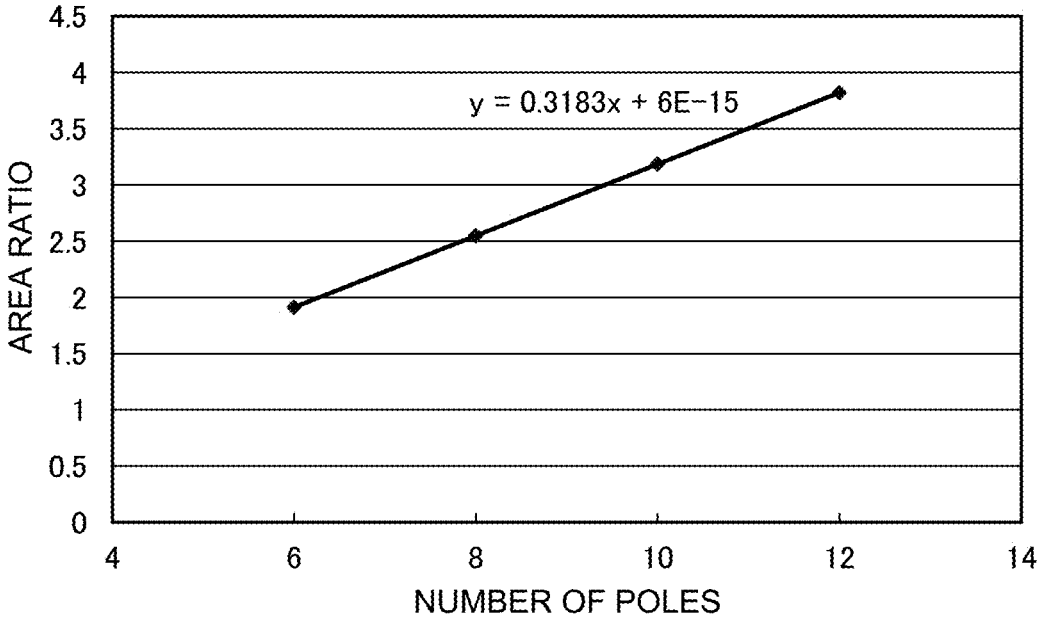
FIG. 23 is a graph showing the relationship between the pole number and the area ratio at the lower limit in the high magnetic flux in the cases of FIGS. 21A to 21D.
Figure 24:
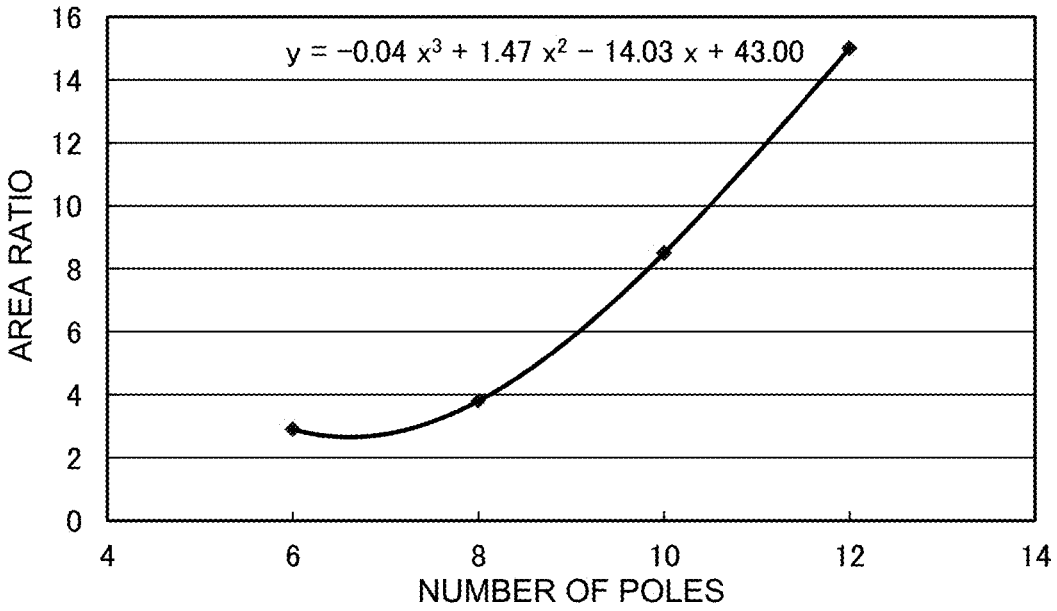
FIG. 24 is a graph showing the relationship between the pole number and the area ratio at the upper limit in the high magnetic flux in the cases of FIGS. 21A to 21D.
Figure 25:
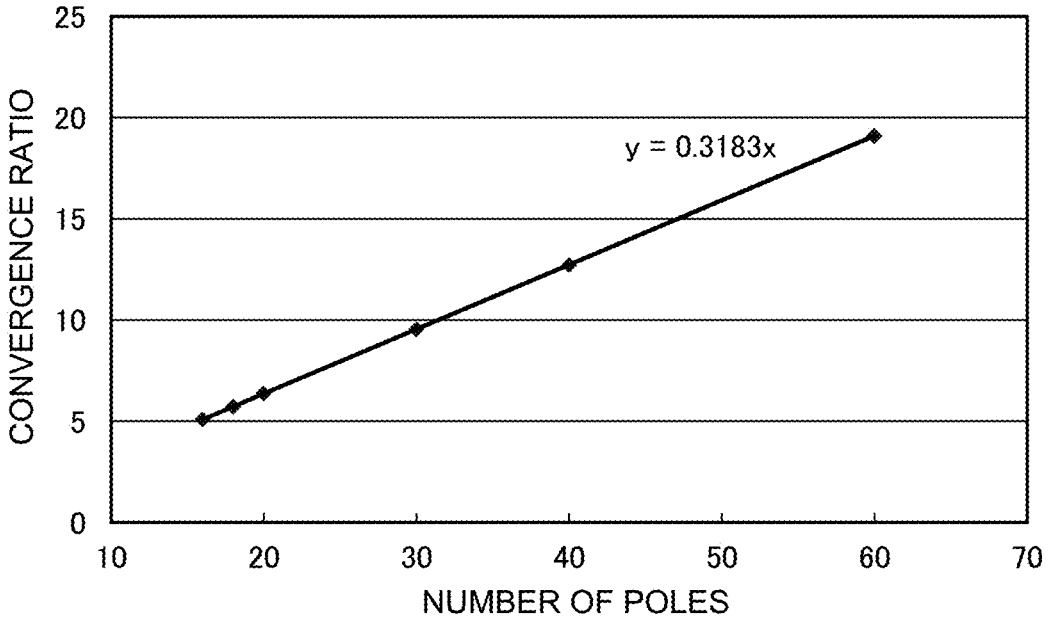
FIG. 25 is a graph showing the relationship between the pole number and the area ratio at the lower limit in the high magnetic flux in the cases of FIGS. 22A to 22D.

As discussed above, it is confirmed that the magnetic flux becomes higher as the sector central angle increases in the low area ratio A/B range. A preferable range of area ratio A/B is now considered. FIG. 23 is a graph showing a straight line approximating plots of the minimum values as the lower limits of the area ratio A/B in FIGS. 21A to 21D versus the number of poles in order to confirm the lower limits of area ratio A/B in the case where the number of poles n is not greater than 12. FIG. 24 is a graph showing a quadratic curve approximating plots of the limit values for obtaining the magnetic flux at the lower limits of the area ratio A/B in FIGS. 21A to 21D versus the number of poles in order to confirm the upper limits of area ratio A/B. Also, FIG. 25 is a graph showing a straight line approximating plots of the minimum values as the lower limits of the area ratio A/B in FIGS. 22A to 22D versus the number of poles in order to confirm the lower limits of area ratio A/B in the case where the number of poles n is greater than 12. Consequently, in the case where the number of poles n is not greater than 12 ($\Theta_0 \geq 30$), the area ratio A/B preferably falls within the range represented by $0.3184n \leq (A/B) < -0.04n^3 + 1.47n^2 - 14.03n + 43$. On the other hand, in the case where the number of poles n is greater than 12 ($\Theta_0 < 30$), the area ratio A/B preferably falls within the range represented by $0.3184n \leq (A/B)$.

(Orientation Rate)

Figure 26:
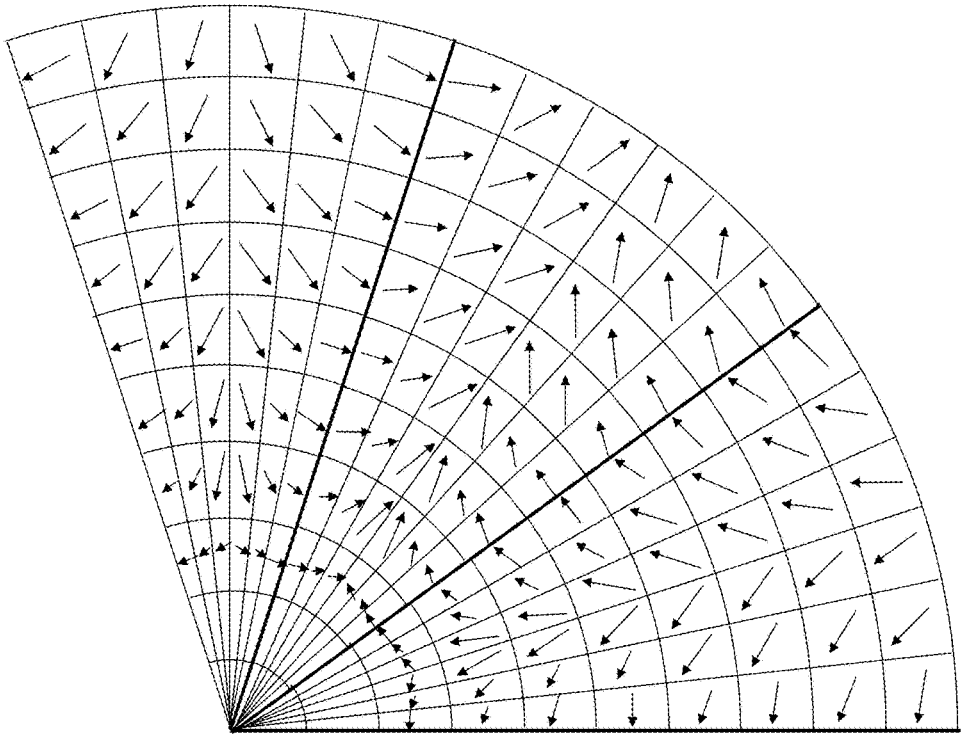
FIG. 26 is a schematic view showing the magnetic orientation obtained by using the permanent magnets.
Figure 27:
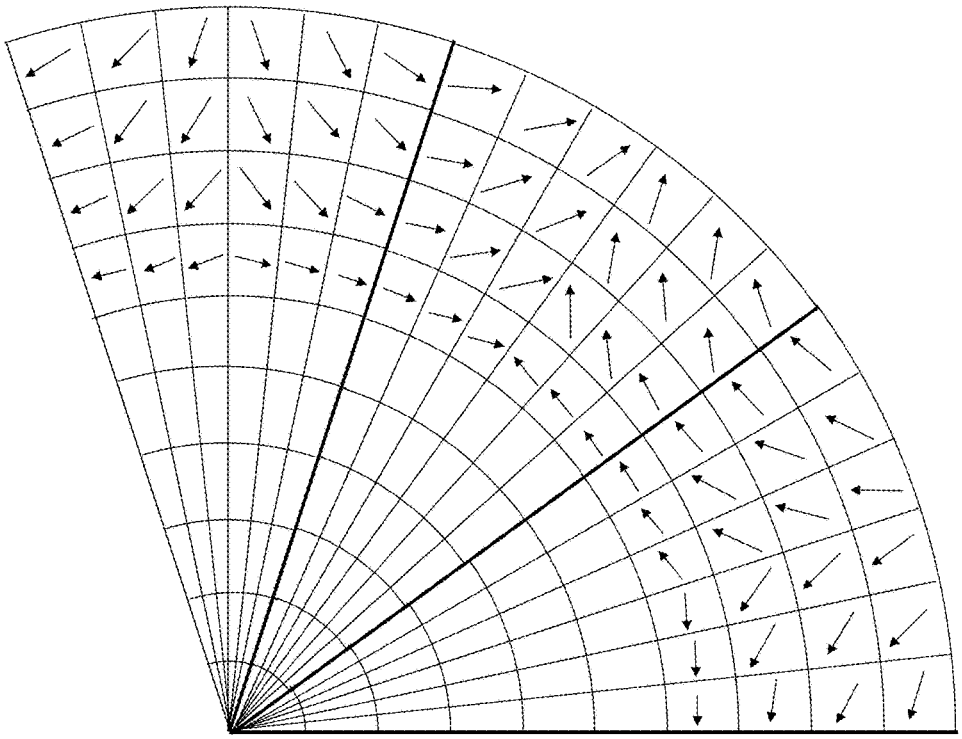
FIG. 27 is a schematic view showing the conventional polar orientation obtained by using permanent magnets.

FIGS. 26 and 27 show orientation rates obtained by the process using the permanent magnets according to the foregoing embodiment of the present invention, and the conventional polar orientation process using the permanent magnets shown in FIG. 54, respectively. In the measurement of the orientation rate, a sample is first sliced into slices with a thickness of 1 to 2 mm, and each of the slices is cut into dices with a size of 1 mm×1 mm. The weight of the dice is measured. Subsequently, the magnetic orientations of the dice are measured by VSM. The measured magnetic orientations of the dice are shown in FIGS. 26 and 27. Each of the dice is magnetized along the direction of the measured orientation. After the magnetization, the strength of the magnetic field of the sample die is additionally measured by VSM. The magnetic orientation rate of the sample is calculated where the strength of the magnetic field of the magnetized magnetic powder used for the sample is defined as 100%.

In the case of the conventional polar orientation process, the magnetic orientation of the bonded magnet is not controlled in the central part as shown in FIG. 27, and the average orientation rate of the bonded magnet is 62.5%. Contrary to this, in the case of the process using the permanent magnets according to the present embodiment, the magnetic orientation of the bonded magnet is controlled in the central part as shown in FIG. 26, and the average orientation rate of the bonded magnet is 85%. This can be seen from the aforementioned graphs of FIGS. 18A to 18F showing the measured strength of the magnetic field versus the position along the radial direction of the bonded magnet components. It is noted that the strength of the magnetic orientation of the bonded magnet in the central part (the range of 0 to 4, or 0 to 5 in the radial position in FIGS. 18A to 18F) corresponds to the opposite orientation to the magnetic orientation in the other part. This is because the strength of the magnetic orientation is represented by its absolute value. Since shortcuts appear toward the magnetizing magnet, the magnetic orientation of the bonded magnet in the central part is opposite to the other part. For example, in the case where the bonded magnet is used for an electric motor, or the like, this central part can be removed in use. In particular, in this case, since a rotational shaft will be inserted into the central part of the bonded magnet for an electric motor, removal of the central part will not cause a problem, or be suitable.

(Surface Magnetic Flux)

Figure 28:
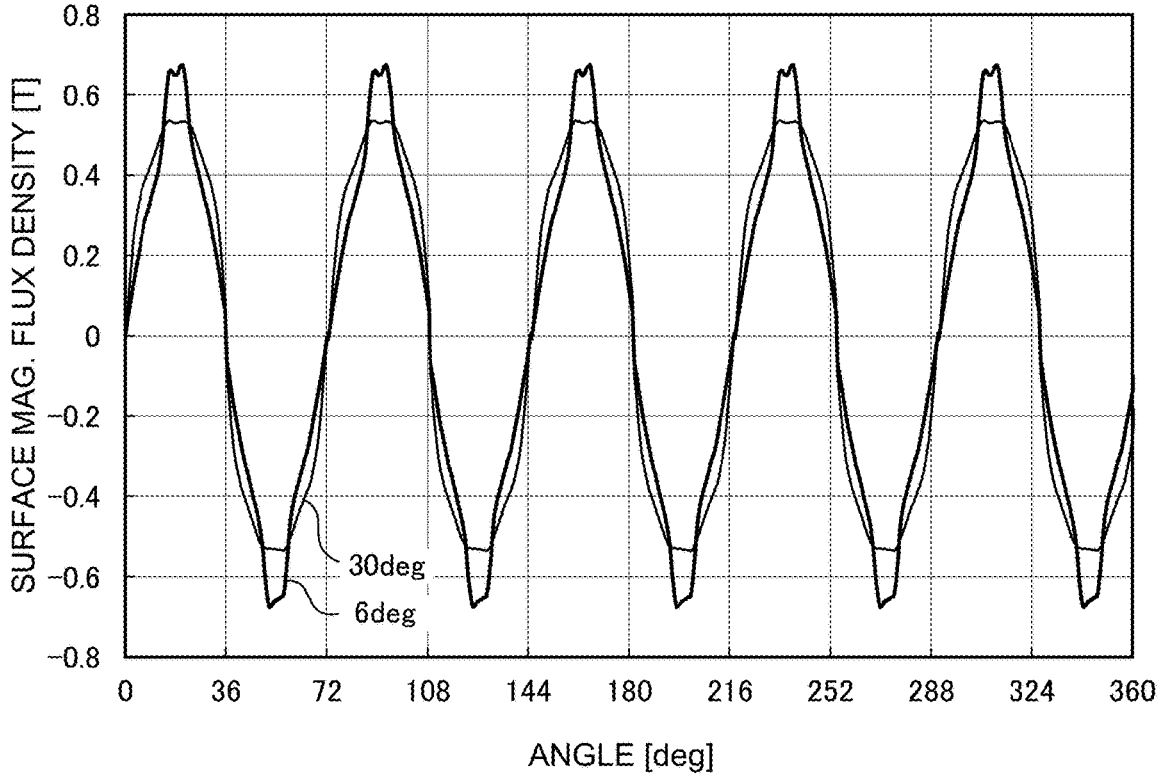
FIG. 28 is a graph showing the surface magnetic flux density versus the angle of the cylindrical columnar bonded magnet composed of bonded magnet components having a central angle of 30°.
Figure 29:
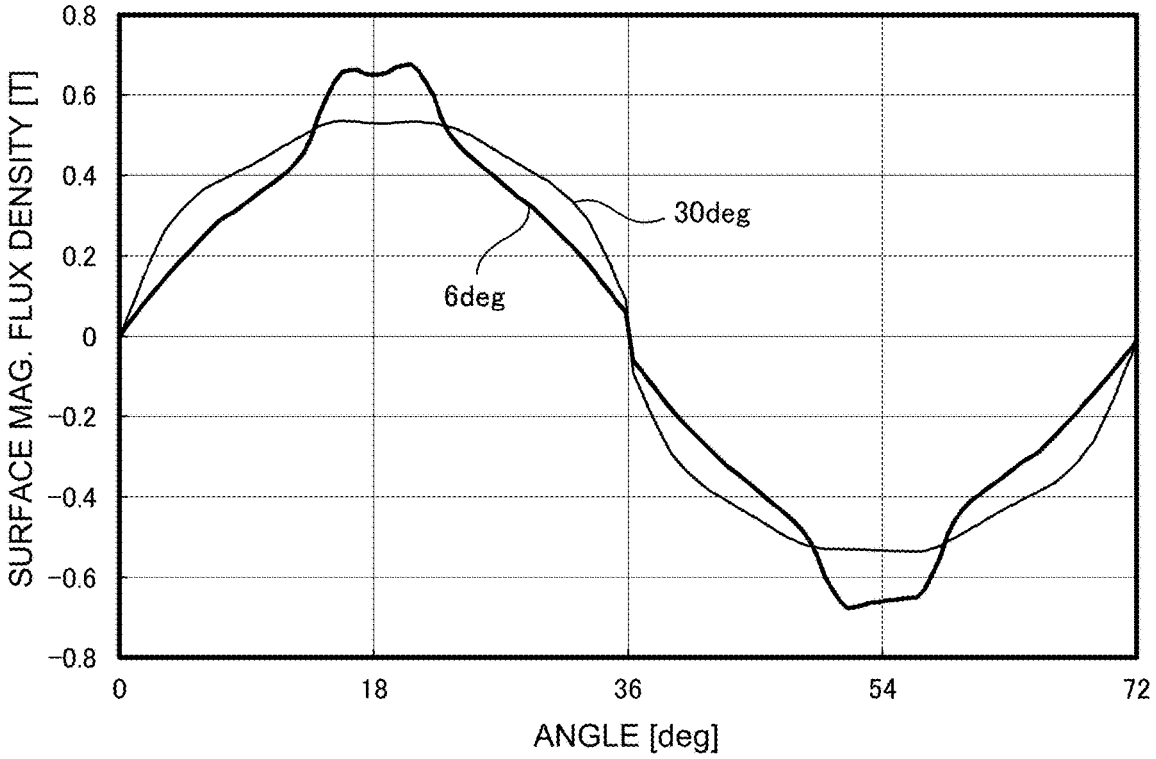
FIG. 29 is an enlarged graph corresponding to 0° to 72° in the graph of FIG. 28.

To confirm the degree of convergence of the magnetic flux from the produced bonded magnet, the surface magnetic flux of the bonded magnet is measured. For example, FIG. 28 is a graph showing the surface magnetic flux density [T] of the cylindrical columnar bonded magnets, which are constructed of the bonded magnet components having central angle of 30° and 6° shown in FIGS. 5B and 5F, along the circumferential direction (0° to 360°). FIG. 29 shows an enlarged part of this graph. From this enlarged part of the graph, it can be seen that, when the width WD of the magnetizing magnet is small, the magnetic flux is converged so that the surface magnetic flux density can be high, and the surface magnetic flux density curve can have a sharp profile. When the width WD of the magnetizing magnet is relatively large, the peak value of the surface magnetic flux density is reduced, and the profile of the surface magnetic flux density curve smoothly rises and falls. Accordingly, the central angle of the bonded magnet component can be estimated from the profile of the surface magnetic flux density curve.

Comparative Test 2

Figure 30:
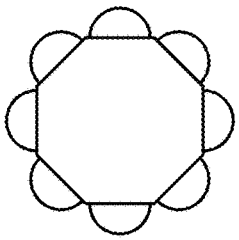
FIG. 30 shows a table showing the results of the measured surface magnetic flux densities of magnets of an example 1 and comparative examples 1 to 3.
Figure 30:
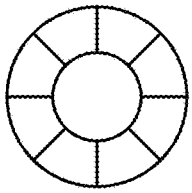
Figure 30:
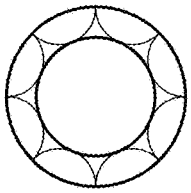
Figure 30:
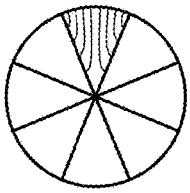

FIG. 30 is a table showing the simulated results of the magnetic flux densities obtained by circular-rod-shaped (columnar or cylindrical) bonded magnets and a circular-rod-shaped sintered magnet to be used as a permanent magnet for a rotor of an electric motor, or the like, in a comparative test 2. In this test, the surface magnetic flux density is calculated for a conventional sintered magnet as a comparative example 1 (sample 1), a bonded magnet of the radial orientation as a comparative example 2 (sample 2), a bonded magnet of the polar orientation as the comparative example 3 (sample 3), and the cylindrical columnar bonded magnet according to an example 1 (sample 4), which is produced by the process according to the foregoing first embodiment. In this test, NdFeB is used as magnetic powder for the sintered magnet or the bonded magnets. As shown in the table, the surface magnetic flux densities of the samples 1, 2, 3 and 4 are 4000 G, 2000 G, 3000 G, and 4000 G, respectively. According to the results, although the magnet according to the first embodiment is a bonded magnet, the surface magnetic flux density of this bonded magnet can be equivalent to the sintered magnet, which is considered as the strongest magnet. Consequently, it is confirmed that the bonded magnet according to the first embodiment can provide a very high magnetic flux density equivalent to the level of a sintered magnet. On the other hand, even if neodymium, which is considered as the strongest magnetic material among the known magnetic material, is not used, a sufficient magnetic flux density can be provided by using samarium for the magnetic materials. For this reason, the present embodiment is very useful in terms of effective utilization of limited natural resources, and country risk.

Also, in the case where the bonded magnet according to this embodiment is used for a rotor of an electric motor, the bonded magnet can have a cylindrical columnar shape and is integrally formed with the rotor dissimilar to a conventional rotor of SPM which has permanent magnets that are adhered on the surface of the rotor.

Second Embodiment

Figure 31:
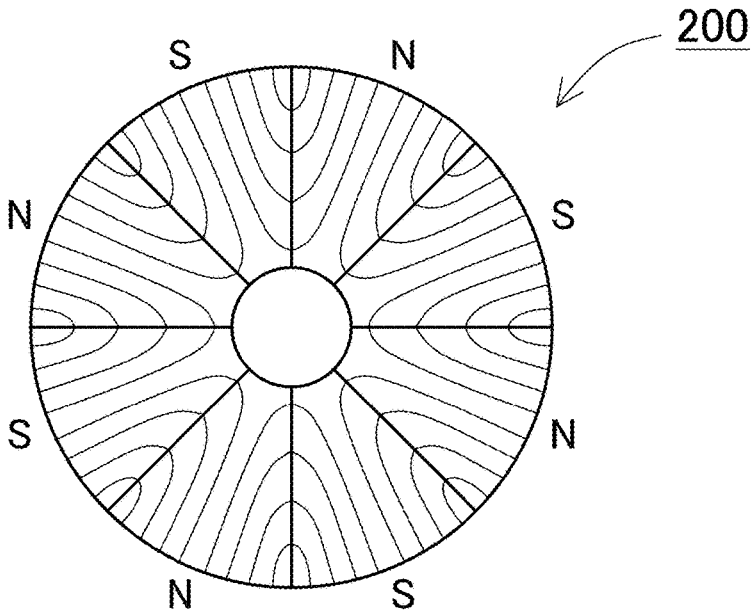
FIG. 31 is a schematic cross-sectional view showing a bonded magnet according to a second embodiment.

Although it has been described that the bonded magnet according to the foregoing embodiment has a cylindrical columnar shape, the present invention is not limited to the cylindrical columnar bonded magnet but can be applied to bonded magnets having other shapes. For example, the present invention can be applied to a cylindrical bonded magnet 200 according to a second embodiment which has a circular hole as shown in a cross-sectional view of FIG. 31. The bonded magnet component according to this embodiment can be produced similarly to the first embodiment. In particular, in the case where magnetic paths which do not extend to the central part of the cylindrical shape can provide a sufficient magnetic flux density, the required amounts of the bonded magnet composition such as the magnetic material and the resin can be reduced by the construction of this embodiment. In addition, the weight of the bonded magnet can be reduced.

In the case shown in FIG. 1, or the like, all of the connection portion between the first surface 11 and the second surface 12, the connection portion between the first surface 11 and the fifth surface 15, the connection portion between the third surface 13 and the fourth surface 14, and the connection portion between the third surface 13 and the sixth surface 16 have the same straight line as a part of the radius of the sector shape as viewed in section. In the case of the cylindrical bonded magnet 200 shown in FIG. 31, all of the connection portion between the first surface 11 and the second surface 12, the connection portion between the second surface 12 and the fifth surface 15, the connection portion between the third surface 13 and the fourth surface 14, and the connection portion between the fourth surface 14 and the sixth surface 16 have the same straight line as a part of the radius of the sector shape as viewed in section, while both the connection portion between the first surface 11 and the fifth surface 15, and the connection portion between the third surface 13 and the sixth surface 16 are recessed as viewed in section.

Modified Embodiment

Figure 32:
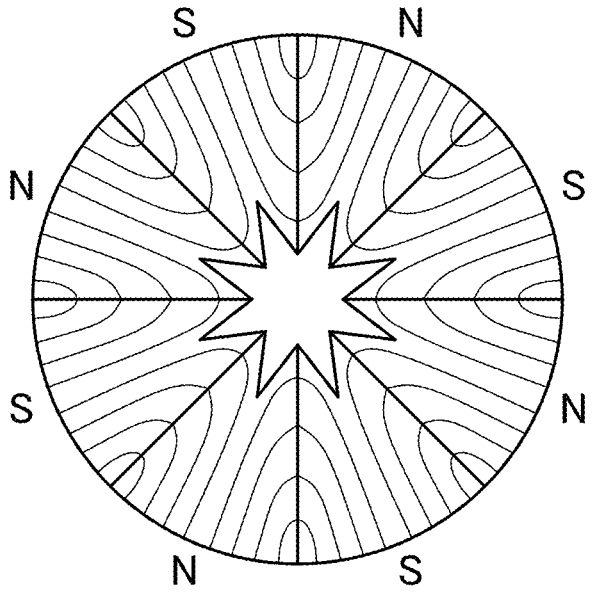
FIG. 32 is a schematic cross-sectional view showing a bonded magnet according to a modified embodiment.

Although it has been described that the bonded magnet according to the foregoing embodiment has a circular hole extending along its center axis, the hole is not limited to a circular shape in section but can be any shapes. For example, the hole can be a star shape as shown in a cross-sectional view of FIG. 32. In particular, in the case where the protruding part of the star shape is interposed between the convex parts of parabolas of magnetic paths, the adverse effect on the magnetic paths can be reduced while reducing the volume and weight of the bonded magnet, and the required amount of the bonded magnet composition. In this case, all of the connection portion between the first surface 11 and the second surface 12, the connection portion between the second surface 12 and the fifth surface 15, the connection portion between the third surface 13 and the fourth surface 14, and the connection portion between the fourth surface 14 and the sixth surface 16 have the same straight line as a part of the radius of the sector shape as viewed in section, while each of the connection portion between the first surface 11 and the fifth surface 15, and the connection portion between the third surface 13 and the sixth surface 16 has a V shape as viewed in section. More specifically, the sectionally V-shaped connection portion between the first surface 11 and the fifth surface 15, or between the third surface 13 and the sixth surface 16 is formed by two planar surfaces.

Figure 33:
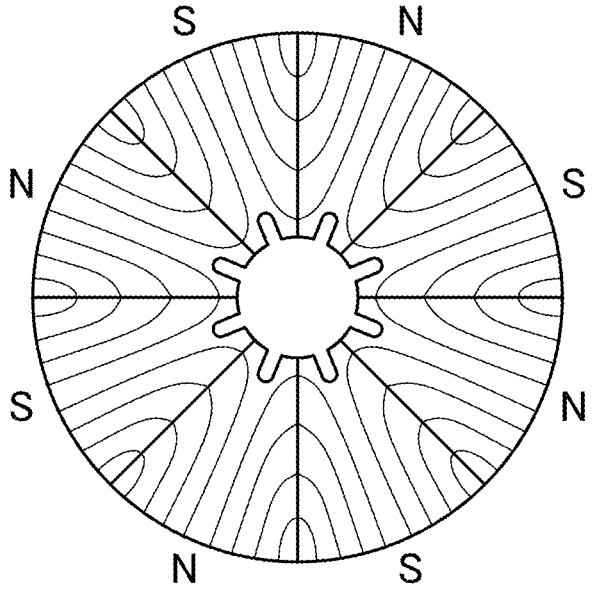
FIG. 33 is a schematic cross-sectional view showing a bonded magnet according to another modified embodiment.
Figure 34:
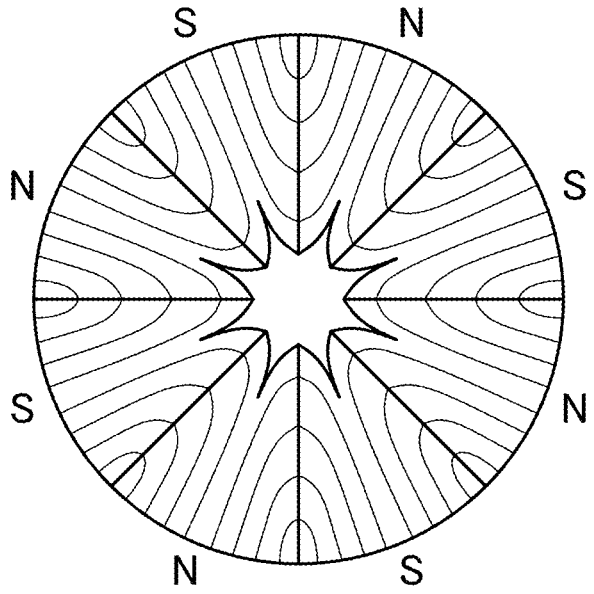
FIG. 34 is a schematic cross-sectional view showing a bonded magnet according to another modified embodiment.
Figure 35:
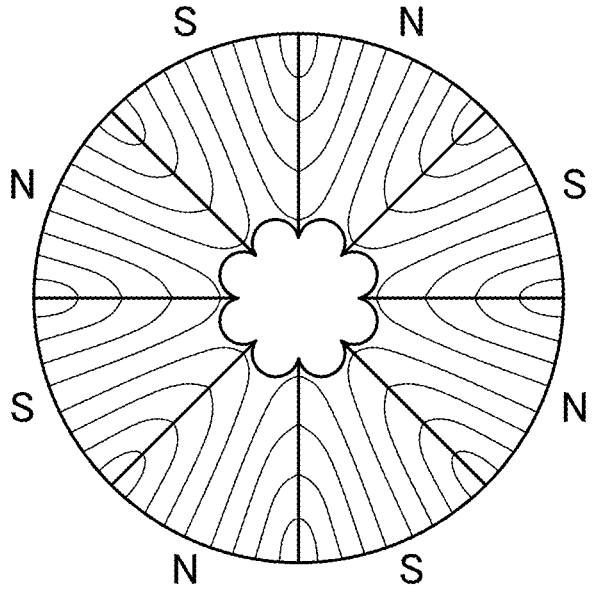
FIG. 35 is a schematic cross-sectional view showing a bonded magnet according to another modified embodiment.

Also, the hole can be a circular shape having protruding parts which are spaced at a fixed interval away from each other, and protrude from the circumference of the circular shape, as shown in a cross-sectional view of FIG. 33. The protruding part can have a semi-circular shape with a smaller radius, a half elliptical shape, or a half track shape as viewed in section. Also, the hole can be formed by connecting tapering parts, which taper along the parabolic curves of the magnetic paths as viewed in section, to each other as shown in a cross-sectional view of FIG. 34. Also, the hole can be a "flower shape" as viewed in section that is formed by connecting semicircles to each other as shown in a cross-sectional view of FIG. 35. As discussed above, the bonded magnet according to the present embodiment can have a hole having any shapes that reduce adverse effects on the magnetic paths to a minimum. In all the cases shown in FIGS. 33 to 35, all of the connection portion between the first surface 11 and the second surface 12, the connection portion between the second surface 12 and the fifth surface 15, the connection portion between the third surface 13 and the fourth surface 14, and the connection portion between the fourth surface 14 and the sixth surface 16 have the same straight line as a part of the radius of the sector shape as viewed in section, while both the connection portion between the first surface 11 and the fifth surface 15, and the connection portion between the third surface 13 and the sixth surface 16 have shapes formed by surfaces obtained by partially removing the vertex parts of the sectionally sector-shaped component formed by the surfaces corresponding to the radii of the sector shapes as viewed in section. The adjacent surfaces from which the vertex parts are removed are connected along a straight line to each other.

Third Embodiment

Figure 36:
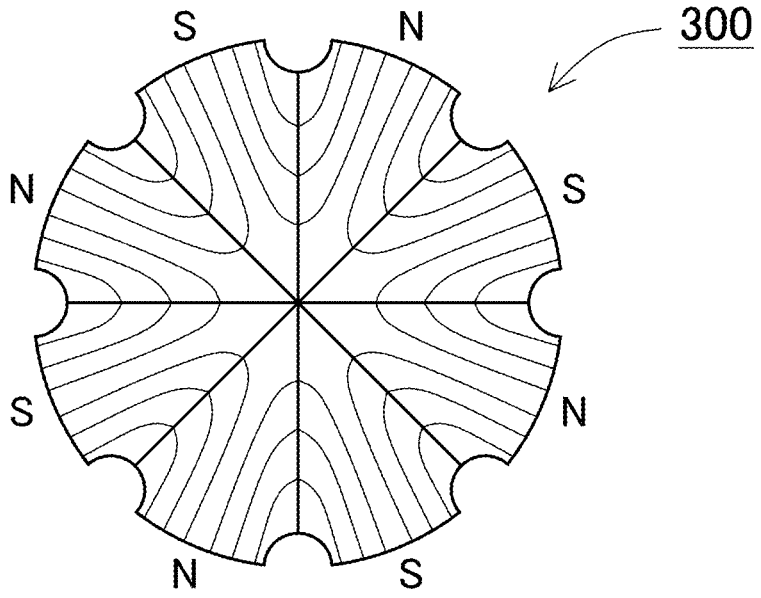
FIG. 36 is a schematic cross-sectional view showing a bonded magnet according to a third embodiment.

Although it has been described that a part of the bonded magnet according to the second embodiment is removed on the center side of the cylindrical columnar shape from the non-action surfaces, which are joint surfaces between the adjacent bonded magnet components, the present invention is not limited to this. Parts of the bonded magnet may be removed from the action surface, in other words, from the circumference of the cylindrical columnar shape. As this type of bonded magnet, FIG. 36 shows a bonded magnet 300 according to a third embodiment. This illustrated bonded magnet 300 has recessed parts which can be formed by removing arc-shaped parts of the bonded magnet component in the circumference of the cylindrical columnar shape from the joint surfaces of the bonded magnet. In this embodiment, the recessed parts extend in the height direction or longitudinal direction of the cylindrical columnar shape so as to be formed in a slit shape, and are spaced at a fixed interval, which corresponds to the length of the segment of a circle of the bonded magnet component, away from each other. In particular, in the case where the cylindrical columnar bonded magnet is used for a rotor of an electric motor, the permanent magnets are not arranged along the entire circumference of the cylindrical columnar shape but are spaced at a fixed interval away from each other. For this reason, the bonded magnet 300 according to the third embodiment is suitably used for a rotor of an electric motor. In addition, the material cost and the weight of the bonded magnet can be reduced by the reduction of the volume of the bonded magnet according to the third embodiment.

In this case both the connection portion between the first surface 11 and the fifth surface 15, and the connection portion between the third surface 13 and the sixth surface 16 have the same straight line as a part of the radius of the sector shape as viewed in section, while all of the connection portion between the first surface 11 and the second surface 12, the connection portion between the second surface 12 and the fifth surface 15, the connection portion between the third surface 13 and the fourth surface 14, and the connection portion between the fourth surface 14 and the sixth surface 16 are recessed as viewed in section.

Fourth Embodiment

Figure 37:
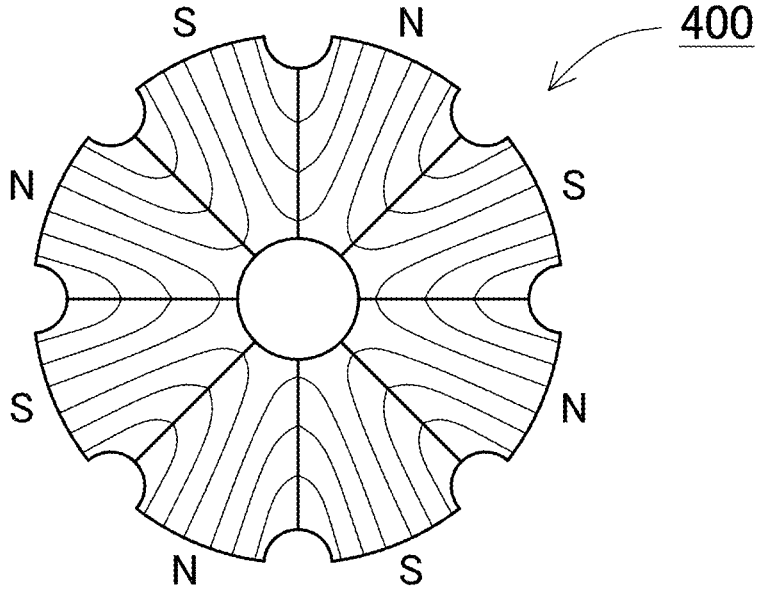
FIG. 37 is a schematic cross-sectional view showing a bonded magnet according to a fourth embodiment.

Although it has been described that a part or parts of the bonded magnet according to the second or third embodiment are removed from one of the end parts of the non-action surface, which serves as the joint plane between the adjacent bonded magnet components, the present invention is not limited to this. Parts of the bonded magnet may be removed from the both end parts of the non-action surface. As this type of bonded magnet, FIG. 37 is a cross-sectional view showing a bonded magnet 400 according to a fourth embodiment. According to this embodiment, the aforementioned effects can be provided such as improvement in the magnetic flux density on the action surface, weight reduction, and cost reduction.

As discussed above, parts of the bonded magnet can be suitably removed from the non-action surfaces. The non-action surface is not limited to a planar surface. The non-action surface may be formed in a suitable shape such as a smooth curved surface, or a partially rectangular wave shape. In particular, in the case where the non-action surface has rectangular recessed and protruding shapes, the bonded magnet components can be accurately positioned by engaging their rectangular recessed and protruding shapes with each other when coupled to each other. For this reason, the workability can be improved when the bonded magnet is assembled.

Fifth Embodiment

Figure 38:
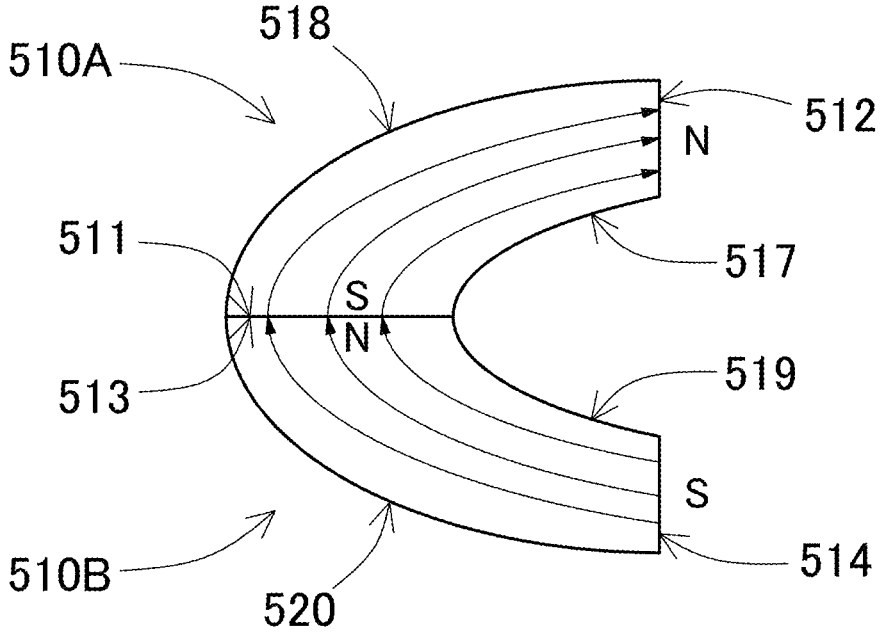
FIG. 38 is a schematic cross-sectional view showing a pair of bonded magnet components according to a fifth embodiment.

Although it has been described that bonded magnet components according to the foregoing embodiments have a sector-shaped end surface, the end surface of the bonded magnet component according to the present invention is not limited to a sector shape but can be other shapes. A first bonded magnet component 510A in a pair of bonded magnet components according to a fifth embodiment shown in FIG. 38 has seventh and eighth surfaces 517 and 518 which extend between first and second surfaces 511 and 512 as viewed in section. It can be said that the first bonded magnet component 510A has a tapered shape, which is defined by the first surface 511, the seventh surface 517, the second surface 512, and the eighth surface 518, as viewed in section. Similar to the first bonded magnet component 510A, a second bonded magnet component 510B has ninth and tenth surfaces 519 and 520 which extend between third and fourth surfaces 513 and 514 as viewed in section. It can be also said that the second bonded magnet component 510B has a tapered exterior shape, which is defined by the third surface 513, the ninth surface 519, the fourth surface 514, and the tenth surface 520, as viewed in section. When the first bonded magnet component 510A is coupled to the second bonded magnet component 510B, the pair of bonded magnet components is formed in a U shape so that the second and fourth surfaces 512 and 514 face the same side. According to this arrangement, magnetic poles are exposed to the outside on the surfaces of the bonded magnet components that correspond to the radius sections (sides) of the sector shape. The circular columnar bonded magnet can be produced by coupling the side surfaces of the bonded magnet components to each other with the magnetic poles of the joint side surfaces of adjacent bonded magnet components being opposite to each other.

Figure 39:
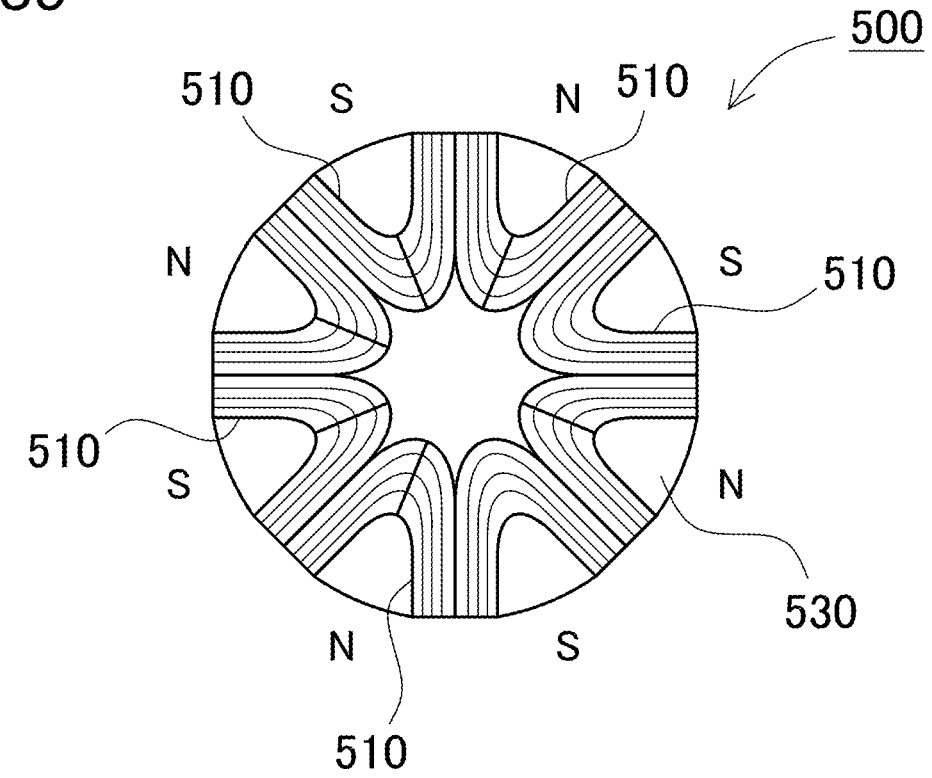
FIG. 39 is a schematic cross-sectional view showing a bonded magnet composed of pairs of the bonded magnet components shown in FIG. 38.

For example, a bonded magnet 500 is constructed of pairs of bonded magnet components 510 the end surfaces of which are aligned on a circle as viewed in section as shown in FIG. 39. This bonded magnet 500 can be used for a rotor of an electric motor. This illustrated bonded magnet 500 includes a member which is formed of a high-permeability material. The space between the adjacent bonded magnet components 510 is filled with the high-permeability member. In other words, the pairs of bonded magnet components 510 are embedded in this high-permeability structure so that the bonded magnet 500 has a cylindrical columnar exterior shape.

Figure 40:
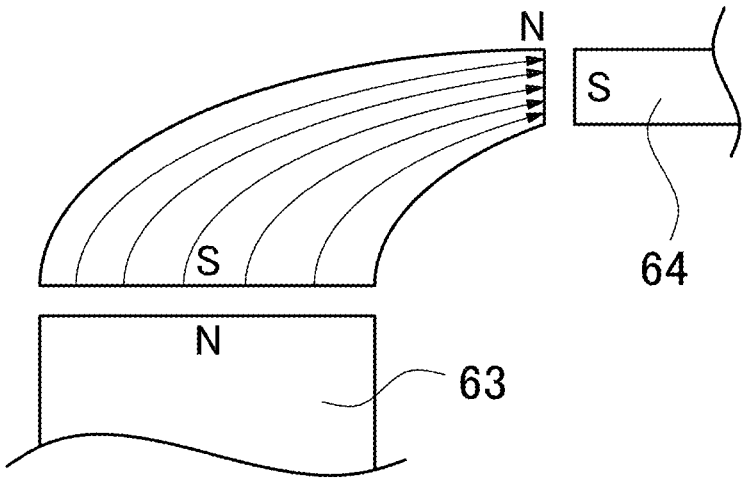
FIG. 40 is a schematic cross-sectional view showing a cavity for forming the bonded magnet component shown in FIG. 38, and magnets for controlling the magnetic orientation of this bonded magnet component.

The bonded magnet component can be formed by magnetizing magnets 63 and 64, which are arranged as shown in FIG. 40.

Figure 41:
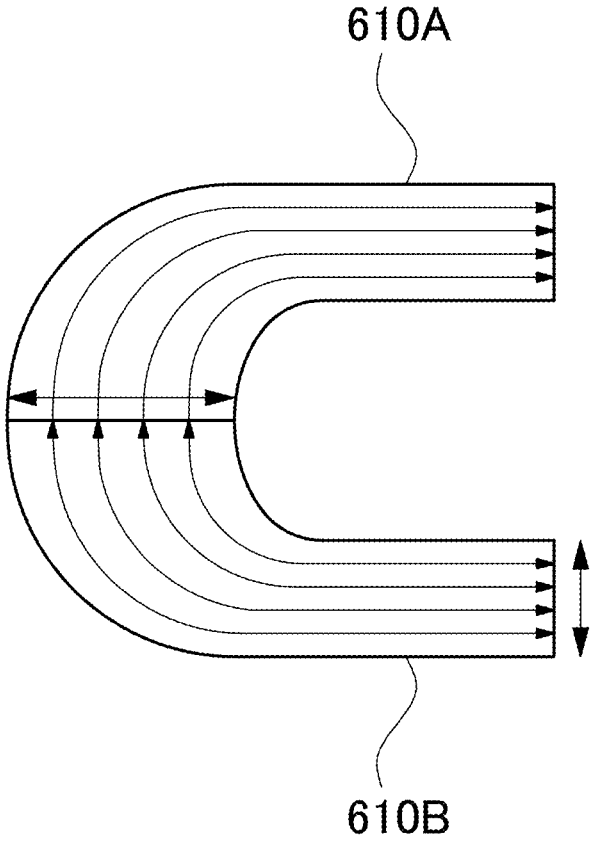
FIG. 41 is a schematic cross-sectional view showing a pair of bonded magnet components according to a modified embodiment.

A pair of bonded magnets can be formed in a U shape or a half track shape constructed of bonded magnet components 610A and 610B as shown in FIG. 41.

Sixth Embodiment

Figure 42:
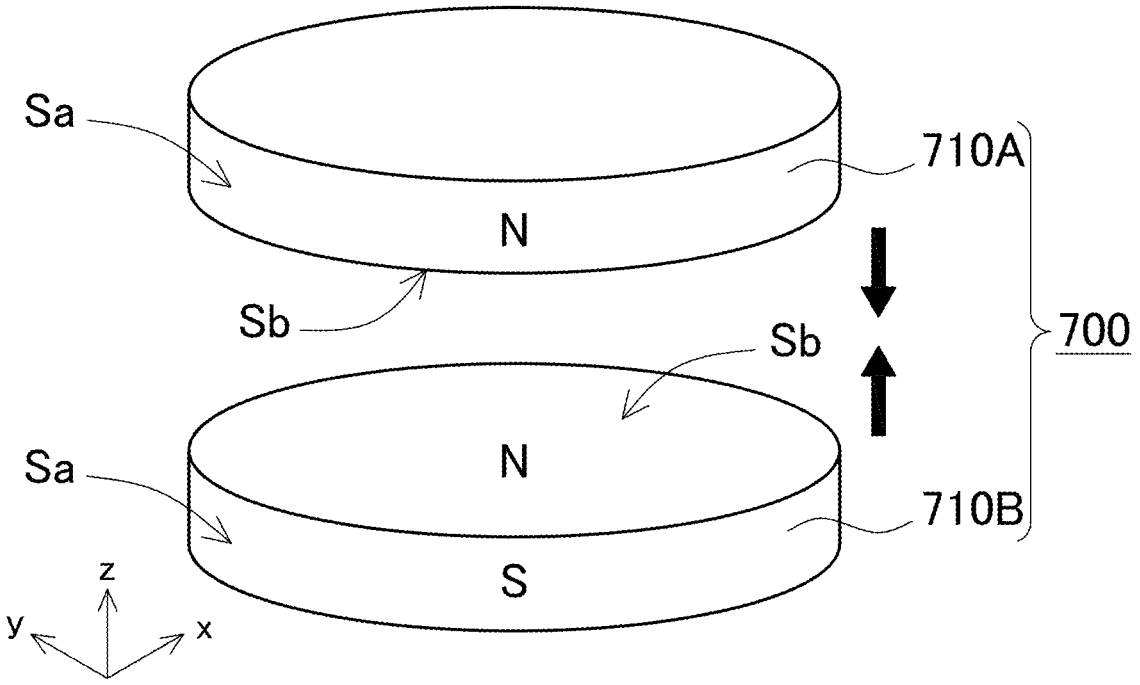
FIG. 42 is an exploded perspective view showing a pair of bonded magnets according to a sixth embodiment.
Figure 43:
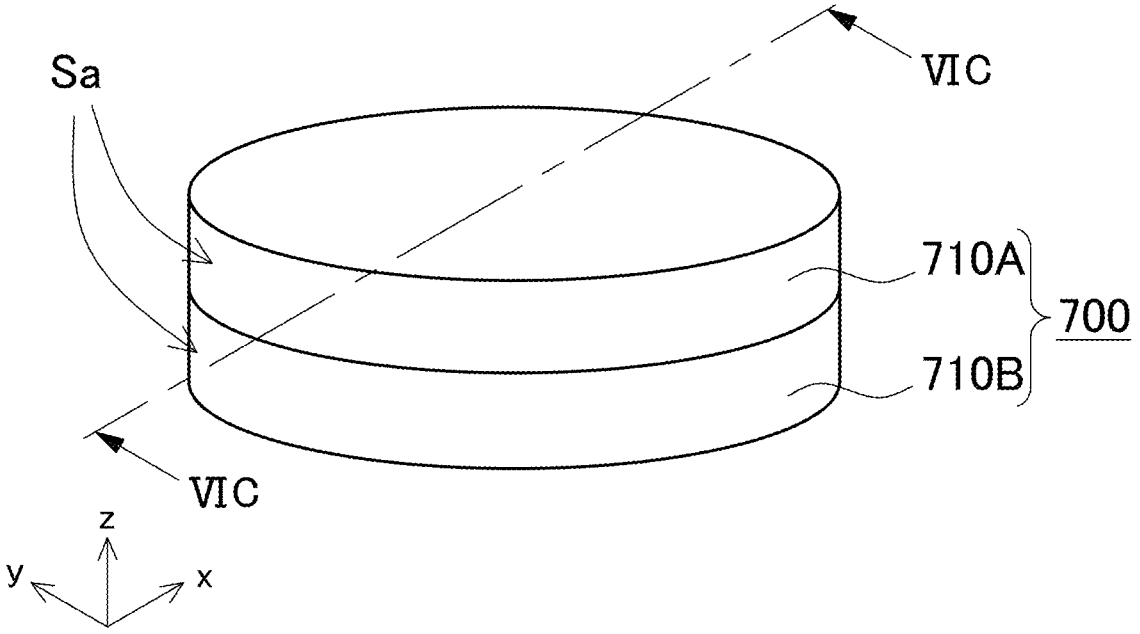
FIG. 43 is a perspective view showing the pair of coupled bonded magnet components shown in FIG. 42.
Figure 44:
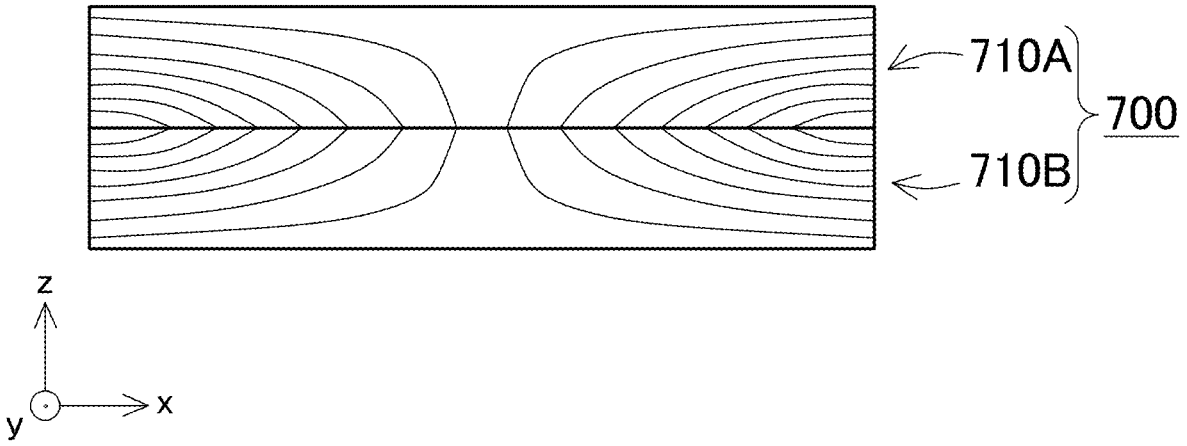
FIG. 44 is a cross-sectional view showing the orientation of axis of easy magnetization of magnetic powder particles in the pair of bonded magnet components taken along the line VIC-VIC shown in FIG. 43.
Figure 45:
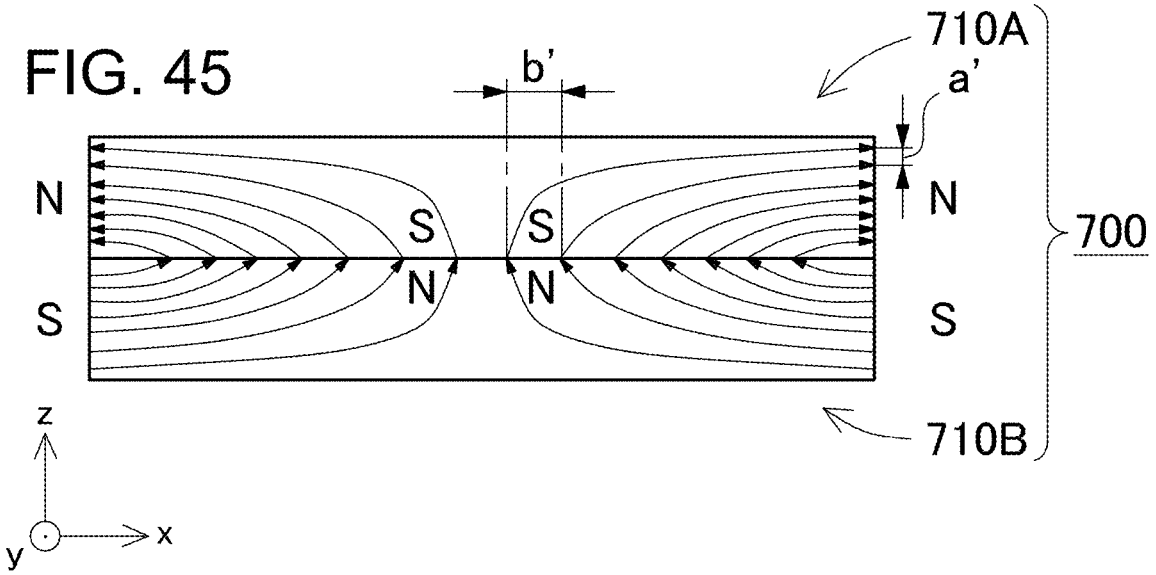
FIG. 45 is a cross-sectional view showing the magnetic lines of flux in the pair of bonded magnet components shown in FIG. 44.

Although it has been described that one magnetic flux group is formed in a single bonded magnet component in the fifth embodiment, and two magnetic flux groups are aligned in the thickness direction on the common action surface in the first embodiment, and the like, the present invention is not limited to these arrangements but can be applied to other arrangements. For example, magnetic path groups can be aligned in the horizontal direction as viewed in section. This type of arrangement is shown as bonded magnets according to a sixth embodiment shown in FIGS. 42 to 46. A bonded magnet 700 is constructed of a pair of bonded magnet components 710A and 710B, as shown in FIGS. 42 and 43. As shown in FIGS. 44 and 45, two opposite poles appear on the side surface of the bonded magnet when the upper surface of the bonded magnet component 710B is coupled to the lower surface of the bonded magnet component 710A. The direction of magnetic lines of flux of the coupled bonded magnet components are opposite to each other. That is, in the case where one (first bonded magnet 710A) of the magnet components has a first group of magnetic lines of flux 21 which is formed inside so that the south pole appears on its lower surface 12 while the north pole appears on its side surface 13, another (second bonded magnet 710B) has a second group of magnetic lines of flux 22 which are formed inside so that the north pole appears on its upper surface 11 while the south pole appears on its side surface 13 as shown in FIG. 45. The south pole on the lower surface of the first bonded magnet 710A is coupled by the attractive force to the north pole on the upper surface of the second bonded magnet 710B. Thus, the first group of magnetic lines of flux 21 is connected to the second group of magnetic lines of flux 22 so that the first and second magnetic groups of lines of flux continuously extend from one to another. Accordingly, the magnetic paths can be elongated inside the bonded magnet 700. As a result, the magnetic flux can be increased.

The bonded magnet components 710A and 710B can be separately formed. The first bonded magnet component 710A can be produced by a magnetic circuit device 120 or 130 shown in FIG. 47 or 48. In the case where magnetizing magnets are orientated opposite to the case of the magnetic circuit device 120 or 130, the magnetic orientation of the bonded magnet component can be opposite to the first bonded magnet component 710A. That is, the first bonded magnet component 710A can be produced by the magnetizing magnets which are orientated with their north poles facing each other, while the second bonded magnet 710B can be produced the magnetizing magnets which are orientated with their south poles facing each other.

Figure 47:
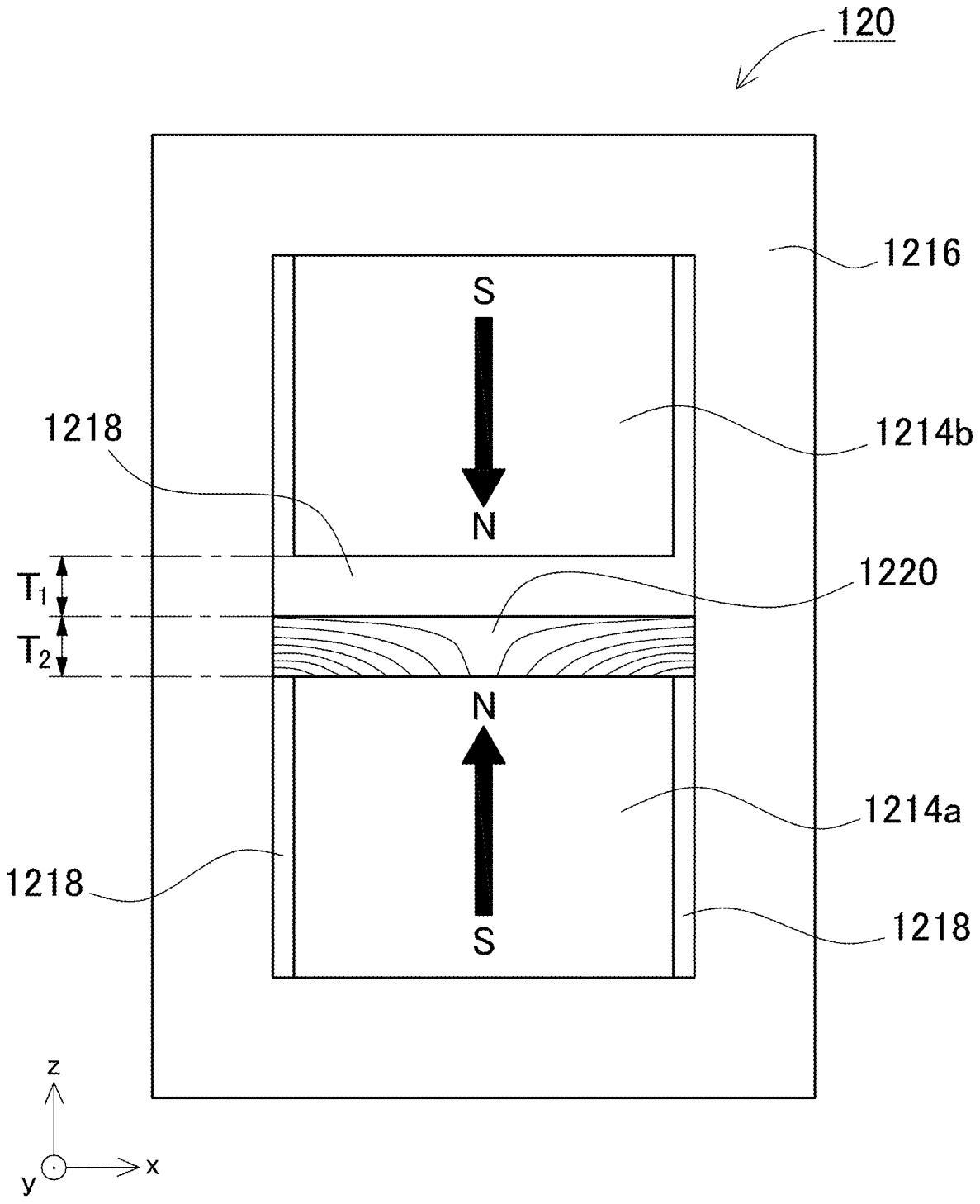
FIG. 47 is a schematic cross-sectional view showing a magnetic circuit device for producing the bonded magnet component according to the sixth embodiment.

FIG. 47 shows the magnetic circuit device 120 in a production device for producing the bonded magnet component. The magnetic circuit device 120 has a cavity 1220 to be filled with the bonded magnet composition containing the magnetic material and the resin. Magnetizing magnets 1214*a* and 1214*b* are arranged so that the cavity 1220 is interposed between them. The magnetizing magnets 1214*a* and 1214*b* apply an external magnetic field to the cavity 1220 to magnetically control the magnetic orientation of the magnetic material during the molding process of the bonded magnet component. The magnetizing magnets 1214*a* and 1214*b* are permanent magnets the magnetic forces of which extend in a direction perpendicular to the non-action surface of the bonded magnet component to be formed in the molding process. The magnetizing magnets 1214*a* and 1214*b* are orientated so that their poles facing each other are the same (north pole in the case of FIG. 47). The external magnetic field is formed by first and second external magnetic field parts that are distributed by facing the same poles of the magnetizing magnets 1214*a* and 1214*b* to each other. The cavity 1220 is interposed between the first and second magnetizing magnets 1214*a* and 1214*b* but deviated toward the first magnetizing magnet 1214*a* in the Z direction, where the axial direction of the magnetizing magnets 1214*a* and 1214*b* is defined as the Z direction.

A division wall formed of nonmagnetic steel material is interposed between the first magnetizing magnet 1214*a* and the cavity 1220 (the non-action surface of molded magnet component). The first magnetizing magnet 1214*a* will face the non-action surface of the molded magnet component. The second magnetizing magnet 1214*b* is spaced at the same distance (T1) as the depth (T2) of the cavity 1220 away from the cavity in the Z direction. A nonmagnetic steel part 1218 is arranged in the non-cavity part which corresponding to the distance T1. A yoke 1216 having a relative permeability of 100 to 1,000,000 is arranged to face the circumferential side surface of the cavity 1220, which corresponds to the action surface as the circumferential side surface of the bonded magnet component. As a result, the north-south magnetic lines of flux are formed in the curves shown in FIG. 47 inside the cavity 1220 by the magnetizing magnets 1214*a* and 1214*b*, which are arranged as discussed above. It may be preferable that an additional magnetizing magnet is arranged to face the circumferential side surface of the cavity 1220, which corresponds to the action surface as the circumferential side surface of the bonded magnet component. This cavity 1220 is filled up with the bonded magnet composition which is a melted mixture of the magnetic material and the resin. It is preferable that the magnetic orientation of the bonded magnet composition is controlled by the external magnetic field applied to the bonded magnet composition within the time that bonded magnet composition has flowability, and after the magnetic orientation control is completed the bonded magnet composition is immediately cooled and cured by air or water so that the magnetic orientation of the magnetic powder is fixed.

In this embodiment, the two magnetizing magnets 1214*a* and 1214*b* are orientated so as to repel each other so that a strong magnetic field radially extend from the central part. Since the second magnetizing magnet 1214*b* is spaced at the distance away from the cavity 1220, the magnetic lines of flux are formed from the lower surface toward the circumferential side surface so that the magnetic lines of flux will not appear on the upper surface of the bonded magnet component. Since magnetic lines of flux are less likely to appear on the upper surface, the magnetic lines of flux can be converged on the side surface as the action surface. As a result, the number of the lines of magnetic induction per unit area can be increased.

Figure 48:
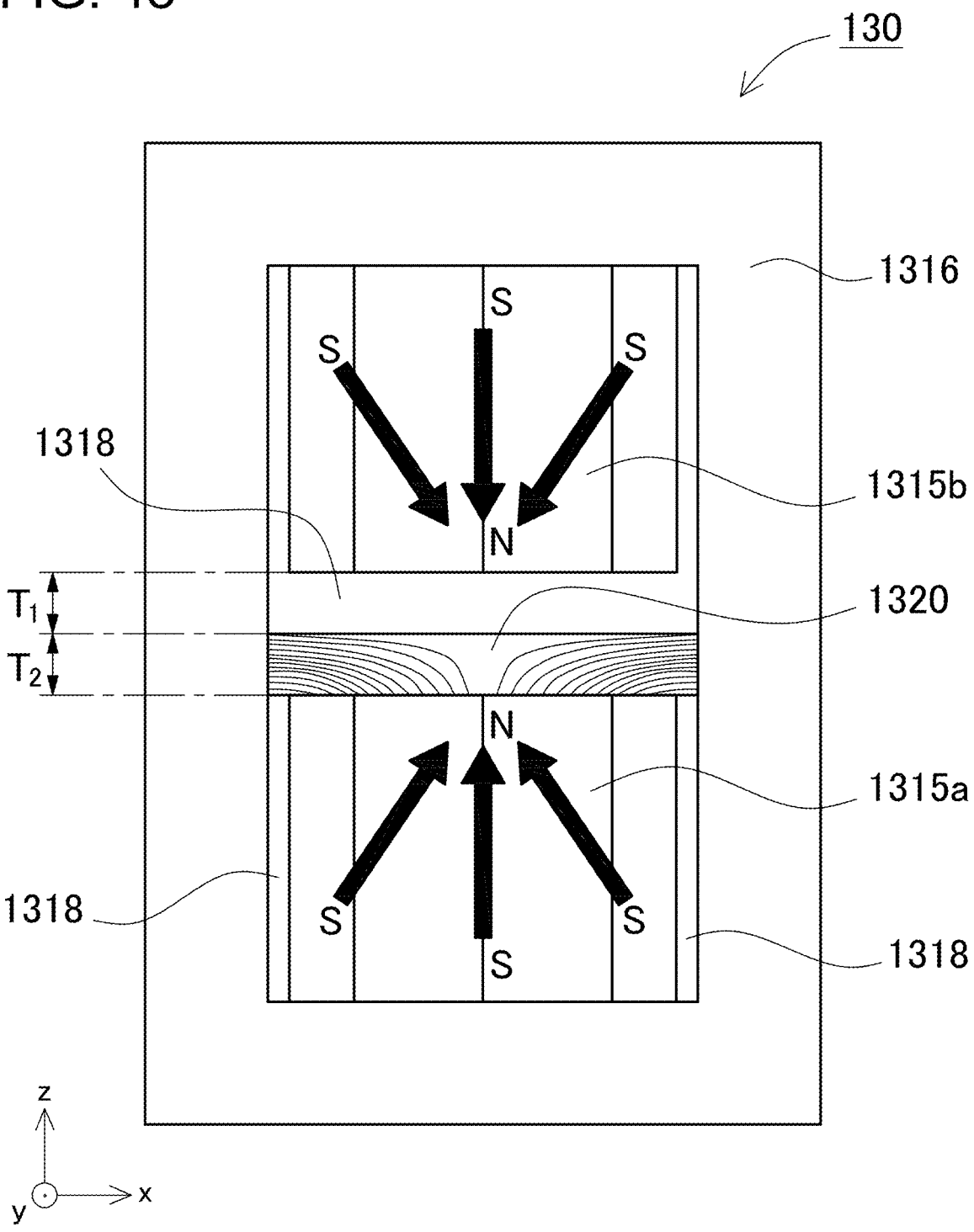
FIG. 48 is a schematic cross-sectional view showing another magnetic circuit device for producing the bonded magnet component according to the sixth embodiment.

The magnetic circuit device 130 shown in FIG. 48 can also be used as the production device for producing the bonded magnet components or the bonded magnet instead of the magnetic circuit device 120 shown in FIG. 47. Magnetizing magnets 1315*a* and 1315*b* shown in FIG. 47 has a cylindrical shape. The magnetizing magnet 1315*a* or 1315*b* is constructed of eight parts each of which corresponds to a 45-degree sector, which is obtained by dividing the cylindrical shape into eight equal parts by radially extending straight lines as viewed in section. The magnetizing magnets 1315*a* or 1315*b* are orientated so that their magnetic lines of flux are converged at one point on the lower surface of the cylindrical shape. That is, the magnetic orientation of the magnetizing magnet 1315*a* or 1315*b* tilts inward with respect to the axial direction of the magnetizing magnet. In this case, the magnetic orientation Θ of the magnetizing magnet 1315*a* or 1315*b* is 34° with respect to the axial direction of the magnetizing magnet. The magnetizing magnets 1315*a* and 1315*b* are arranged as the reflection of each other with their poles facing each other being the same so that the magnetic forces are focused toward the cavity 1320. Similar to the case of FIG. 47, the second magnetizing magnet 1315*b* is spaced at the same distance (T1) as the depth (T2) of the cavity 1320 away from the cavity in the z direction. As a result, the north-south magnetic lines of flux are formed in the curves shown in FIG. 48 inside the cavity 1320 by the magnetizing magnets 1315*a* and 1315*b*, which are arranged as discussed above. The yoke 1316 and the nonmagnetic steel part 1318 in the magnetic circuit device 130 can be constructed, and an additional magnetizing magnet can be arranged to face the circumferential side surface of the cavity 1320 similarly to the case of FIG. 47. Therefore, their description is omitted.

FIG. 44 shows the orientation of axis of easy magnetization of magnetic powder particles in the disc-shaped bonded magnet 700 taken along the line VIC-VIC shown in FIG. 42, or the like. When the surfaces (the upper and lower surfaces Sb), which intersect to the circumferential side surface as the action surfaces (Sa), are coupled to each other, the magnet can be produced which has two poles on the action surfaces (Sa). The magnet can be easily produced by coupling the Sb surfaces of the molded components, which have opposite magnetic poles, to each other. According to this arrangement, the magnetic paths extend along the narrow areas of the two magnets corresponding to their thickness so that the surface magnetic flux density can be significantly increased, and in addition to this the leakage flux density can be small from surfaces other than the action surfaces.

Figure 46:
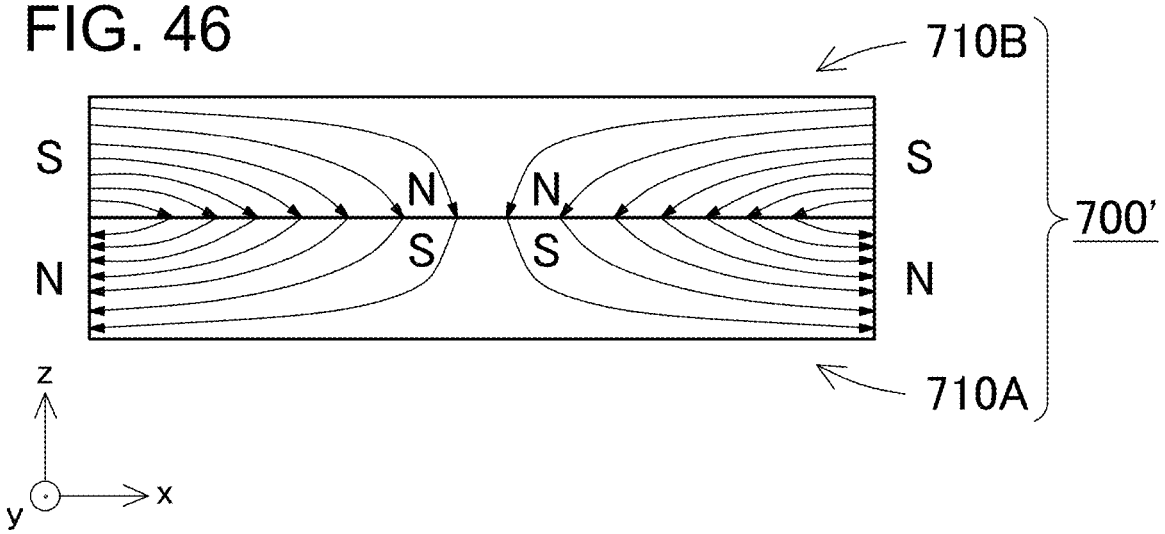
FIG. 46 is a cross-sectional view showing the magnetic lines of flux in another pair of bonded magnet components.

As shown in FIG. 46, the two bonded magnet components 710A and 710B may be coupled to each other so that the direction of the magnetic lines of flux of the bonded magnet 700' is reversed from the case of FIG. 45. In this case, the bonded magnet 700 of FIG. 45 is upside down so that the second bonded magnet component 710B is arranged on the top side, and the first bonded magnet component 710A is arranged on the bottom side. Accordingly, the north pole surface as the joint surface of the second bonded magnet component 710B faces the south pole surface as the joint surface of the first bonded magnet 710A. As a result, the magnetic paths of the two bonded magnet components are connected to each other, and continuously extend from one to another. Therefore, the surface magnetic flux density on the magnetic pole, which is exposed on the side surface, can be increased. In addition, pairs of disc-shaped first and second bonded magnets 710A and 700B magnet may be stacked on one after another. As a result, a bonded magnet can be produced having magnetic poles which are alternately exposed on the cylindrical side surface. In this arrangement, the joint planes between the bonded magnet components are parallel to each other.

In particular, in the case where the joint surface is planar, and the side surface serves as the magnetic pole surface on which one magnetic pole is exposed, the magnetic flux on the planar joint surface with a relatively large area can be converged on the side surface with a relatively small area, in other words, to the magnetic pole. As a result, the converged orientation can be realized for convergence of the magnetic flux. Therefore, the magnetic flux density on the one magnetic pole can be effectively increased. That is, since the interval a' between two magnetic lines of flux on the action surface is narrower than the interval b' of the two magnetic lines of flux on the non-action surface as shown in FIG. 45, the converged orientation is realized. The relation a'<b' relates to the magnetic flux density. In the present embodiment, the parabolic magnetic orientation is used which bends the magnetic paths from a straight line into a parabolic line, and elongates the magnetic paths whereby increasing the magnetic force. Consequently, a high surface magnetic flux density can be provided by the converged orientation together with the parabolic magnetic orientation.

As discussed above, according to the bonded magnet of the foregoing embodiment of the present invention, although the polar orientation is realized, the magnetic path deeply enters the cylindrical bonded magnet toward the center of the cylindrical shape. In addition, since the interval between the magnetic paths is wider on the magnetic pole (non-action surface) in the central part away from the bonded magnet surface (action surface), and the non-action surfaces of adjacent bonded magnet components, which have opposite magnetic poles, are coupled to each other, their magnetic paths are connected to each other through the joint plane so that they continuously extend from one to another. Since the magnetic paths deeply enters the cylindrical bonded magnet inward from the surface of the cylindrical bonded magnet, the operating point of the BH curve shown in FIG. 56 can be increased. Additionally, since the area of the magnetic pole on the non-action surface is large, while the area of the magnetic pole on the action surface is small, the magnetic paths are converged from the larger magnetic pole to the smaller magnetic pole. As a result, a very high surface magnetic flux density can be provided by both the polar orientation and the converged orientation. Therefore, although the magnet according to the present embodiment is a bonded magnet, the bonded magnet according to the present invention can provide magnetic flux as high as a sintered magnet.

The bonded magnet, which is produced as discussed above, may be embedded in a high-permeability material such as silicon steel, or the like. For example, as shown in FIG. 39, the bonded magnet can be constructed of pairs of bonded magnet components shown in FIG. 38. The pairs of bonded magnet components are arranged along the circumference of a circle centering the rotation axis. The gaps between the bonded magnet components can be filled with a high-permeability material.

Also, according to the aforementioned construction, a lateral orientation bonded magnet, which has magnetic poles on its side surface as the action surface, can be provided which has a small leakage flux from surfaces other than the action surface, and a field magnet unit can be provided which includes this lateral orientation bonded magnet. In addition, a method can be provided for producing a thin bonded magnet with a sufficient strength of the magnetic orientation.

Also, according to the aforementioned construction, the leakage flux can be small from surfaces other than the action surface of the bonded magnet. Therefore, a flat lateral orientation bonded magnet can be provided, and a field system unit can be provided which includes this flat lateral orientation bonded magnet.

Although it has been described that the samarium-iron-nitrogen magnet is used as the magnet powder for the bonded magnet in the foregoing embodiments, the present invention is not limited to this. For example, rare earth magnets can be used such as samarium cobalt magnet, neodymium magnet, praseodymium magnet, and the like.

A bonded magnet according to the present embodiment can be suitably used instead of sintered magnets used for electric motors which includes permanent magnets. Also, the bonded magnet according to the present embodiment can be used in applications that require a sufficient surface magnetic flux density, or a sufficient magnetic field of a field system. For example, the bonded magnet according to the present embodiment can be formed into various shapes, and can be used as a segment magnet for a precision motor, a VCM magnet for HDD, magnets for various types of sensors using magnetic signals (e.g., such as a currency detector), a magnet for a health appliance, a magnet for a foreign matter removing device, a magnet for a linear motor, and a magnet for a thin actuator (in particular, a magnet for a loudspeaker used in a thin TV, etc.).

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims.

What is claimed is:

1. A method for producing a flat bonded magnet having a first action surface on which the magnetic poles are exposed, and a first non-action surface connected to said first action surface, the method comprising:

providing a molding die cavity to be filled with a bond magnet composition that contains a magnetic material and a resin; and charging a melted mixture of the bond magnet composition into said cavity, and forming said bonded magnet while controlling the magnetic orientation of said magnetic material by applying an external magnetic field to said magnetic material, wherein said external magnetic field is formed by a first external magnetic field part and a second external magnetic field part that are distributed by facing the same poles to each other, said cavity is closer to said first external magnetic field part than to said second external magnetic field part in said same-poles-facing direction in the space where said first external magnetic field part and said second external magnetic field part are distributed, and said second external magnetic field part is arranged at substantially the same distance from said cavity as a depth of said cavity in said same-poles-facing direction.

2. The method for producing a flat bonded magnet according to claim 1, wherein a nonmagnetic steel part is arranged between said second external magnetic field part and said cavity.

3. The method for producing a flat bonded magnet according to claim 1, wherein said flat bonded magnet is disc-shaped.

4. The method for producing a flat bonded magnet according to claim 3, wherein a yoke having a relative permeability of 100 to 1,000,000 is arranged to face a circumferential side surface of said cavity, which corresponds to an action surface as a circumferential side surface of said bonded magnet.

5. The method for producing a flat bonded magnet according to claim 3, wherein an additional magnetizing magnet is arranged to face a circumferential side surface of said cavity, which corresponds to an action surface as a circumferential side surface of said bonded magnet.

6. A method for producing a flat bonded magnet having a first action surface on which the magnetic poles are exposed, and a first non-action surface connected to said first action surface, the method comprising:

providing a molding die cavity to be filled with a bond magnet composition that contains a magnetic material and a resin; and charging a melted mixture of the bond magnet composition into said cavity, and forming said bonded magnet while controlling the magnetic orientation of said magnetic material by applying an external magnetic field to said magnetic material by using magnetizing magnets for magnetically controlling the orientation of said magnetic material, wherein said magnetizing magnets comprise a first magnetizing magnet and a second magnetizing magnet that are orientated with the same poles facing to each other, said cavity is interposed between said first magnetizing magnet and said second magnetizing magnet, and is closer to said first magnetizing magnet than to said second magnetizing magnet in an axial direction from the first magnetizing magnet to the second magnetizing magnet, and said second magnetizing magnet is arranged at substantially the same distance from said cavity as a depth of said cavity in the axial direction.

7. The method for producing a flat bonded magnet according to claim 6, wherein a nonmagnetic steel part is arranged between said second magnetizing magnet and said cavity.

8. The method for producing a flat bonded magnet according to claim 6, wherein said flat bonded magnet is disc-shaped.

9. The method for producing a flat bonded magnet according to claim 8, wherein a yoke having a relative permeability of 100 to 1,000,000 is arranged to face a circumferential side surface of said cavity, which corresponds to an action surface as a circumferential side surface of said bonded magnet.

10. The method for producing a flat bonded magnet according to claim 8, wherein an additional magnetizing magnet is arranged to face a circumferential side surface of said cavity, which corresponds to an action surface as a circumferential side surface of said bonded magnet.

11. The method for producing a flat bonded magnet according to claim 1, wherein the first non-action surface is a flat surface.

12. The method for producing a flat bonded magnet according to claim 1, wherein a magnetic force of the first external magnetic field part extends in a direction perpendicular to the non-action surface of the flat bonded magnet.

13. The method for producing a flat bonded magnet according to claim 1, wherein an area of the first non-action surface is larger than an area of the first action surface.

14. The method for producing a flat bonded magnet according to claim 6, wherein the first non-action surface is a flat surface.

15. The method for producing a flat bonded magnet according to claim 6, wherein a magnetic force of the first magnetizing magnet extends in a direction perpendicular to the non-action surface of the flat bonded magnet.

16. The method for producing a flat bonded magnet according to claim 6, wherein an area of the first non-action surface is larger than an area of the first action surface.

17. The method for producing a flat bonded magnet according to claim 1, wherein said cavity is rectangular in a cross section.

18. The method for producing a flat bonded magnet according to claim 6, wherein said cavity is rectangular in a cross section.

* * * * *